US006595511B2

(12) United States Patent
Goda et al.

(10) Patent No.: US 6,595,511 B2
(45) Date of Patent: Jul. 22, 2003

(54) PAPER FEEDER

(75) Inventors: Mitsuhiro Goda, Osaka (JP); Masaki Higashiyama, Osaka (JP); Masami Fuchi, Osaka (JP); Kiyonori Yamamoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 10/107,355

(22) Filed: Mar. 28, 2002

(65) Prior Publication Data

US 2002/0145246 A1 Oct. 10, 2002

Related U.S. Application Data

(62) Division of application No. 09/599,512, filed on Jun. 23, 2000.

(51) Int. Cl.[7] ..... B65H 3/14
(52) U.S. Cl. ..... 271/98
(58) Field of Search ..... 271/97, 980, 106 C, 271/104 C, 105, 195; 220/58.24, 52.24; 400/627; 414/797

(56) References Cited

U.S. PATENT DOCUMENTS

| | | | | |
|---|---|---|---|---|
| 5,071,110 A | * | 12/1991 | Arnone et al. | 271/104 |
| 5,150,892 A | | 9/1992 | Shimizu | 271/98 |
| 5,181,706 A | | 1/1993 | Yamamoto | 271/98 |
| 5,181,709 A | | 1/1993 | Okada et al. | 271/98 |
| 5,181,710 A | | 1/1993 | Takata et al. | 271/98 |
| 5,184,812 A | | 2/1993 | Namba | 271/98 |
| 5,344,133 A | * | 9/1994 | Jantsch et al. | 128/870 |
| 5,472,310 A | | 12/1995 | Frank | 414/798.9 |
| 5,634,634 A | * | 6/1997 | Dobbertin et al. | 271/104 |
| 5,836,582 A | | 11/1998 | Ogauia et al. | 271/98 |
| 5,988,626 A | | 11/1999 | La Vos et al. | 271/98 |
| 6,082,728 A | | 7/2000 | Ubayashi | 271/98 |

FOREIGN PATENT DOCUMENTS

| | | |
|---|---|---|
| JP | 61-254438 A | 11/1986 |
| JP | 3-284553 | 12/1991 |
| JP | 4-089729 A | 3/1992 |
| JP | 4-159935 A | 6/1992 |
| JP | 6-107347 A | 4/1994 |
| JP | 6-321372 | 11/1994 |
| JP | 11-100139 A | 4/1999 |

* cited by examiner

*Primary Examiner*—Donald P. Walsh
*Assistant Examiner*—Kenneth W. Bower
(74) *Attorney, Agent, or Firm*—Smith, Gambrell & Russell, LLP

(57) ABSTRACT

A paper feeder comprises a paper-stacking mechanism having a paper-stacking plate on which the papers are to be stacked, and a width-limiting member for limiting the position of the papers stacked on said paper-stacking plate in the direction of width of the papers; a suction/feed mechanism disposed above the paper-stacking mechanism to feed by suction the uppermost paper stacked on the paper-stacking plate; and an air-blowing mechanism disposed on the front side of the paper-stacking means in the direction in which the papers are conveyed and including an air duct extending in a direction at right angles with the direction in which the paper is conveyed, said air duct having plural nozzles for jetting out the air against an upper portion at the front end of the papers stacked on said paper-stacking means, and a fan connected to an end of said air duct. The width-limiting member is provided with a closure member for closing the nozzles located on the outer sides of the width-limiting member, of the plural nozzles.

8 Claims, 39 Drawing Sheets

PAPER FEEDER

CROSS REFERENCE TO RELATED APPLICATION

This application is a division of Ser. No. 09/599,512, filed Jun. 23, 2000 and is being incorporated herein by reference.

FIELD OF THE INVENTION

The present invention relates to a paper feeder mounted in an image-forming machine such as copier, facsimile or printer to feed a paper toward an image-forming unit.

DESCRIPTION OF THE PRIOR ART

The conventional image-forming machine is equipped with a paper feeder which takes out, piece by piece, papers stacked on a paper-feed tray starting from the uppermost one, and feeds it toward the image-forming unit. The paper feeder that is widely and practically used is of the type in which a feed roller is brought into contact with the paper at the uppermost position stacked on the paper-feed tray to feed the paper by frictional force. In the paper feeder of the type in which the feed roller is brought into contact with the paper to feed it, however, slipping occurs between the feed roller and the paper when the feed roller is worn out, thereby causing the paper to be contaminated. Furthermore, when the feed roller is worn out to a great extent, the paper is not fed smoothly. Therefore, a problem resides in the durability of the feed roller.

The paper feeder is further equipped with a paper separation means for separating the paper at the uppermost position from the second and subsequent papers stacked on the paper-feed tray. The paper separation means is generally of a pawl separation type, friction pad type or gate type. However, none of them is capable of reliably separating a paper from the subsequent papers, and there occurs often feeding of plural pieces of papers at one time in an overlapped manner or occurrence of clogging of paper.

In order to solve the problems of the paper feeder equipped with the above-mentioned feeder roller and the paper separation mechanism, Japanese Unexamined Patent Publication (Kokai) No. 107347/1994 (JP-A 6-107347) discloses a paper feeder of the air suction type. The paper feeder of the air suction type comprises a paper-stacking means for stacking the papers; a suction/feed means having a drive roller and a driven roller arranged above the paper-stacking means in parallel with each other and spaced out in a direction in which the paper is conveyed, a suction duct arranged between the drive roller and the driven roller and having a suction port in the bottom wall thereof, and a conveyer belt arranged being wrapped round the drive roller, driven roller and suction duct and having plural holes formed therein; and an air-blowing means disposed on the front side of the paper-stacking means in the direction in which the papers are conveyed, which includes an air duct equipped with plural floatation nozzles to jet out the air against an upper portion at the front end of the papers stacked on the paper-stacking means and plural separation nozzles for jetting out the air toward the lower surface of the suction/feed means. The air jetted out from the floatation nozzles is blown to the upper portion of the papers stacked on the paper-stacking means to float several pieces of upper papers. The paper at the uppermost position thus floated is sucked and conveyed by a feed belt of the suction/feed means. On the other hand, the thus floated papers other than the uppermost paper are separated from the uppermost paper by the air that is jetted out from the separation nozzles and enters between the uppermost paper and the second paper. In order to reliably separate one paper from the other, the air must be reliably introduced between the uppermost paper and the second and subsequent papers. For this purpose, according to the paper feeder disclosed in Japanese Unexamined Patent Publication (Kokai) No. 107347/1994, a protrusion is provided on the lower surface of the bottom wall of the suction duct to come into contact with the conveyer belt thereby to give a curve to the conveyer belt, so that the paper adsorbed by the conveyer belt is caused to have undulation. Consequently, the air can easily enters between the uppermost paper and the second paper.

The above paper-stacking means comprises a frame that is mounted to freely move between an acting position and a non-acting position drawn out from the acting position, and a paper-stacking plate mounted on the frame to freely move up and down. The frame is drawn out to the non-acting position, and plural papers are stacked on the paper-stacking plate as required. Then, the frame is returned back to the acting position so that the plural papers stacked on the paper-stacking plate are positioned as required with respect to the air-blowing means and the suction/feed means.

The paper feeder further includes a means for holding down the rear end of the papers and for detecting the height of the papers. The means for holding down the rear end of the papers and for detecting the height of the papers includes a support member, a pushing member mounted on the support member so as to move over a predetermined range in a direction toward the paper-stacking plate and in a direction to separate away therefrom, and a detector for detecting the position of the pushing member. The pushing member is pushed at its lower end to the uppermost paper of the plural papers on the paper-stacking plate to prevent the papers on the paper-stacking plate from moving backward by the air sent from the air-blowing means. Further, the position or height of the pushing member is detected by the detector to detect the height of the uppermost paper on the paper-stacking plate, that is pushed by the lower end of the pushing member. As a considerable number of pieces of papers on the paper-stacking plate are consumed and the height of the uppermost paper on the paper-stacking plate becomes lower than a predetermined threshold value, the paper-stacking plate is elevated by a required amount.

In the conventional paper feeder of the air suction type, plural floatation nozzles and separation nozzles provided in the air duct constituting the air-blowing means are arranged in a range corresponding to a maximum paper size. When the papers of small sizes are used, therefore, the air jetted from the nozzles also act onto both sides of the papers placed on the paper-stacking means. As a result, there arises a problem that there occurs a so-called overlapped paper feeding in which the papers are excessively floated and plural papers are fed at one time.

In the paper feeder disclosed in the above Japanese Unexamined Patent Publication (Kokai) No. 107347/1994, the protrusions are provided on the side of the suction ports. Therefore, the paper adsorbed by the conveyer belt is excessively undulated due to the mutual action between the protrusions and the suction. Consequently, the undulation remains on the paper even after being conveyed and it is liable to cause a paper clogging (jamming) in the subsequent conveyance.

Further, even when the uppermost paper and the second and subsequent papers are relatively smoothly separated, there often occurs the so-called overlapped paper feeding in which plural pieces of papers are fed at one time when there is some distance between the feed belt and the separation nozzles.

Desirably, the plural floatation nozzles and separation nozzles provided in the air duct constituting the air-blowing means are selected for their number and arrangement according to the size of the papers and the quality (weight) of the papers. In the conventional paper feeder, however, the floatation nozzles and the separation nozzles are formed in one member that constitutes the air duct. To cope with the papers of various sizes and various qualities, therefore, there must be provided air ducts of several kinds having floatation nozzles and separation nozzles in various numbers and in various arrangements, resulting in an increase in the cost.

In the above-mentioned paper feeder of the air suction type, the papers stacked on the paper-stacking means float in different conditions based on the velocity of the air blown from the plural floatation nozzles provided in the air duct constituting the air-blowing means. That is, when the air velocity is set to be adapted to thick and heavy papers, the thin papers are excessively floated giving rise to the occurrence of the so-called overlapped paper feeding. When the air velocity is set to be adapted to the thin papers, on the other hand, the thick papers are not floated as desired, and no feeding of paper will occur.

In the above-mentioned conventional paper feeder, the air is simultaneously jetted out from the plural floatation nozzles and separation nozzles provided in the air duct constituting the air-blowing means. To supply the air simultaneously jetted out from the plural floatation nozzles and separation nozzles, however, a fan of a large capacity is required, resulting in an increase in the cost and in hindrance for realizing the apparatus in a compact size as a whole.

In the above-mentioned conventional paper feeder of the air suction type, the frame must be drawn out from the acting position to the non-acting position when the papers stacked on the paper-stacking plate are to be replaced by the papers of a different size. At this time, the pushing member pushing the uppermost paper stacked on the paper-stacking plate must be moved upward to be separated away from the uppermost paper prior to drawing out the frame. Also when the frame is to be returned from the non-acting position back to the acting position after the plural pieces papers have been stacked on the paper-stacking plate, it becomes necessary to move the pushing member upward so that the pushing member will not act on the uppermost paper on the paper-stacking plate. Otherwise, the uppermost paper is hindered from moving since it is pushed by the pushing member at the time when the paper-stacking plate is moved following the drawing out of the frame, and it drops from the paper-stacking plate and, in some cases, the subsequent several pieces of papers, too, drop from the paper-stacking plate. However, the conventional paper feeder is not equipped with any suitable means for moving the pushing member upward so as to be separated away from the uppermost paper on the paper-stacking plate and hence, cumbersome manual operation is needed for moving the pushing member upward.

Further, the conventional paper feeder often causes the so-called overlapped paper feeding in which the uppermost piece of paper and the second piece or several pieces of papers on the paper-stacking plate are fed simultaneously, or often causes a defective paper feeding in which the uppermost paper is not fed from the paper-stacking plate despite the air-blowing means and the suction/feed means are actuated.

SUMMARY OF THE INVENTION

It is the first object of the present invention to provide a paper feeder equipped with an air-blowing means which is capable of floating the papers properly correspondingly to their sizes and preventing the overlapped paper feeding beforehand.

It is the second object of the present invention to provide a paper feeder which is capable of enhancing the paper separation performance by undulating the paper adsorbed by conveyer belts and of eliminating the undulation of the paper after it is conveyed.

The present invention further provides a paper feeder capable of preventing the so-called overlapped paper feeding in which plural pieces of papers are fed at one time.

It is the third object of the present invention to provide a paper feeder equipped with an air-blowing means having an air duct capable of easily changing the number and arrangement of the floatation nozzles and separation nozzles depending upon the size and the quality of the papers.

It is the fourth object of the present invention to provide a paper feeder equipped with an air-blowing means capable of suitably adjusting the velocity of the air jetted out from plural floatation nozzles provided in the air duct.

It is the fifth object of the present invention to provide a paper feeder which can reduce the capacity of a fan constituting the air-blowing means.

It is the sixth object of the present invention to provide a novel and improved paper feeder which enables a pushing member to be automatically located at an elevated position at the time when a frame of the paper-stacking means is moved from an acting position to a non-acting position or from the non-acting position to the acting position.

It is the seventh object of the present invention to provide a novel and improved paper feeder which scarcely permits occurrence of the overlapped paper feeding in which plural pieces of papers are fed at one time from the paper-stacking plate or occurrence of defective paper feeding in which no paper is fed from the paper-stacking plate.

In order to accomplish the above-mentioned first object according to the present invention, there is provided a paper feeder comprising:

a paper-stacking means having a paper-stacking plate on which the papers are to be stacked, and a width-limiting member for limiting the position in the width direction of the papers stacked on said paper-stacking plate;

a suction/feed means having a drive roller and a driven roller arranged above said paper-stacking means in parallel with each other and spaced out in a direction in which the paper is conveyed, a suction duct arranged between said drive roller and said driven roller and having suction ports, and conveyer belts arranged wrapped round said drive roller, driven roller and suction duct and having plural holes; and an air-blowing means disposed on the front side of the paper-stacking means in the direction in which the papers are conveyed and including an air duct that extends in a direction at right angles with the direction in which the paper is conveyed and has plural nozzles for jetting out the air against an upper portion at the front end of the papers stacked on said paper-stacking means, and a fan connected to an end of said air duct; wherein said width-limiting member is provided with a closure member for closing the nozzles located on the outer sides of said width-limiting member, of said plural nozzles.

According to the present invention, there is further provided a paper feeder comprising a paper size detection means for detecting the position of said width-limiting member, and a control means for controlling the air amount of said fan based on a detection signal sent from said paper size detection means.

In order to accomplish the above-mentioned second object according to the present invention, there is provided a paper feeder comprising:

a paper-stacking means on which the papers are to be stacked;

a suction/feed means having a drive roller and a driven roller arranged above said paper-stacking means in parallel with each other and spaced out in a direction in which the paper is conveyed, a suction duct arranged between said drive roller and said driven roller and having suction ports in the bottom wall thereof, and conveyer belts arranged wrapped round said drive roller, driven roller and suction port in said suction duct and having plural holes; and an air-blowing means disposed on the front side of the paper-stacking means in the direction in which the papers are conveyed and including an air duct extending in a direction at right angles with the direction in which the paper is conveyed to jet out the air against an upper portion at the front end of the papers stacked on said paper-stacking means, and a fan connected to an end of said air duct; wherein said suction duct has ribs formed on the lower surface of the bottom wall on the upstream sides of said suction ports in the direction in which the paper is conveyed to come into contact with the conveyer belts.

The suction ports are formed in a plural number in the direction at right angles with the direction in which the paper is conveyed, and the ribs are formed on the upstream sides of the plural suction ports in the direction in which the paper is conveyed. It is desired that the ribs protrude by an amount of 1.5 to 3.5 mm from the lower surface of the bottom wall of the suction duct.

In order to accomplish the above-mentioned second object according to the present invention, there is further provided a paper feeder comprising:

a paper-stacking means on which the papers are to be stacked;

a suction/feed means having a drive roller and a driven roller arranged above said paper-stacking means in parallel with each other and spaced out in a direction in which the paper is conveyed, a suction duct arranged between said drive roller and said driven roller and having suction ports in the bottom wall thereof, and conveyer belts arranged wrapped round said drive roller, said driven roller and said suction ports in said suction duct and having plural holes; and an air-blowing means including an air duct with plural floatation nozzles for jetting the air against an upper portion at the front end of the papers stacked on said paper-stacking means and plural separation nozzles for jetting the air toward the lower surface of said suction/feed means, and a fan connected to an end of said air duct; wherein a paper-limiting member made of a flexible elastic material is provided at a positioned near the lower surfaces of said conveyer belts on the downstream side of the papers stacked on said paper-stacking means in the direction in which the paper is conveyed.

It is desired that a gap between the upper end of the paper-limiting member and the lower surfaces of said conveyer belts is set to be 0.5 to 3 mm.

In order to accomplish the above-mentioned second object according to the present invention, there is further provided a paper feeder comprising:

a paper-stacking means on which the papers are to be stacked;

a suction/feed means having a drive roller and a driven roller arranged above said paper-stacking means in parallel with each other and spaced out in a direction in which the paper is conveyed, a suction duct arranged between said drive roller and said driven roller and having suction ports in the bottom wall thereof, and plural conveyer belts arranged wrapped round said drive roller, driven roller and suction ports in said suction duct and having plural holes; and an air-blowing means including an air duct with plural floatation nozzles for jetting out the air against an upper portion at the front end of the papers stacked on said paper-stacking means and plural separation nozzles for jetting out the air toward the lower surface of said suction/feed means, and a fan connected to an end of said air duct; wherein ribs are formed protruding downward on the lower surface of the bottom wall of said suction duct to come into contact with said conveyer belts; and a paper-limiting member made of a flexible elastic material is provided being arranged between said conveyer belt and said conveyer belt on the downstream side of the papers stacked on said paper-stacking means in the direction in which the paper is conveyed.

It is desired that the upper end of said paper-limiting member is not lower than the lowermost point but is not higher than the uppermost point of the paper that is undulated by being adsorbed by said conveyer belts.

In order to accomplish the above-mentioned third object according to the present invention, there is provided a paper feeder comprising:

a paper-stacking means on which the papers are to be stacked;

a suction/feed means having a drive roller and a driven roller arranged above said paper-stacking means in parallel with each other and spaced out in a direction in which the paper is conveyed, a suction duct arranged between said drive roller and said driven roller and having suction ports, and conveyer belts arranged wrapped round said drive roller, driven roller and suction duct and having plural holes; and an air-blowing means disposed on the front side of the paper-stacking means in the direction in which the papers are conveyed and including an air duct having plural floatation nozzles for jetting out the air against an upper portion at the front end of the papers stacked on said paper-stacking means and plural separation nozzles for jetting out the air toward the lower surface of said suction/feed means; wherein said air duct of said air-blowing means is constituted by a base board extending in a direction at right angles with the direction in which the paper is conveyed and plural blocks mounted on said base board to form an air passage together with said base board; and said plural blocks include the first blocks having said floatation nozzles and the second blocks having said separation nozzles.

According to the present invention, further, there is provided a paper feeder wherein said plural blocks include the first blocks having said floatation nozzles and the third blocks having said floatation nozzles as well as said separation nozzles.

According to the present invention, further, there is provided a paper feeder wherein said plural blocks include the first blocks having said floatation nozzles, the second blocks having said separation nozzles, and the third blocks having said floatation nozzles as well as said separation nozzles.

It is desired that said plural blocks include space blocks having neither said floatation nozzle nor said separation nozzle, and both sides of said air duct are constituted by said space blocks.

In order to accomplish the above-mentioned fourth object according to the present invention, there is provided a paper feeder comprising:

a paper-stacking means on which the papers are to be stacked;

a suction/feed means having a drive roller and a driven roller arranged above said paper-stacking means in parallel with each other and spaced out in a direction in which the paper is conveyed, a suction duct arranged between said drive roller and said driven roller and having suction ports, and conveyer belts arranged wrapped round said drive roller, driven roller and suction duct and having plural holes; and an air-blowing means disposed on the front side of the paper-stacking means in the direction in which the papers are conveyed and including an air duct extending in a direction at right angles with the direction in which the paper is conveyed to jet the air against an upper portion at the front end of the papers stacked on said paper-stacking means, and a fan connected to an end of said air duct; wherein said air duct has plural floatation nozzles for jetting the air against an upper portion at the front end of the papers stacked on said paper-stacking means, an air-escape hole, and an escape hole-shutter mechanism for changing the opening area of said air-escape hole.

The floatation nozzles are formed in a side wall that constitutes the air duct, and the air-escape hole is formed in an end wall that constitutes the air duct. It is desired that the air duct has plural separation nozzles for jetting out the air toward the lower surface of said suction/feed means.

In order to accomplish the above-mentioned fourth object according to the present invention, there is further provided a paper feeder comprising:

a paper-stacking means on which the papers are to be stacked;

a suction/feed means having a drive roller and a driven roller arranged above said paper-stacking means in parallel with each other and spaced out in a direction in which the paper is conveyed, a suction duct arranged between said drive roller and said driven roller and having suction ports, and conveyer belts arranged wrapped round said drive roller, driven roller and suction duct and having plural holes; and an air-blowing means disposed on the front side of the paper-stacking means in the direction in which the papers are conveyed and including an air duct extending in a direction at right angles with the direction in which the paper is conveyed to jet out the air against an upper portion at the front end of the papers stacked on said paper-stacking means, and a fan connected to an end of said air duct; wherein said air duct has plural floatation nozzles formed in the side wall for jetting out the air against an upper portion at the front end of the papers stacked on said paper-stacking means, an air-escape hole, and a nozzle shutter mechanism for changing the opening area of said plural nozzle.

It is desired that said air duct has plural separation nozzles for jetting out the air toward the lower surface of said suction/feed means, and said nozzle shutter mechanism changes the opening areas of the separation nozzles.

In order to accomplish the above-mentioned fifth object, the present inventors have found through experiment that the floatation of the papers by the air jetted from the floatation nozzles and the separation of the uppermost paper and the second and subsequent papers by the air jetted from the separation nozzles are not always necessary to execute simultaneously, i.e., the separation of the papers may be executed at a moment when the uppermost paper is sucked by the conveyer belts of the suction/feed means after the papers are floated, and that the capacity of the fan can be made small by selectively changing over the timing for jetting the air through the floatation nozzles and the timing for jetting the air through the separation nozzles.

That is, in order to accomplish the above-mentioned fifth object according to the present invention, there is provided a paper feeder that solves the above technical problem, comprising:

a paper-stacking means on which the papers are to be stacked;

a suction/feed means having a drive roller and a driven roller arranged above said paper-stacking means in parallel with each other and spaced out in a direction in which the paper is conveyed, a suction duct arranged between said drive roller and said driven roller and having suction ports, and conveyer belts arranged wrapped round said drive roller, driven roller and suction duct and having plural holes; and an air-blowing means including an air duct with plural floatation nozzles for jetting out the air against an upper portion at the front end of the papers stacked on said paper-stacking means and plural separation nozzles for jetting out the air toward the lower surface of said suction/feed means; wherein said air-blowing means is equipped with an air blow change-over mechanism for suitably changing over the air jetted through said floatation nozzles or said separation nozzles.

The air blow change-over mechanism includes a shutter plate for selectively closing said floatation nozzles or said separation nozzles, and a drive mechanism that moves said shutter plate to the first position to close said separation nozzles and open said floatation nozzles, and to the second position to close said floatation nozzles and open said separation nozzles. Said shutter plate is mounted on a rotary shaft disposed in said air duct, and said drive mechanism pivots the rotary shaft in one direction or in the other direction so that the shutter plate is brought to said first position or said second position. Further, the shutter plate is arranged to slide along the outer peripheral surface of said air duct, and said drive mechanism moves the shutter plate in one direction or in the other direction so that the shutter plate is brought to said first position or said second position.

In order to accomplish the above-mentioned fifth object according to the present invention, there is further provided a paper feeder comprising:

a paper-stacking means on which the papers are to be stacked;

a suction/feed means having a drive roller and a driven roller arranged above said paper-stacking means in parallel with each other and spaced out in a direction in which the paper is conveyed, a suction duct arranged between said drive roller and said driven roller and having suction ports, and conveyer belts arranged wrapped round said drive roller, driven roller and suction duct and having plural holes; and an air-blowing means including an air duct with plural floatation nozzles for jetting out the air against an upper portion at the front end of the papers stacked on said paper-stacking means and plural separation nozzles for jetting out the air toward the lower surface of said suction/feed means; wherein said air-blowing means includes a shutter plate for selectively closing said floatation nozzles or said separation nozzles, an air blow change-over mechanism that moves said shutter plate to the first position to close said separation nozzles and open said floatation nozzles and moves said shutter plate to the second position to close said floatation nozzles and open said separation nozzles, a paper adsorption detection means for detecting whether the paper is adsorbed by the conveyer belts of said suction/feed means, and a control means for controlling the operation of said air blow change-over mechanism based on a detection signal from said paper adsorption detection means; and based on the detection signal from said paper adsorption detection means, said control means so controls said air blow change-over means that said shutter plate is brought to said first position when no paper is adsorbed by said conveyer belts and that said shutter plate is brought to said second position when a paper is adsorbed by said conveyer belts.

In order to accomplish the above-mentioned sixth object according to the present invention, there is provided a paper feeder comprising:

a paper-stacking means including a paper-stacking plate on which the papers are to be stacked and which moves up and down;

an air-blowing means for blowing the air onto an upper portion at the front end of plural papers stacked on said paper-stacking plate;

a suction/feed means for sucking and feeding the uppermost paper of the plural papers stacked on said paper-stacking plate; and a means for holding down the rear end of the papers and for detecting the height of the papers, which includes a support member, a pushing member mounted on said support member to move in a direction toward said paper-stacking plate and in a direction to separate away therefrom within a predetermined range, and a detector for detecting the position of said pushing member; wherein said paper-stacking means includes a frame that freely moves between an acting position and a non-acting position drawn out from said acting position, said paper-stacking plate being mounted on said frame;

said support member of said means for holding down the rear end of the papers and for detecting the height of the papers is mounted to move between a pushing/detecting position and a separated position;

when said frame of said paper-stacking means moves to said acting position, said support member of said paper holding/detecting means is brought to said pushing/detecting position where said pushing member is pushed onto the uppermost paper of the papers stacked on said stacking plate; and when said frame of said paper-stacking means moves from said acting position to said non-acting position, said support member of said means for holding down the rear end of the papers and for detecting the height of the papers moves to said separated position from said pushing/detecting position, and said pushing member separates upward away from the uppermost paper of the papers stacked on said paper-stacking plate.

In the preferred embodiment, the paper holding/detecting means includes a resilient urging member for resiliently urging said support member to the separated position. When the frame of the paper-stacking means is moved to the acting position, the frame comes in contact with the support member to move the support member to the pushing/detecting position against the resilient urging action of the resilient urging means. The frame of the paper-stacking means is drawn forward substantially horizontally from the acting position to move to the non-acting position. A contact piece is disposed on the frame to protrude backward from the back surface thereof. When the frame of the paper-stacking means moves to the acting position, the contact piece comes in contact with the support member. The support member of the means for holding down the rear end of papers and for detecting the height of the papers is allowed to turn between the pushing/detecting position and the separated position.

In order to accomplish the above-mentioned sixth object according to the present invention, there is provided a paper feeder comprising:

a paper-stacking means including a paper-stacking plate on which plural pieces of papers are to be stacked and which moves up and down;

an air-blowing means for blowing the air onto an upper portion at the front end of plural papers stacked on said paper-stacking plate;

a suction/feed means for sucking and feeding the uppermost paper of the plural papers stacked on said paper-stacking plate; and a means for holding down the rear end of the papers and for detecting the height of the papers, which includes a support member, a pushing member mounted on said support member to move in a direction toward said paper-stacking plate and in a direction to separate away therefrom within a predetermined range, and a detector for detecting the position of said pushing member; wherein said paper-stacking means includes a frame that moves between an acting position and a non-acting position drawn out from said acting position, said paper-stacking plate being mounted on said frame;

said means for holding down the rear end of the papers and for detecting the height of the papers includes a push-release means which is selectively actuated to move said pushing member in a direction to separate away from said paper-stacking plate;

when said frame of said paper-stacking means moves to said acting position, the release action of said push-release means extinguishes and said pushing member is pushed onto the uppermost paper of the papers stacked on said paper-stacking plate; and when said frame of said paper-stacking means moves from said acting position to said non-acting position, said pushing member separates upward away from the uppermost paper of the papers stacked on said paper-stacking plate due to the release action of said push-release means.

It is desired that the push-release means is constituted by an electromagnetic solenoid.

In order to accomplish the above-mentioned seventh object according to the present invention, there is provided a paper feeder comprising:

a paper-stacking means including a paper-stacking plate on which plural pieces of papers are to be stacked and which moves up and down;

an air-blowing means for blowing the air onto an upper portion at the front end of plural papers stacked on said paper-stacking plate;

a suction/feed means for sucking and feeding the uppermost paper of the plural papers stacked on said paper-stacking plate; and a means for holding down the rear end of the papers and for detecting the height of the papers, which includes a support member, a pushing member mounted on said support member to move in a direction toward said paper-stacking plate and in a direction to separate away therefrom within a predetermined range, and a detector for detecting the position of said pushing member; wherein plural kinds of papers of different sizes are selectively placed on said paper-stacking plate of said paper-stacking means, and front edges are aligned to a predetermined position irrespective of the kinds of the papers that are stacked on said paper-stacking plate; and said support member of said means for holding down the rear end of the papers and for detecting the height of the papers can be freely adjusted for its position on said paper-stacking plate in the direction in which the paper is conveyed.

In a preferred embodiment, said means for holding down the rear end of the papers and for detecting the height of the papers includes an electric motor for moving said support member on said paper-stacking plate in the direction in which the sheet-like paper is conveyed and in the direction opposite thereto. The electric motor is drivably coupled to said support member through an externally threaded shaft extending on the paper-stacking plate in the direction in which the sheet-like paper is conveyed and in the opposite direction, and through internally threaded blocks screwed onto said externally threaded shaft.

In order to accomplish the above-mentioned seventh object according to the present invention, there is further provided a paper feeder comprising:

a paper-stacking means including a paper-stacking plate on which plural pieces of papers are to be stacked and which moves up and down;

an air-blowing means for blowing the air onto an upper portion at the front end of plural papers stacked on said paper-stacking plate;

a suction/feed means for sucking and feeding the uppermost paper of the plural papers stacked on said paper-stacking plate; and a means for holding down the rear end of the papers and for detecting the height of the papers, which includes a support member, a pushing member mounted on said support member to move in a direction toward said paper-stacking plate and in a direction to separate away therefrom within a predetermined range, and a detector for detecting the position of said pushing member; wherein said pushing member of said means for holding down the rear end of the papers and for detecting the height of the papers is pushed onto the uppermost paper of the sheet-like papers on said paper-stacking plate with a pressure of 10 to 80 g, and/or the contact area between the lower end of said pushing member of said means for holding down the rear end of the papers and for detecting the height of the papers and the uppermost paper of the sheet-like papers on said paper-stacking plate is not larger than 100 $mm^2$; and/or said pushing member of said means for holding down the rear end of the papers and for detecting the height of the papers is pushed onto the uppermost paper on said paper-stacking plate at a position within 50 mm from the rear edge of the paper as viewed in the direction in which the paper is delivered from said paper-stacking plate.

Preferably, the pushing member of said means for holding down the rear end of the papers and for detecting the height of the papers is pushed onto the uppermost paper of the papers on said paper-stacking plate with a pressure of from 20 to 60 g. It is desired that the means for holding down the rear end of the papers and for detecting the height of the papers includes a resilient pushing means for resiliently urging the pushing member toward the paper-stacking plate. Preferably, the pushing member of said means for holding down the rear end of the papers and for detecting the height of the papers has a lower end of nearly a semispherical shape. Preferably, the pushing member of said means for holding down the rear end of the papers and for detecting the height of the papers is pushed onto the uppermost paper on said paper-stacking plate at a position within 30 mm from the rear edge of the paper as viewed in the direction in which the paper is delivered from said paper-stacking plate.

DETAILED DESCRIPTION OF THE PREFERRED EMBODIMENTS

Preferred embodiments of the paper feeder constituted according to the present invention will now be described in detail with reference to the accompanying drawings.

Figure 1:
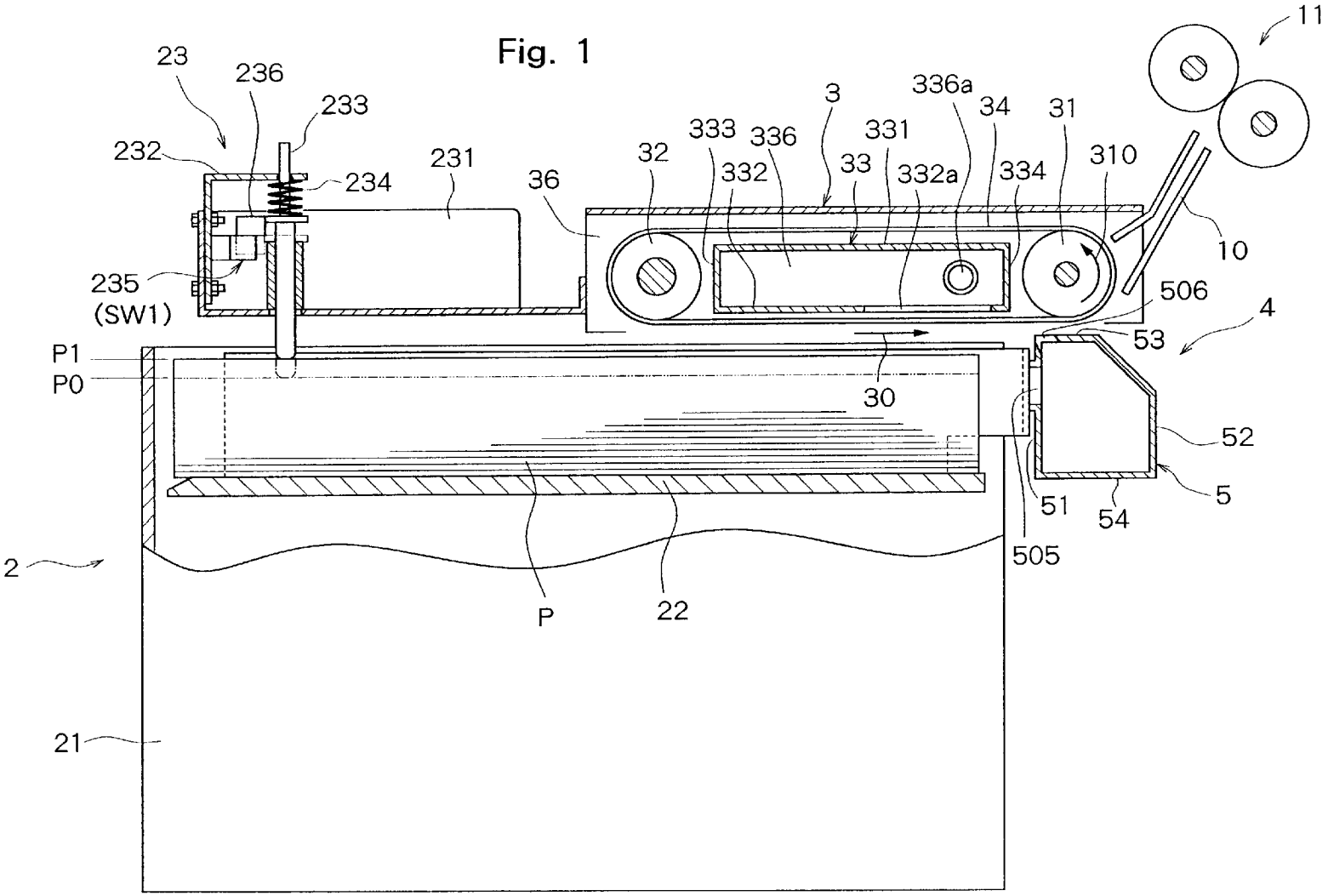
FIG. 1 is a sectional view schematically illustrating the constitution of a paper feeder according to the first embodiment of the present invention.

FIG. 1 is a sectional view schematically illustrating the constitution of a paper feeder mounted on an image-forming machine. The paper feeder is equipped with a paper-stacking means 2 on which papers will be stacked. The paper-stacking means 2 shown in the embodiment includes a frame 21, a paper-stacking plate 22 disposed in the frame 21 and holding sheet-like papers P stacked thereon, and a means 23 for pushing the rear end of the papers P stacked on the paper-stacking plate 22 and for detecting the height of the papers P. The paper-stacking plate 22 is allowed to move up and down in FIG. 1 along the frame 21, using a plate elevation mechanism (not shown). A pair of width-limiting members 24 and 24 are disposed on the paper-stacking plate 22. The width-limiting members 24 and 24 will be described later in detail.

The means 23 for holding down the rear end of the papers and for detecting the height of the papers include a bracket 232 disposed above the frame 21 and secured to a mounting plate 231, a pushing member 233 mounted to the bracket 232 so as to slide up and down in FIG. 1, a coil spring 234 for urging to move the pushing member 233 downward in FIG. 1, a photo sensor 235 (SW1) constituted by a light-emitting element and a light-receiving element mounted on the bracket 232, and a light-shielding plate 236 mounted on the pushing member 233 to pass through between the light-emitting element and the light-receiving element of the photo sensor 235 (SW1) with the movement of the pushing member 233. The pushing member 233 of the thus constituted means 23 for holding down the rear end of the papers and for detecting the height of the papers comes at its lower end into contact with the uppermost paper of the papers P stacked on the paper-stacking plate 22, and pushes the paper with a predetermined pushing force by resilient force of the coil spring 234. The pushing member 233 moves between the first position indicated by a solid line at which its lower end comes in contact with an upper-limit position P1 of the papers P stacked on the paper-stacking plate 22 and the second position indicated by a two-dot chain line at which its lower end comes in contact with a lower-limit position P0 of the papers P. The light-shielding plate 236 of the means 23 for holding down the rear end of the papers and for detecting the height of the papers is positioned above the photo sensor 235 (SW1) when the pushing member 233 is located at the first position indicated by the solid line, and is brought to a position between the light-emitting element and the light-receiving element of the photo sensor 235 (SW1) to shut off light when the pushing member 233 is brought to the second position indicated by the two-dot chain line. The photo sensor 235 (SW1) sends a signal ON to a control means that will be described later until the pushing member 233 arrives at the second position indicated by the two-dot chain line from the first position indicated by the solid line, and sends a signal OFF to the control means when the pushing member 233 has arrived at the second position indicated by the two-dot chain line. In response to the signal OFF sent from the photo sensor 235 (SW1), the control means that will be described later actuates the plate elevation mechanism that is not shown to elevate the paper-stacking plate 21. When the paper-stacking plate 21 is elevated and the height of the papers P stacked on the paper-stacking plate 22 reaches the position P1, the pushing member 233 reaches the first position indicated by the solid line and the light-shielding plate 236 is brought to a position on the upper side of the photo sensor 235 (SW1) as indicated by a solid line. As a result, the photo sensor 235 (SW1) produces a signal ON, and the control means halts the operation of the plate elevation mechanism in response to the signal ON.

Figure 2:
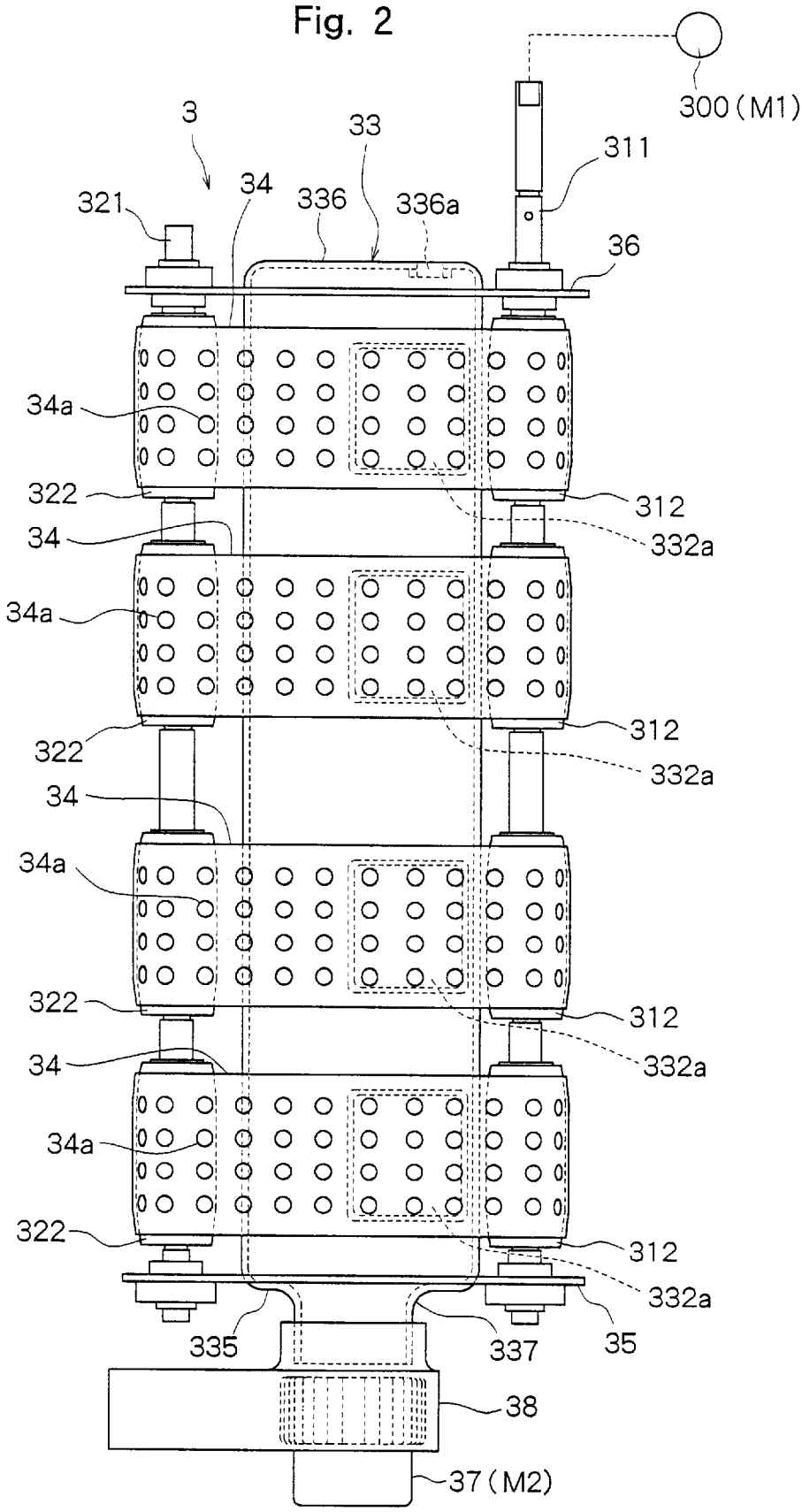
FIG. 2 is a plan view of a suction/feed means constituting the paper feeder shown in FIG. 1.

A suction/feed means 3 is disposed on a front upper side of the paper-stacking means 2 in a direction in which the paper is conveyed as indicated by an arrow 30. The suction/feed means 3 will now be described with reference to FIGS. 1 and 2. The suction/feed means 3 in the illustrated embodiment includes a drive roller 31 and a driven roller 32 arranged in parallel and spaced out in the direction in which the paper is conveyed as indicated by the arrow 30 in FIG. 1, a suction duct 33 arranged between the drive roller 31 and the driven roller 32, and conveyer belts 34 arranged wrapping round the drive roller 31, driven roller 32 and suction duct 33.

The drive roller 31 includes a rotary shaft 311 rotatably supported by support plates 35, 36 arranged at a predetermined distance in the back-and-forth direction (up-and-down direction in FIG. 2), and four rollers 312 mounted on the rotary shaft 311. The rotary shaft 311 is rotated in a direction indicated by an arrow 310 in FIG. 1 by the drive force of an electric motor 300 (M1) via a rotary drive mechanism that is not shown. The driven roller 32 includes a rotary shaft 321 rotatably supported by the support plates 35, 36, and four rollers 322 mounted on the rotary shaft 321. The four rollers 312 of the drive roller 31 and the four rollers 322 of the driven roller 32 are disposed at positions facing each other.

The suction duct 33 includes an upper wall 331, a lower wall 332, a left side wall 333, a right side wall 334, a front end wall 335 and a rear end wall 336. In the illustrated embodiment, the suction duct 33 is molded as a unitary structure using a synthetic resin. In the lower wall 332 constituting the suction duct 33 are formed four suction ports 332*a* at positions corresponding to the rollers 312 and 322 of the drive roller 31 and of the driven roller 32 in a direction at right angles with the direction indicated by the arrow 30 in which the paper is conveyed. In the illustrated embodiment, the four suction ports 332*a* are formed at a front portion in the direction, in which the paper is conveyed, indicated by the arrow 30 in FIG. 1. A connection cylinder 337 is molded integrally with the front end wall 335, and a suction fan 38 driven by an electric motor 37 (M2) is mounted to the connection cylinder 337. An air intake port 336*a* is formed in the rear end wall 336.

The conveyer belt 34 is formed of a synthetic rubber having a thickness of about 0.5 to about 1.5 mm in an endless form. The conveyer belt 34 has plural holes 34*a* formed therein. In the illustrated embodiment, the holes 34*a* have a diameter of 5 mm and are arranged in four columns at a hole pitch of 10 mm, the distance between the hole 34*a* and another hole 34*a* being 13.5 mm.

Figure 3:
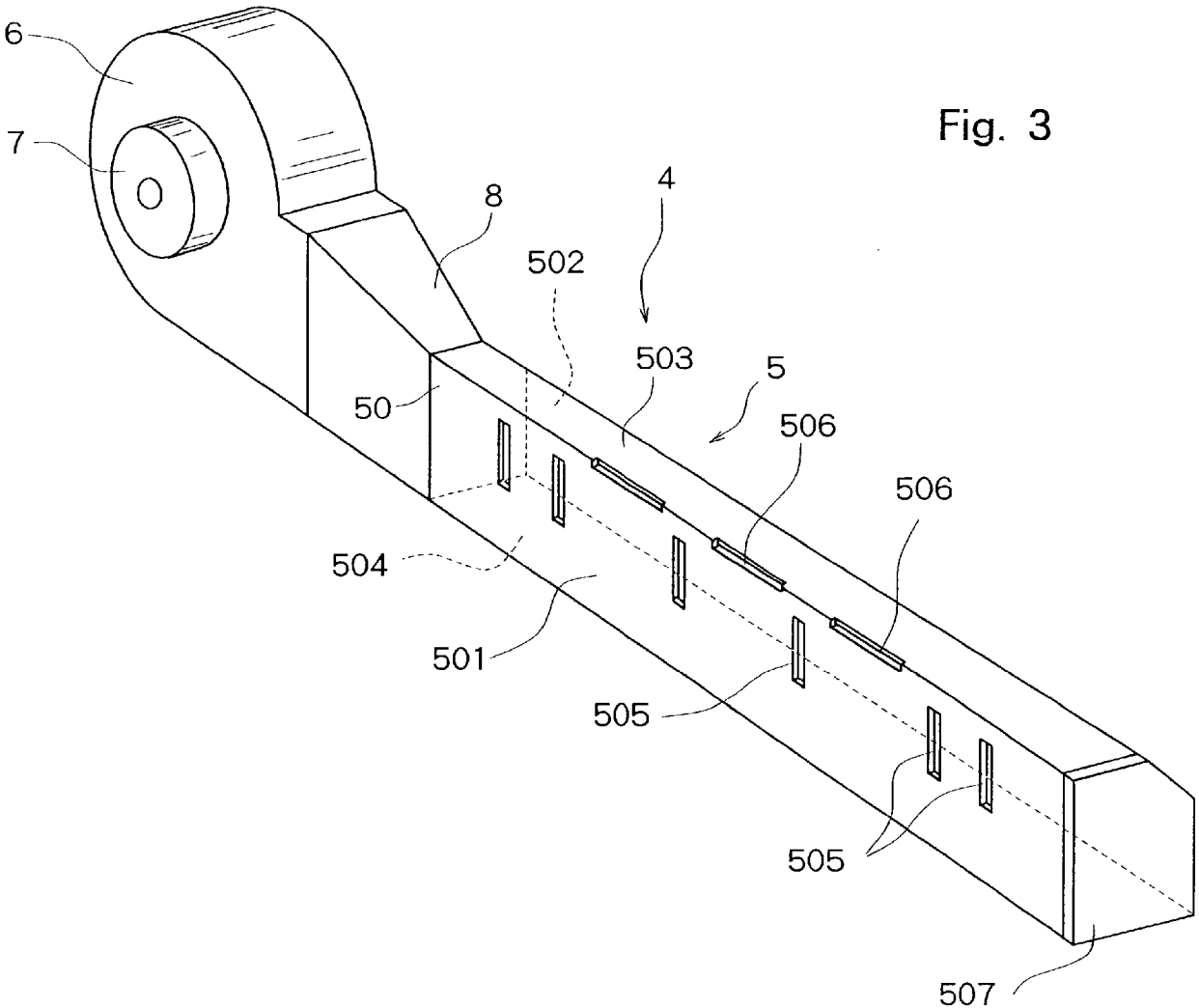
FIG. 3 is a perspective view of an air-blowing means constituting the paper feeder shown in FIG. 1 according to the embodiment.

An air-blowing means 4 is disposed at a front lower portion of the thus constituted suction/feed means 3 in the direction indicated by the arrow 30 in which the paper is conveyed. As shown in FIG. 3, the air-blowing means 4 of the illustrated embodiment includes an air duct 5 that extends in a direction (perpendicular to the surface of the paper in FIG. 1) at right angles with the direction in which the paper is conveyed, a fan 6 connected to an end of the air duct 5 via a connection duct 8, and an electric motor 7 (M3) for rotating the fan 6. The electric motor 7 (M3) for rotating the fan 6 is constituted to change its speed by controlling a voltage applied, using a control means that will be described later.

The air duct 5 will now be described with reference to FIGS. 3 and 4. The air duct 5 in the illustrated embodiment is molded in the shape of a rectangular parallelopiped by using a suitable synthetic resin, and includes side walls 501, 502, an upper wall 503 and a bottom wall 504. The side wall 501 constituting the air duct 5 is provided with plural floatation nozzles 505 for jetting out the air against an upper portion of the papers P stacked on the paper-stacking plate 22 of the paper-stacking means 2. The plural floatation nozzles 505 having a form elongated in the up-and-down direction are formed at predetermined distances in the lengthwise direction of the side wall 501. Plural separation nozzles 506 are formed in the connection portion between the side wall 501 and the upper wall 503 forming the air duct 5 to jet out the air onto the lower surface of the suction/feed means 3. The separation nozzles 506 are formed being elongated in the lengthwise direction of the side wall 501. In the illustrated embodiment, two floatation nozzles 505 are respectively formed on both sides of the side wall 501, and separation nozzles 506 and the floatation nozzles 505 are alternately formed on the inner side of the above two floatation nozzles 505. An end wall 507 separately formed is fitted to the other end of the thus constituted air duct 5.

Figure 4:
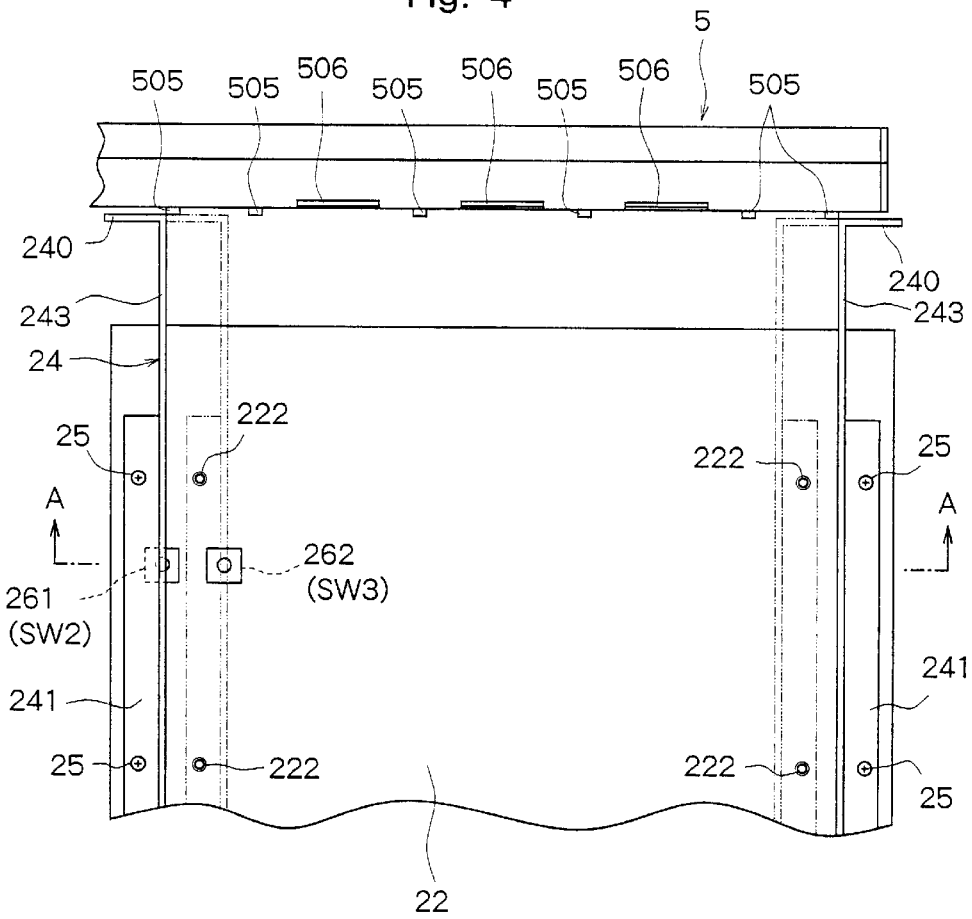
FIG. 4 is a plan view illustrating major portions of a paper-stacking means and the air-blowing means constituting the paper feeder shown in FIG. 1.

In the illustrated embodiment, of the floatation nozzles 505 and separation nozzles 506 formed in the air duct 5, floatation nozzles 505 located on the outer sides of the width-limiting members 24, 24 are so constituted as can be closed as shown in FIG. 4.

Figure 5:
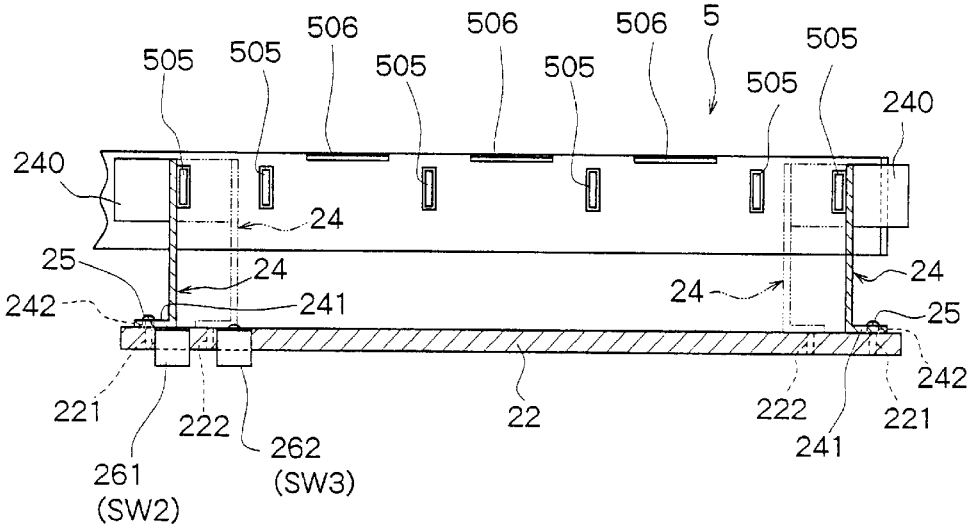
FIG. 5 is a sectional view along the line A—A in FIG. 4.

Referring to FIGS. 4 and 5, a pair of width-limiting members 24 and 24 arranged on the paper-stacking plate 22 are moved and secured at positions corresponding to the size of the papers stacked on the paper-stacking plate 22. That is, the paper-stacking plate 22 is provided with threaded holes 221, 222 for securing the width-limiting members 24 and 24 at positions corresponding to the size of the papers at a predetermined distance in a direction (right-and-left direction in FIG. 4) at right angles with the direction in which the paper is conveyed. In the illustrated embodiment, the threaded holes 221 are set to the lengthwise side of an A4 size, and the threaded holes 222 are set to the lengthwise side of a B5 size. The width-limiting members 24 and 24 are provided with mounting portions 241 and 241 formed by bending their lower ends outward. Screw insertion holes 242, 242 are formed in the mounting portions 241, 241 so as to correspond to the threaded holes 221, 222. The width-limiting members 24, 24 are moved to positions corresponding to the size of the papers to be used, screws 25 are inserted in the screw insertion holes 242 and are screwed into the threaded holes 221 or the threaded holes 222. Thus, the width-limiting members 24 are secured to the positions corresponding to the size of the papers to be used. In the illustrated embodiment, the width-limiting members 24 and 24 are located to the positions of the lengthwise side of the A4 size indicated by solid lines in FIGS. 4 and 5 secured by the position of the threaded hole 221 and to the position of the lengthwise side of the B5 size indicated by two-dot chain lines in FIGS. 4 and 5 secured by the position of the threaded hole 222.

On the thus constituted pair of width-limiting members 24 and 24 are mounted closure members 240, 240 for closing floatation nozzles 505 located on the outer sides of the width-limiting members 24, 24, of the floatation nozzles 505 and the separation nozzles 506 formed in the air duct 5. The closure members 240 and 240 are formed by bending the support portions 243 and 243 formed by the upper ends of the width-limiting members 24 and 24 that protrude beyond the front end of the paper-stacking plate 22. In the illustrated embodiment, when the width-limiting members 24 and 24 are located at the positions of the lengthwise side of the A4 size indicated by solid lines in FIGS. 4 and 5, neither the floatation nozzle 505 nor the separation nozzle 506 formed in the air duct 5 exists on the outer sides of the width-limiting members 24 and 24. Therefore, the closure members 240 and 240 do not close the floatation nozzles 505 formed in the air duct 5. On the other hand, when the width-limiting members 24 and 24 are brought to the positions of the lengthwise side of the B5 size indicated by two-dot chain lines in FIGS. 4 and 5, the closure members 242 and 242 close the floatation nozzles 505 on both extreme sides of the air duct 5.

The illustrated embodiment is equipped with a paper size detection means 26 for detecting the position of the width-limiting members 24. The paper size detection means 26 of the illustrated embodiment is constituted by the first detection switch 261 (SW2) for detecting the lengthwise side of the A4 size and the second detection switch 262 (SW3) for detecting the lengthwise side of the B5 size. The first detection switch 261 (SW2) and the second detection switch 262 (SW3) are disposed at positions corresponding to the threaded holes 221 and 222 in the paper-stacking plate 22. The first detection switch 261 (SW2) sends a signal ON to the control means that will be described later when the width-limiting members 24 are brought to the positions of the lengthwise side of the A4 size indicated by solid lines in FIGS. 4 and 5. The second detection switch 262 (SW3) sends a signal ON to the control means that will be described later when the width-limiting members 24 are brought to the positions of the lengthwise side of the B5 size indicated by two-dot chain lines in FIGS. 4 and 5.

Figure 6:
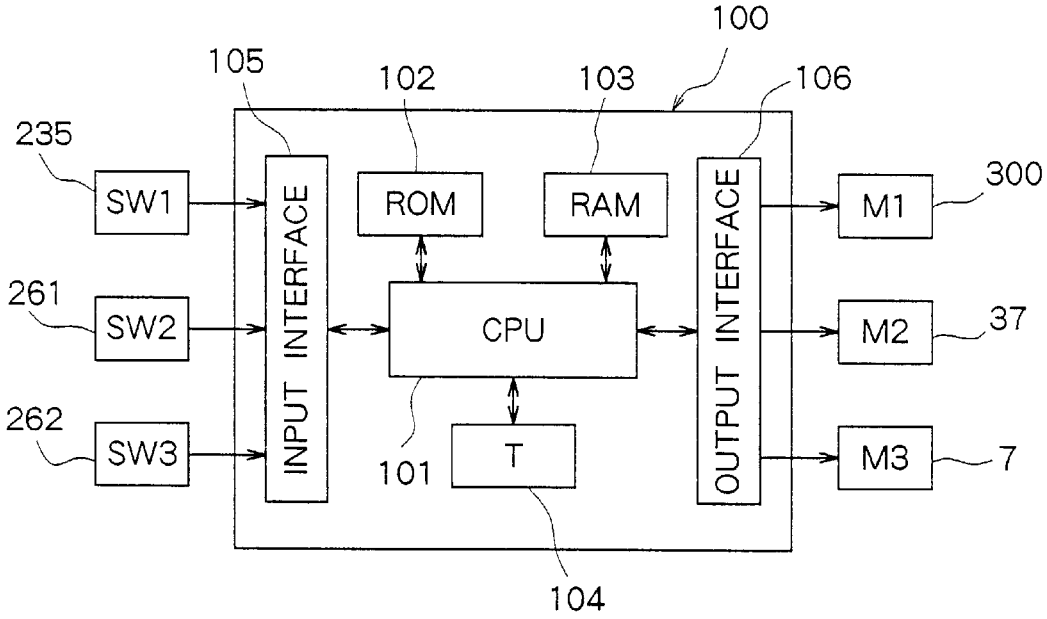
FIG. 6 is a block diagram of a control means in the paper feeder shown in FIG. 1.

Reverting to FIG. 1, a pair of guide plates 10 and a pair of conveyer rollers 11 are disposed on the downstream side of the suction/feed means 3 in the direction in which the paper is conveyed. The paper feeder in the illustrated embodiment is equipped with a control means 100 shown in FIG. 6. The control means 100 is constituted by a microcomputer and comprises a central processing unit (CPU) 101 that executes an arithmetic processing according to a control program, a read-only memory (ROM) 102 for storing the control program, a random access memory (RAM) 103 capable of reading and writing for storing the operated results, a timer 104 (T), an input interface 105 and an output interface 106. The input interface 106 of the thus constituted control means 100 receives detection signals from the photo sensor 235 (SW1), the first detection switch 261 (SW") and the second detection switch 262 (SW3) of the paper size detection means 26. The control means 100 sends control signals to the electric motor 300 (M1), electric motor 37 (M2) and electric motor 7 (M3) through the output interface 106.

The paper feeder of the illustrated embodiment is constituted as described above. Described below is its operation.

The pair of width-limiting members 24 and 24 disposed on the paper-stacking plate 22 of the paper-stacking means 2 are brought to the positions of a lengthwise side of the A4 size indicated by solid lines in FIGS. 4 and 5 or brought to the positions of a lengthwise side of the B5 size indicated by two-dot chain lines in FIGS. 4 and 5 to meet the size of the papers to be used. Here, at the time when the machine is delivered, the width-limiting members 24 and 24 are, in many cases, set by a serviceman to meet the size of the papers that will be most used. Plural pieces of papers P are stacked on the paper-stacking plate 22 in a state where the pair of width-limiting members 24 and 24 are located at predetermined positions corresponding to the size of the papers to be used and the frame 21 is brought to a predetermined position. Then, in response to a signal that has detected this state, the control means 100 actuates the plate elevation mechanism (not shown) to elevate the paper-stacking plate 21. When the height of the papers P stacked on the paper-stacking plate 22 reaches the position P1 shown in FIG. 1, the photo sensor 235 (SW1) produces a signal ON as described above. In response to this signal, the control means 100 discontinues the operation of the plate elevation mechanism in a state shown in FIG. 1.

When a paper-feed signal is produced in a state shown in FIG. 1, the control means 100 drives the electric motor 7 (M3) of the air-blowing means 4 and the electric motor 37 (M2) of the suction/feed means 3. The electric motor 7 (M3) of the air-blowing means 4 is controlled for its rotational speed according to the positions of the width-limiting members 24 and 24 brought to predetermined positions depending upon the size of the papers to be used. That is, the control means 100 controls the voltage applied to the electric motor 7 (M3) based on a detection signal from the first detection switch 261 (SW2) or the second detection switch 262 (M3) of the paper size detection means 26 that detects the positions of the width-limiting members 24. When the signal ON is received from the first detection switch 261 (SW2), the control means 100 controls a drive circuit that is not shown so as to apply, to the electric motor 7 (M3), a predetermined first voltage that allows the fan 6 to produce the air flow rate suitable to floating and separating the papers of the A4 size with lengthwise side. Further, when the signal ON is received from the second detection switch 262 (SW3), the control means 100 controls the drive circuit that is not shown so as to apply a predetermined second voltage smaller than the first voltage to the electric motor 7 (M3) that allows the fan 6 to produce the air flow rate suitable to floating and separating the papers of the B5 size with lengthwise side.

When the electric motor 7 (M3) is driven, the fan 6 sends the air to the air duct 5 and the air is jetted out through the floatation nozzles 505 and the separation nozzles 506. The air jetted from the floatation nozzles 505 is blown to the upper portion of the papers P stacked on the paper-stacking plate 22, whereby the upper several pieces of papers are caused to float. Here, when the papers to be used are of the B5 size with lengthwise side, the width-limiting members 24 and 24 are brought to the positions of lengthwise side of the B5 size indicated by two-dot chain lines in FIGS. 4 and 5, whereby the floatation nozzles 505, 505 located on the outer sides of the width-limiting members 24, 24 are closed by the closure members 240 and 240. Accordingly, the air jetted from the floatation nozzles 505, 505 do not act on the papers from both sides thereof; i.e., the papers are not excessively floated thereby to prevent the occurrence of the so-called overlapped paper feeding in which plural pieces of papers are fed at one time. Further, when the width-limiting members 24, 24 are brought to the positions of lengthwise side of the B5 size indicated by two-dot chain lines in FIG. 4, and the floatation nozzles 505, 505 on both extreme sides are closed by the closure members 240 and 240, the number of the nozzles for jetting the air decreases, and the fan 6 needs send the air at a decreased rate. Here, when the width-limiting members 24 and 24 are brought to the positions of the lengthwise side of the B5 size indicated by two-dot chain lines in FIGS. 4 and 5, the second detection switch 262 (SW3) produces a signal ON. In response to this signal, the control means 100 so works that the predetermined second voltage is applied to the electric motor 7 (M3). Therefore, the fan 6 is driven by the electric motor 7 (M3) at a decreased speed, whereby the air flow rate decreases and the fan becomes more silent.

When the electric motor 37 (M2) is driven, the suction fan 38 of the suction/feed means 3 operates to suck the air through the suction duct 33, suction ports 332*a* and holes 34*a* provided in the conveyer belts 34. As a result, the lower side of the conveyer belts 34 is decompressed, and the uppermost paper that is floated is adsorbed by the lower surfaces of the conveyer belts 34. Here, when the second paper adheres to the uppermost paper, the air jetted from the separation nozzles 506 enters between the uppermost paper and the second paper, whereby the second and subsequent papers are separated from the uppermost paper. The drive roller 31 of the suction/feed means 3 is driven in the direction indicated by an arrow 310 to cause to run the conveyer belts 34 in the direction indicated by the arrow 30. Therefore, the uppermost paper is fed in the direction indicated by the arrow 30 in which the paper is to be conveyed while being adsorbed by the conveyer belts 34. Thus, the paper fed by the suction/feed means 3 is conveyed to the image-forming unit through the pair of conveyer rollers 11.

In the embodiment shown in FIGS. 1 to 6, the pair of width-limiting members 24 and 24 disposed on the paper-stacking plate 22 are secured to the positions of lengthwise side of the A4 size or to the positions of lengthwise side of the B5 size. They, however, may be constructed to be secured to plural positions corresponding to other paper sizes.

According to the embodiment shown in FIGS. 1 to 6, as described above, the width-limiting members for limiting the positions of the papers stacked on the paper-stacking plate in the direction of width are provided with the closure members for closing the nozzles existing on the outer sides of the width-limiting members, of plural nozzles provided in the air duct that constitutes the air-blowing means. When the papers of a small size are to be used, therefore, the air jetted from the nozzles do not act on the papers from both sides thereof, whereby there can be prevented the occurrence of the so-called overlapped paper feeding in which the papers are excessively floated and plural pieces of papers are fed at one time.

Further, according to the embodiment shown in FIGS. 1 to 6, a paper size detection means for detecting the positions of the width-limiting members and a control means for controlling the air amount of the fan based on a detection signal from the paper size detection means are provided and controls the air flow amount of the fan depending on the size of the papers to be used. When the papers of a small size are used, therefore, the fan is rotated at a decreased speed to decrease the air amount and, hence, the fan can be more silent.

Next, a second embodiment of the paper feeder constituted according to the present invention will be described with reference to FIGS. 7 to 10. In the embodiment shown in FIGS. 7 to 10, the same members as those of the embodiment of FIGS. 1 to 6 are denoted by the same reference numerals but their description is not repeated.

In the embodiment shown in FIGS. 7 to 10, the suction duct 33 constituting the suction/feed means 3 is different from that of the embodiment shown in FIGS. 1 to 6. That is, in the embodiment shown in FIGS. 7 to 10, ribs 332*b* are formed on the lower surface of the bottom wall 332 constituting the suction duct 33 to protrude downward on the upstream sides (left sides in FIG. 7) of the four suction ports 332*a* in the direction in which the paper is conveyed. The protrusion amount H of the ribs 332*b* protruding from the lower surface of the bottom wall 332 is set to be 1.5 to 3.5 mm in the illustrated embodiment. The connection cylinder 337 is molded at the front end wall 335 integrally therewith. The suction fan 38 driven by the electric motor 37 is mounted in the connection cylinder 337. The air intake port 336*a* is formed in the rear end wall 336.

The conveyer belt 34 is made of a synthetic rubber having a thickness of about 0.5 to about 1.5 mm in an endless form like in the embodiment shown in FIGS. 1 to 6. The conveyer belt 34 has plural holes 34*a* formed therein. In the illustrated embodiment, the holes 34*a* have a diameter of 5 mm and are arranged in four columns at a hole pitch of 10 mm, the distance between the hole 34*a* and another hole 34*a* being 13.5 mm. The thus constituted conveyer belts 34 are disposed at positions corresponding to the above four suction ports 332*a* and come in contact with the ribs 332*b*.

Figure 8:
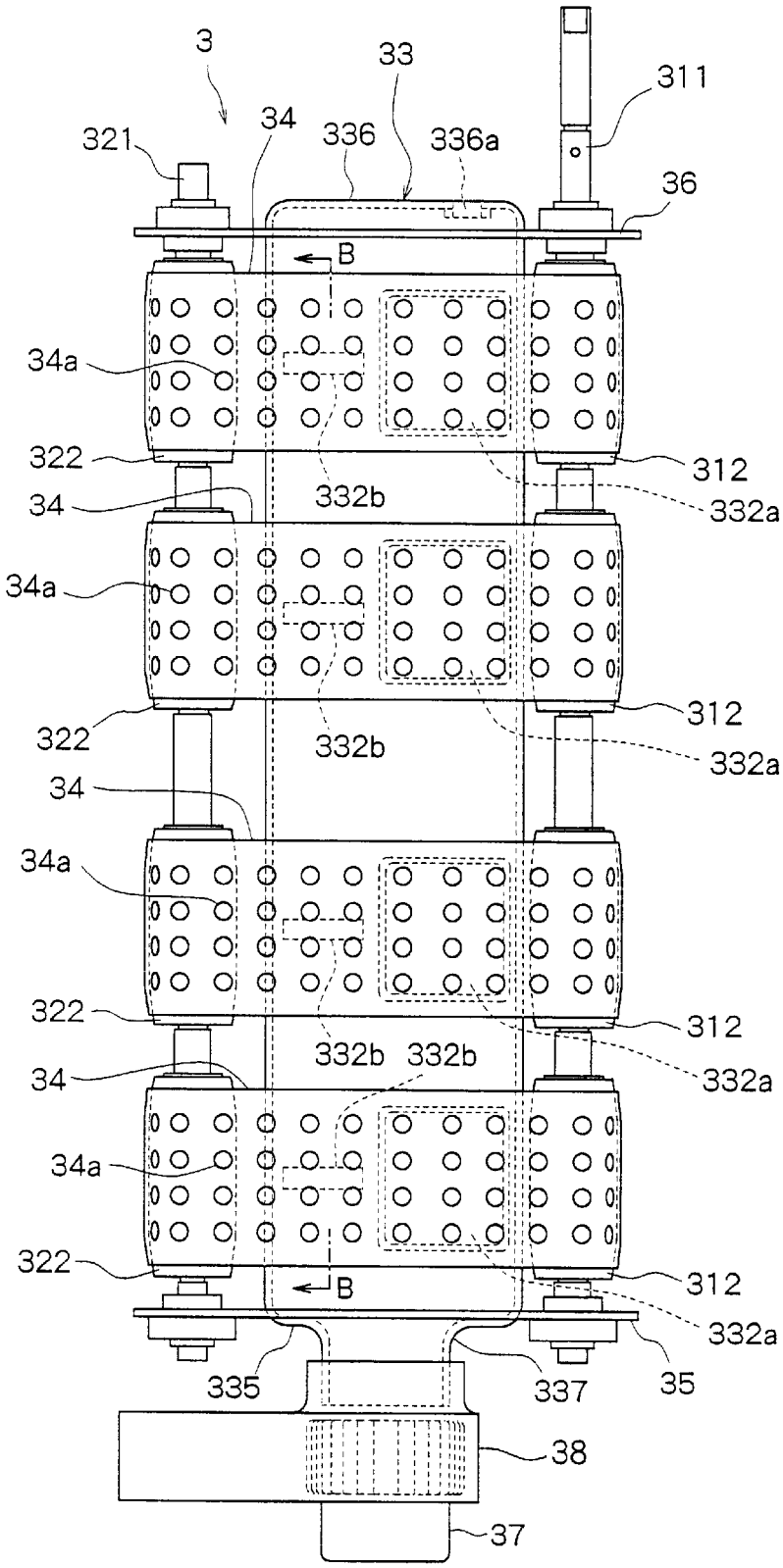
FIG. 8 is a plan view of a suction/feed means constituting the paper feeder shown in FIG. 7.
Figure 9:
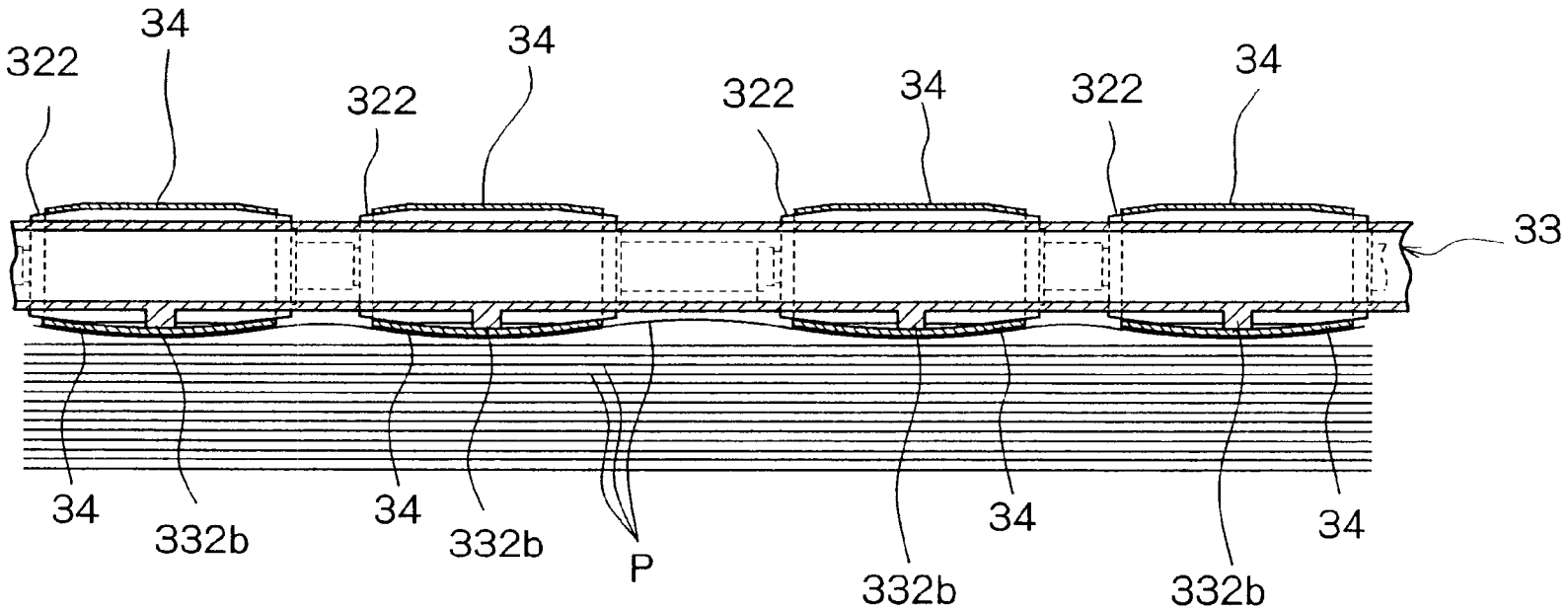
FIG. 9 is a sectional view along the line B—B of the suction/feed means shown in FIG. 2.
Figure 10:
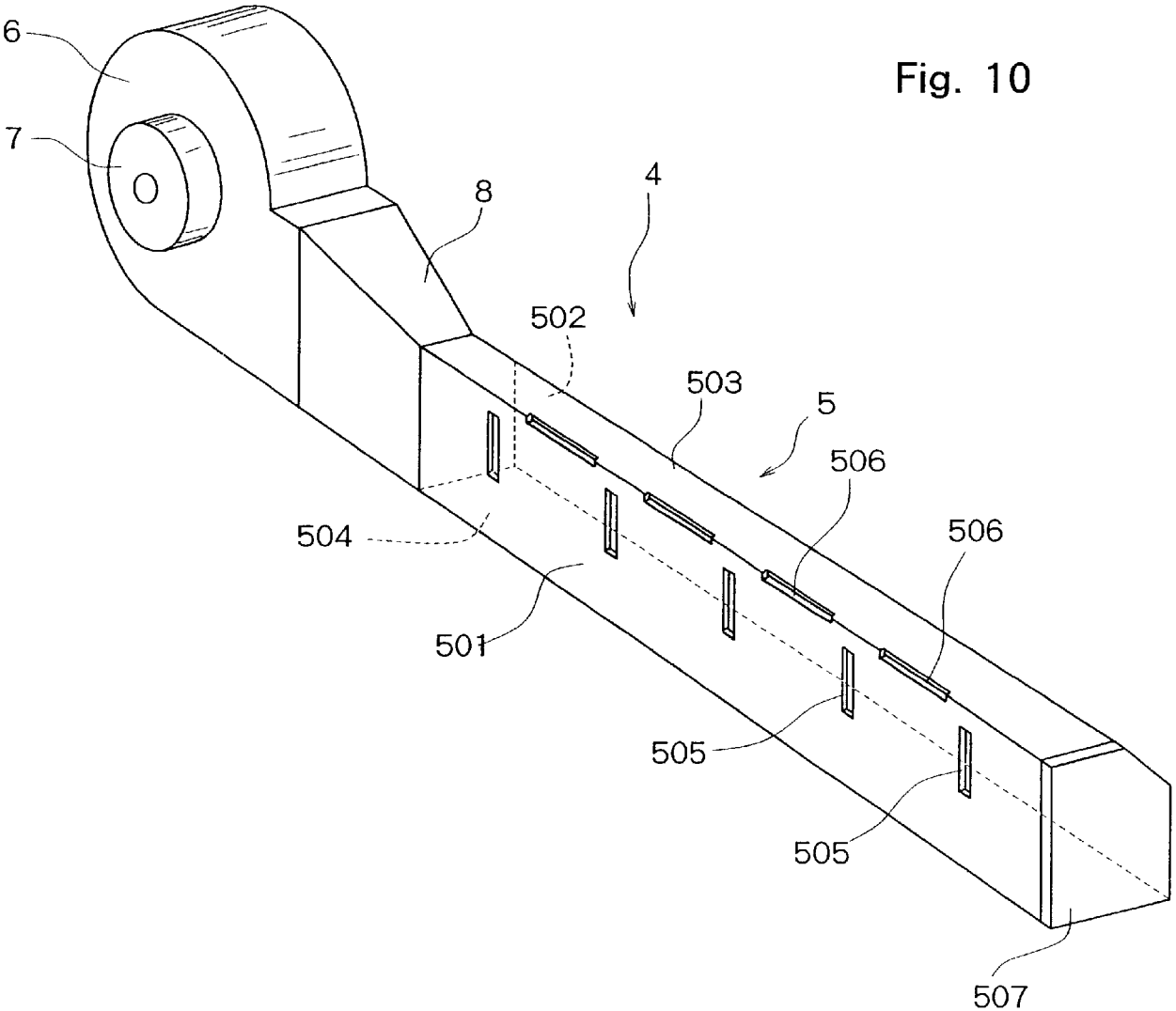
FIG. 10 is a perspective view of an air-blowing means constituting the paper feeder shown in FIG. 7 according to the embodiment.

The embodiment shown in FIGS. 7 to 10 is substantially the same as the constitution of the suction duct 33 constituting the above-mentioned suction/feed means 3 except that the arrangement of the floatation nozzles 511 and the separation nozzles 551 formed in the air duct 5 of the air-blowing means 4 shown in FIG. 10 is slightly different from those of the embodiment shown in FIGS. 1 to 6.

The paper feeder of the embodiment shown in FIGS. 7 to 10 is constituted as described above. Now, described below is its operation.

When plural pieces of papers P are stacked on the paper-stacking plate 22 of the paper-stacking means 2 and are brought to a predetermined position of the frame 21, this state is detected in the same manner as in the above-mentioned embodiment shown in FIGS. 1 to 6, whereby the plate elevation mechanism that is not shown is actuated to elevate the paper-stacking plate 21. When the height of the papers P stacked on the paper-stacking plate 22 reaches the position P1, the photo sensor 235 produces a signal ON and the actuation of the plate elevation mechanism is halted in a state shown in FIG. 7, as described above.

Figure 7:
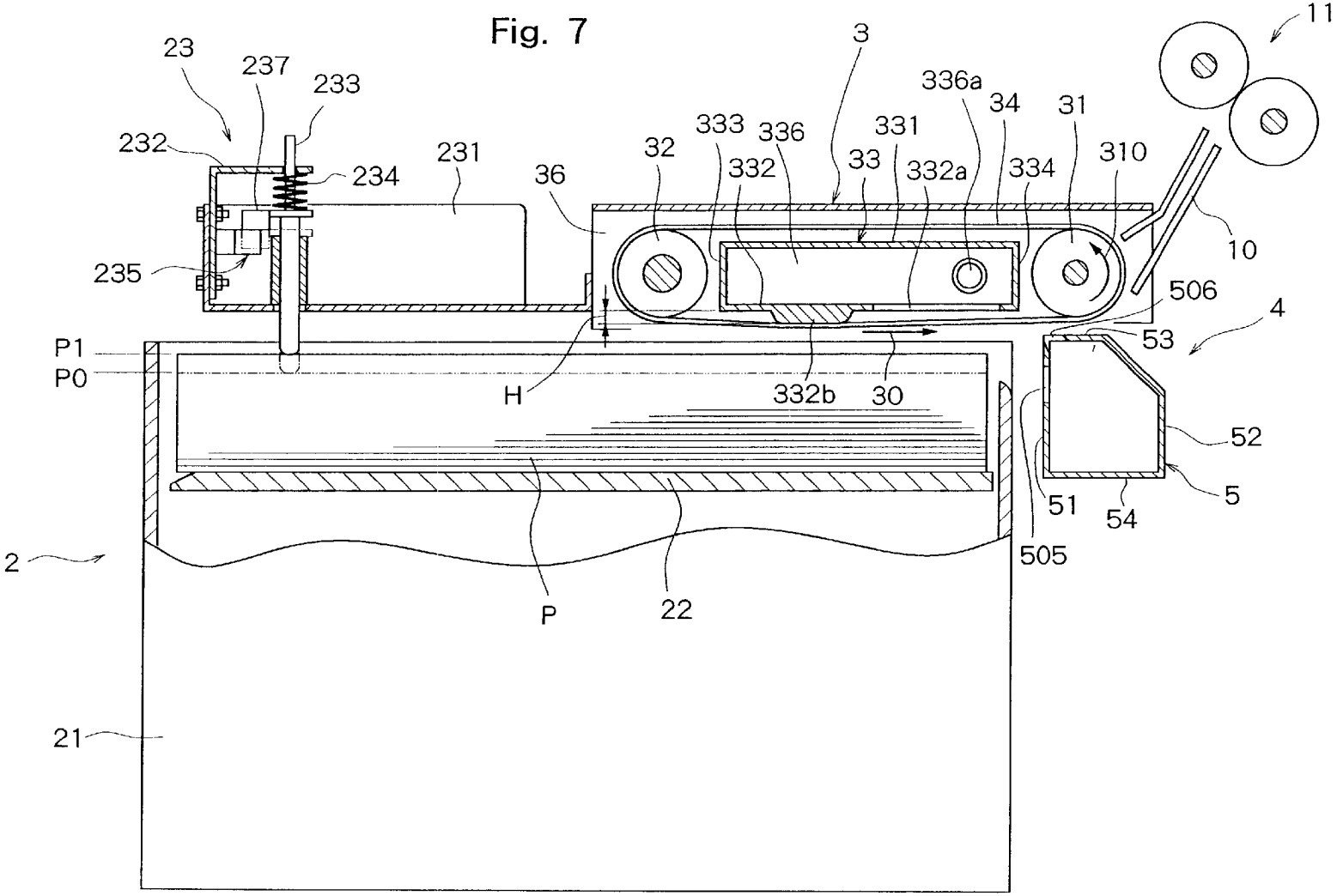
FIG. 7 is a sectional view schematically illustrating the constitution of the paper feeder according to a second embodiment of the present invention.

When a paper-feed signal is produced in a state shown in FIG. 7, the control means 100 drives the electric motor 7 of the air-blowing means 4 and the electric motor 37 of the suction/feed means 3. When the electric motor 7 of the air-blowing means 4 is driven, the fan 6 is actuated and sends the air to the air duct 5, and the air is jetted out through the floatation nozzles 505 and the separation nozzles 506. The air jetted from the floatation nozzles 505 is blown against the upper portion of the papers P stacked on the paper-stacking plate 22, whereby the upper several pieces of papers are caused to float. When the electric motor 37 of the suction/feed means 3 is driven, the suction fan 38 of the suction/feed means 3 operates to suck the air through the suction duct 33, suction ports 332*a* and holes 34*a* provided in the conveyer belts 34. As a result, the lower side of the conveyer belts 34 is decompressed, and the uppermost paper that is floated is adsorbed by the lower surfaces of the conveyer belts 34. At this moment, the conveyer belts 34 are curved by the ribs 332*b* that protrude beyond the lower surface of the bottom wall 332 constituting the suction duct 33 as shown in FIG. 9 and, hence, the uppermost paper adsorbed by the lower surfaces of the conveyer belts 34 is undulated. Therefore, a gap is formed between the uppermost paper adsorbed by the lower surfaces of the conveyer belts 34 and the second paper, and the air jetted from the separation nozzles 551 enters into the gap, so that the uppermost paper is reliably separated from the second and subsequent papers. The drive roller 31 of the suction/feed means 3 is driven in the direction indicated by an arrow 310 to cause to run the conveyer belts 34 in the direction indicated by the arrow 30. Therefore, the uppermost paper is fed in the direction indicated by the arrow 30 in which the paper is to be conveyed while being adsorbed by the conveyer belts 34. Thus, the paper fed by the suction/feed means 3 is conveyed to the image-forming unit through the pair of conveyer rollers 11.

Described below are the results of experiment concerning performance for separating the papers by a change in the protrusion amounts H of the ribs 332*b* protruding beyond the lower surface of the lower wall 332 constituting the suction duct 33. The suction/feed means 3 having four conveyer belts 34 was used as shown in FIGS. 7 to 9. The ribs 332*b* were 30 mm long in the direction in which the paper is conveyed, and 5 mm wide, and the experiment was conducted by changing the protrusion amount H. As the papers were used those which were generally used as copy papers weighing 60 g/m$^2$ and having an A4-size and those called thick papers weighing 200 g/m$^2$ and having the A4-size. The experimental results are shown in Table 1 in which "o" represents favorable separation, and "x" represents poor separation resulting in the so-called overlapped paper feeding in which plural pieces of papers are fed at one time.

TABLE 1

| H | 1 mm | 1.5 mm | 2 mm | 3 mm | 3.5 mm | 4 mm |
|---|---|---|---|---|---|---|
| 60 g/m$^2$ | x | ○ | ○ | ○ | ○ | ○ |
| 200 g/m$^2$ | x | ○ | ○ | ○ | ○ | x |

As shown in Table 1, when the protrusion amount H of the ribs 332*b* was 1.5 to 3.5 mm, the papers of both 60 g/m$^2$ and 200 g/m$^2$ were smoothly separated without occurrence of the so-called overlapped paper feeding. When the protrusion amount H of the ribs 332*b* was 1 mm or less, the papers of both 60 g/m$^2$ and 200 g/m$^2$ were fed in an overlapped manner. When the protrusion amount H of the ribs 332*b* was 4 mm or more, it happened that no paper was fed in the case of the papers of 200 g/m$^2$, though neither occurrence of the overlapped paper feeding nor feeding of no paper were caused in the case of the papers of 60 g/m$^2$. It is, therefore, desired that the protrusion amount H of the ribs 332*b* is 1.5 to 3.5 mm. Since the ribs 332*b* are formed on the upstream sides of the suction ports 332*a* in the direction in which the paper is conveyed, the conveyer belts 34 are gently curved with the ribs 332*b* as vertexes as shown in FIG. 9. Therefore, the paper adsorbed by the conveyer belts 34 is not so strongly undulated unlike the one that occurs when the ribs are formed by the sides of the suction ports as done in the prior art, but is gently undulated. The gentle undulation formed in the paper disappears after the paper is conveyed and hence, the occurrence of paper clogging (jamming) is prevented in the subsequent conveyance.

Next, a third embodiment of the paper feeder constituted according to the invention will be described with reference to FIGS. 11 and 12. In the embodiment shown in FIGS. 11 and 12, the same members as those of the embodiment of FIGS. 7 to 10 are denoted by the same reference numerals but their description is not repeated.

Figure 11:
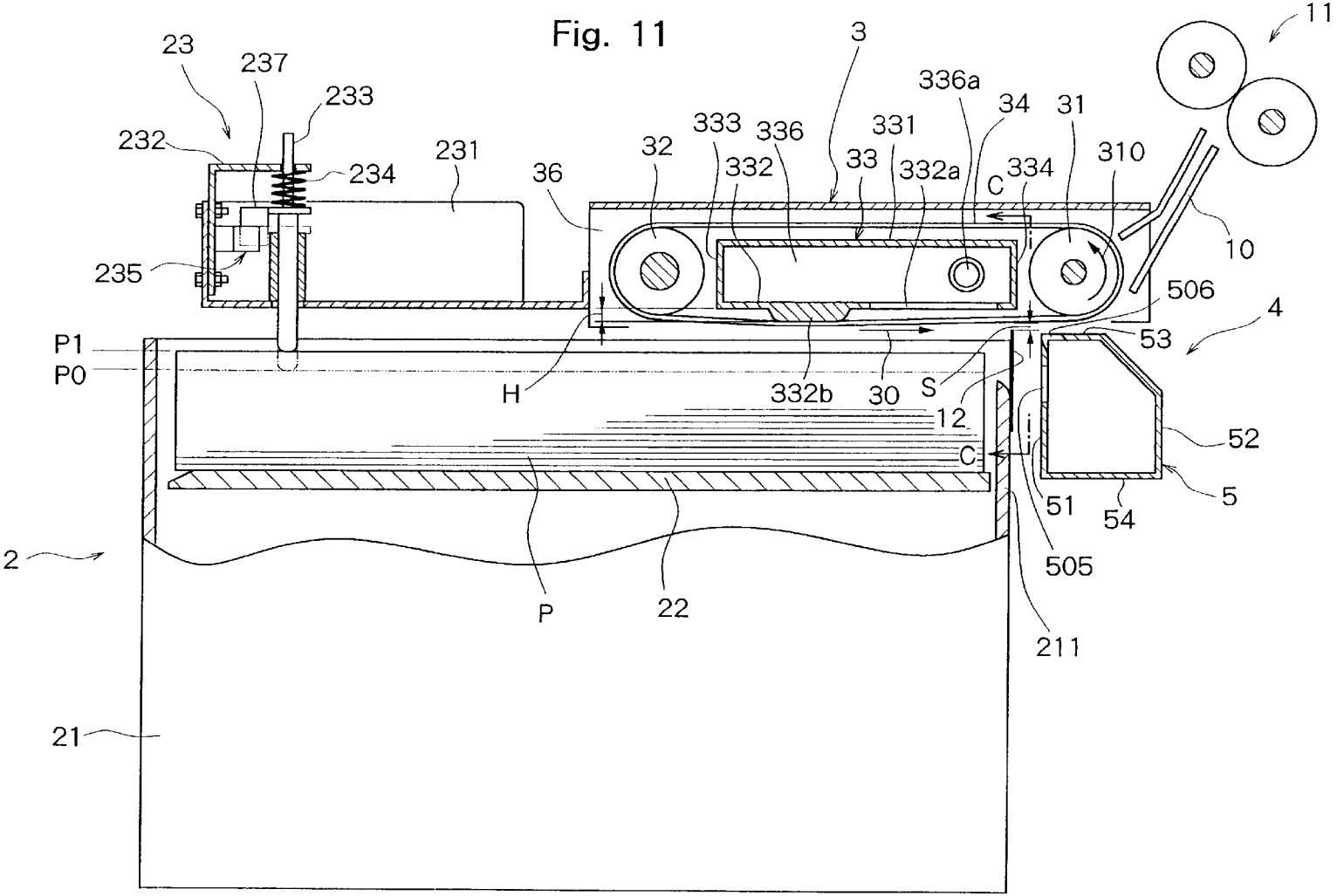
FIG. 11 is a sectional view schematically illustrating the constitution of a paper feeder according to a third embodiment of the present invention.
Figure 12:
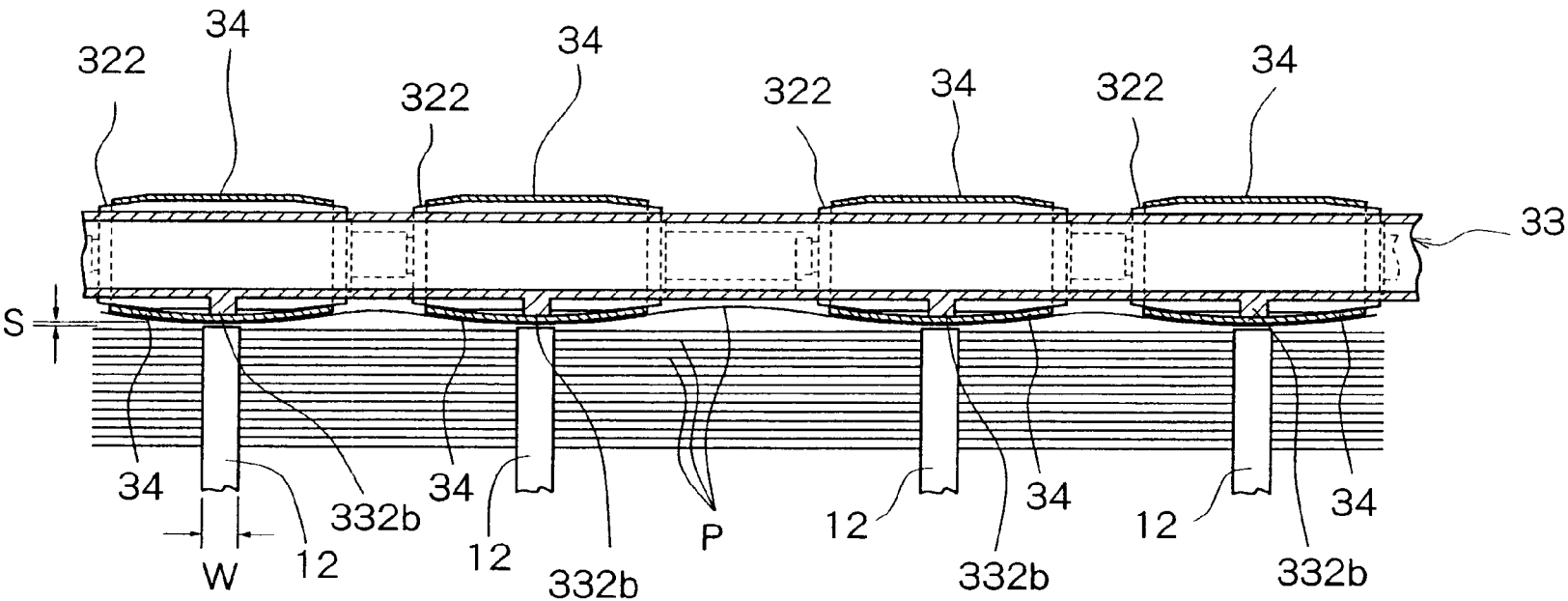
FIG. 12 is a sectional view along the line C—C of the paper feeder shown in FIG. 11.

In the embodiment shown in FIGS. 11 and 12, paper-limiting members 12 are disposed at positions close to the lower surfaces of each the four conveyer belts 34 constituting the suction/feed means 3 on the upstream side (right side in FIG. 11) of the papers P stacked on the paper-stacking plate 22 of paper-stacking means 2, in the direction in which the paper is conveyed. The paper-limiting members 12 are made of a flexible elastic material such as a polyethylene terephthalate resin (PET) film or the like, and are attached at their lower ends to a side plate 211, on the right side in FIG. 11, constituting the frame 21 of the paper-stacking means 2, by using fastening means such as double-sided adhesive tape or the like. It is desired that a gap S is set to be 0.5 to 3 mm between the upper ends of the paper-limiting members 12 and the lower surfaces of the conveyer belts 34. When the gap S is too small, there may often occur that no paper is fed. When the gap S is too large, there may occur the so-called overlapped paper feeding in which plural pieces of papers are fed at one time.

Described below are the results of experiment concerning the paper-feeding performance by a change in the gap S between the upper ends of the paper-limiting members 12 and the lower surfaces of the conveyer belts 34. In this experiment, a paper-limiting members 12 made of a polyethylene terephthalate resin (PET) film and having a thickness of 0.05 to 0.25 mm and a width W of 20 mm was used. As the papers were used those which were usually used as copy papers weighing 60 g/m$^2$ and having the A4-size and those called thick papers weighing 200 g/m$^2$ and having the A4-size. The experimental results are as shown in Table 2 in which "o" represents favorable paper feeding, and "x" represents no paper feeding or poor separation resulting in the so-called overlapped paper feeding in which plural pieces of papers were fed at one time.

TABLE 2

| S | 0 mm | 0.5 mm | 1 mm | 2 mm | 3 mm | 3.5 mm |
|---|---|---|---|---|---|---|
| 60 g/m$^2$ | x | ○ | ○ | ○ | ○ | x |
| 200 g/m$^2$ | ○ | ○ | ○ | ○ | ○ | x |

As shown in Table 2, when the gap S between the upper ends of the paper-limiting members 12 and the lower surfaces of the conveyer belts 34 was 0.5 to 3 mm, the papers of both 60 g/m$^2$ and 200 g/m$^2$ were smoothly fed without occurrence of the so-called overlapped paper feeding. When the gap S was smaller than 0.5 mm, the papers of 60 g/m$^2$ were not often fed. Further, when the gap S was 3.5 mm or more, the papers of both 60 g/m$^2$ and 200 g/m$^2$ were fed in an overlapped manner. It is therefore desired that the gap S between the upper ends of the paper-limiting members 12 and the lower surface of the conveyer belts 34 is set to be 0.5 to 3 mm.

In the embodiment shown in FIGS. 11 and 12, the ribs 332*b* are provided on the lower surface of the bottom wall 332 of the suction duct 33. The invention, however, does not necessarily require the ribs 332*b*.

Next, a fourth embodiment of the paper feeder constituted according to the invention will be described with reference to FIG. 13. In the embodiment shown in FIG. 13, the same members as those of the embodiment of FIGS. 11 and 12 are denoted by the same reference numerals but their description is not repeated.

Figure 13:
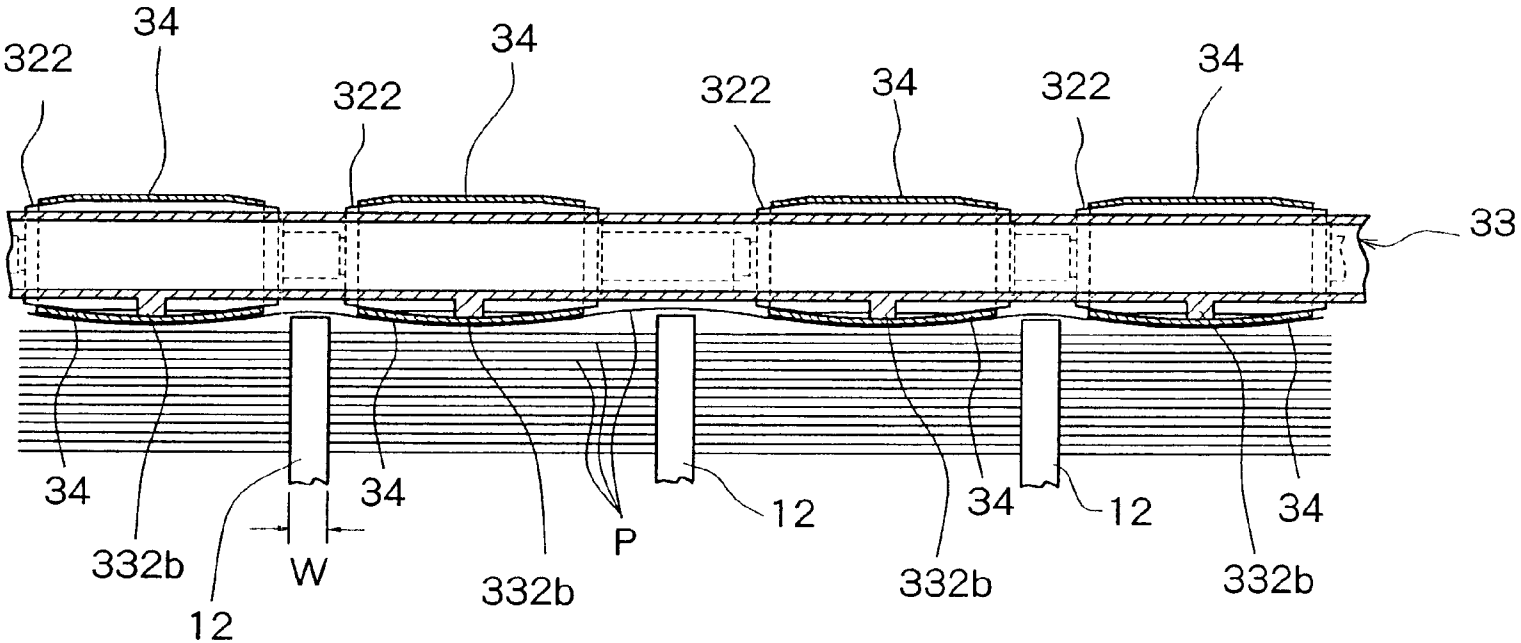
FIG. 13 is a sectional view schematically illustrating the constitution of a paper feeder according to a fourth embodiment of the present invention.

In the embodiment shown in FIG. 13, the paper-limiting members 12 of the embodiment of FIGS. 11 and 12 are disposed between the respective four conveyer belts 34 constituting the suction/feed means 3. The paper-limiting members 12 are made of a flexible elastic material such as a polyethylene terephthalate resin (PET) film or the like, having a thickness of 0.05 to 0.25 mm and a width W of 20 mm. The thus constituted paper-limiting members 12 are attached at their lower ends to the side plate 211 constituting the frame 21 of the paper-stacking means 2 by using a fastening means such as double-sided adhesive tape or the like in the same manner as in the embodiment shown in FIGS. 11 and 12. The upper ends of the paper-feeding members 12 are flush with the lower surfaces of the conveyer belts 34 or protrude upward beyond the lower surfaces of the conveyer belts 34. That is, the upper ends of the paper-limiting members 12 are set to be higher than the lowermost point of the uppermost paper but is not higher than the uppermost point of the uppermost paper that is undulated being absorbed by the conveyer belts 34 as shown in FIG. 13. Accordingly, the paper-limiting members 12 permit the conveyance of the uppermost paper adsorbed by the conveyer belts 34 but blocks the movement of the second and subsequent papers to the direction of conveyance, thereby reliably preventing the occurrence of the so-called overlapped paper feeding in which plural pieces of papers are fed at one time.

According to the embodiments shown in FIGS. 7 to 13 as described above, the suction duct constituting the suction/feed means is provided with ribs that come in contact with the conveyer belts, the ribs being formed on the lower surface of the bottom wall on the upstream sides of the suction ports formed in the bottom wall in the direction in which the paper is conveyed. Therefore, the conveyer belts are curved by the ribs, and the uppermost paper adsorbed by the lower surfaces of the conveyer belts is caused to undulate. Accordingly, a gap is formed between the uppermost paper adsorbed by the lower surfaces of the conveyer belts and the second paper, and the air jetted from the separation nozzles enter into the gap to reliably separate the uppermost paper from the second and subsequent papers.

The ribs are formed on the upstream sides of the suction ports in the direction in which the paper is conveyed and, hence, the conveyer belt is gently curved with the ribs as vertexes. Therefore, the paper adsorbed by the conveyer belts is not so largely undulated as the one would occur with the prior art in which the ribs are provided by the sides of the suction ports; i.e., the paper is gently undulated. The gentle undulation formed in the paper disappears after the paper is conveyed, preventing the occurrence of paper clogging (jamming) in the subsequent conveyance.

According to the embodiments shown in FIGS. 7 to 13, the paper-limiting members made of a flexible elastic material are provided at the position close to the lower surfaces of the conveyer belts on the downstream sides of the papers stacked on the paper-stacking means in the direction in which the paper is conveyed. Therefore, a reliable paper-separating function is accomplished and prevents the occurrence of the so-called overlapped paper feeding in which plural pieces of papers are fed at one time.

According to the embodiments shown in FIGS. 7 to 13, further, since the paper-limiting members made of a flexible elastic material are provided being disposed between the conveyer belts on the downstream sides of the papers stacked on the paper-stacking means in the direction in which the paper is conveyed, a reliable paper-separating function is accomplished with the result that the occurrence of the so-called overlapped paper feeding in which plural pieces of papers are fed at one time can be surely prevented.

Next, a fifth embodiment of the paper feeder constituted according to the invention will be described with reference to FIGS. 14 to 27. In the embodiment shown in FIGS. 14 to 27, the same members as those of the embodiment of FIGS. 1 to 6 are denoted by the same reference numerals but their description is not repeated.

In the embodiment shown in FIGS. 14 to 27, the air duct 5 constituting the air-blowing means 4 is different from that of the embodiment shown in FIGS. 1 to 6. In other respects, however, the constitution of this embodiment is substantially the same as the embodiment shown in FIGS. 1 to 6. In the embodiment shown in FIGS. 14 to 27, the air duct 5 is constituted by a base board 51, and plural blocks 52 mounted on the base board 51 to form a duct together with the base board 51.

Figure 16:
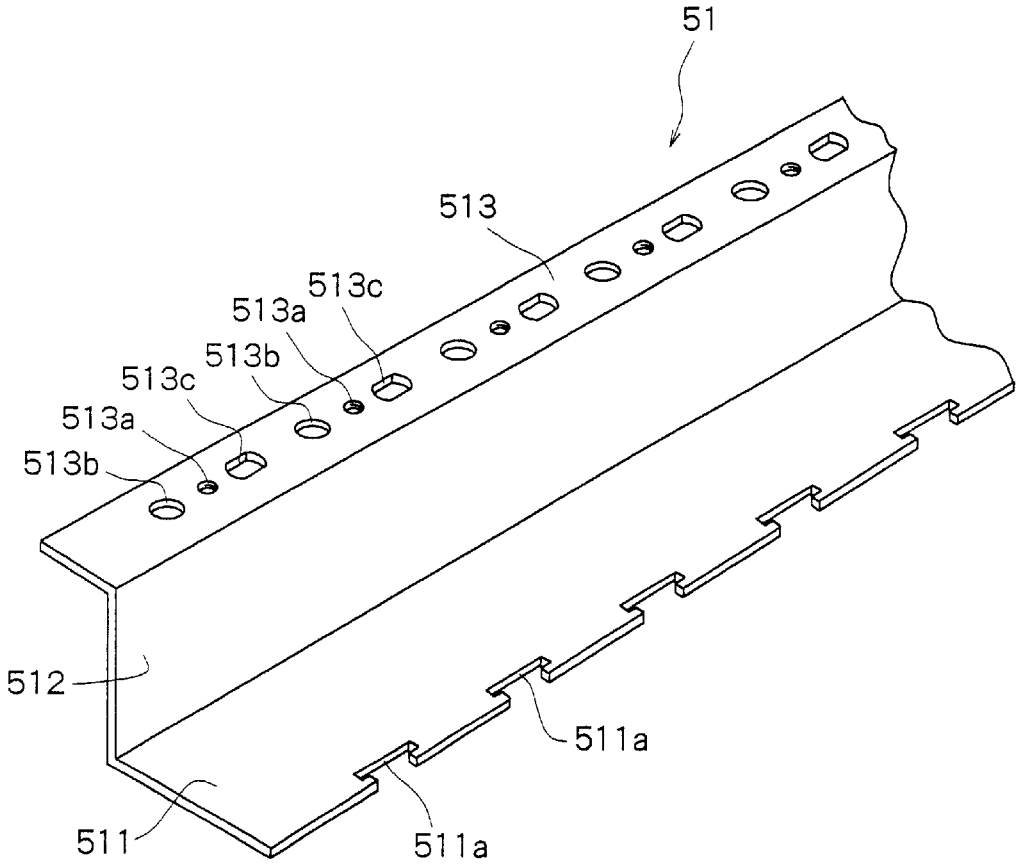
FIG. 16 is a perspective view of a base board constituting an air duct of the air-blowing means shown in FIG. 15.

In the illustrated embodiment as shown in FIG. 16, the base board 51 has a bottom wall 511, a side wall 512 extending upward from an edge of the bottom wall 511, and an upper wall 513 extending outward in a horizontal direction from the upper edge of the side wall 512. The base board 51 is formed by press-molding a steel plate. Plural engaging grooves 511*a* are formed in the lengthwise direction at the other edge portion of the bottom wall 511. In the upper wall 513 threaded holes 513*a*, fitting holes 513*b* and elongated fitting holes 513*c* are formed at positions corresponding to the engaging grooves 511*a*. The threaded holes 513*a* are formed at positions corresponding to the centers of the engaging grooves 511*a*, the fitting holes 513*b* are formed on one side of the threaded holes 513*a*, and the elongated fitting holes 513*c* are formed on the other side of the threaded holes 513*a*.

Figure 15:
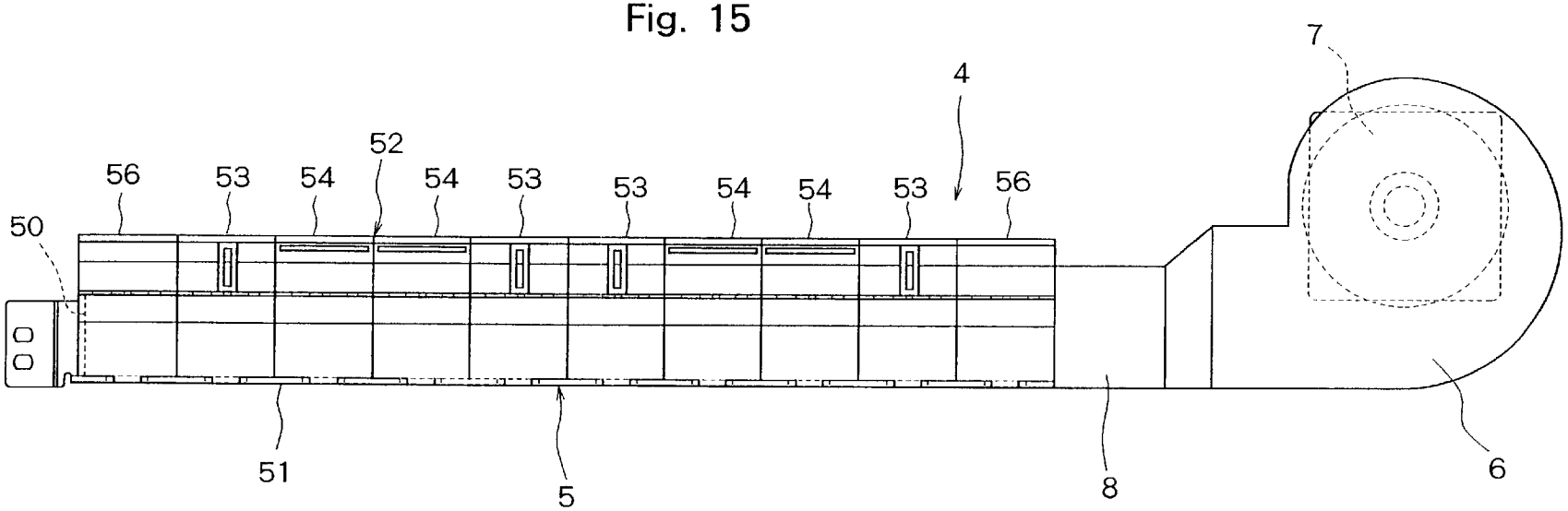
FIG. 15 is a front view of an air-blowing means constituting the paper feeder shown in FIG. 14.

In the embodiment shown in FIG. 15, the plural blocks 52 include the first blocks 53, the second blocks 54 and space blocks 56, these blocks having the same size in the direction of width. The illustrated embodiment further includes the third blocks 55 shown in FIGS. 21 and 22.

Figure 17:
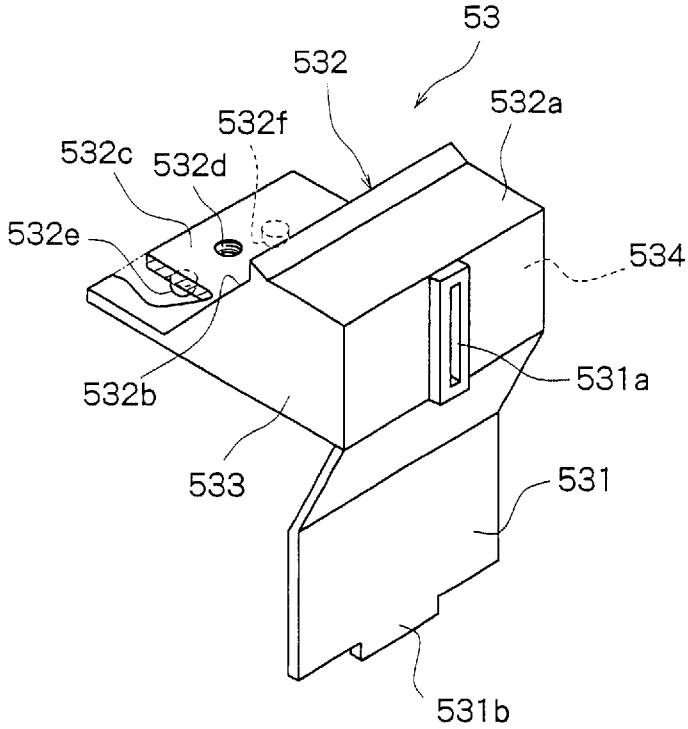
FIG. 17 is a perspective view illustrating the first block that constitutes the air duct of the air-blowing means shown in FIG. 15.
Figure 18:
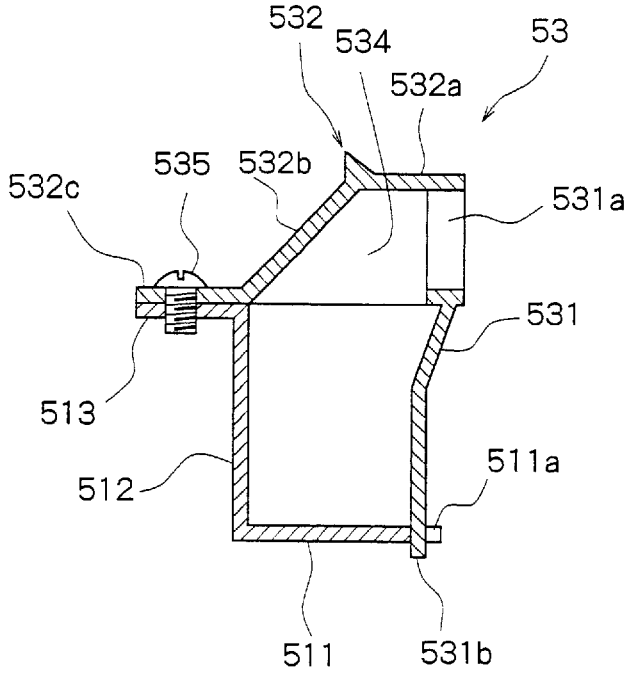
FIG. 18 is a sectional view illustrating a state where the first block shown in FIG. 17 is mounted on the base board.

As shown in FIGS. 17 and 18, the first block 53 includes a side wall 531, an upper wall 532 and end walls 533, 534 which are molded as a unitary structure using a suitable synthetic resin. A floatation nozzle 531*a* is formed in an upper part of the side wall 531 to jet out the air against an upper portion of the papers P stacked on the paper-stacking plate 22 of the paper-stacking means 2. The floatation nozzle 531*a* extends in the up-and-down direction at a central portion in the direction of width of the side wall 531. Further, an engaging portion 531*b* protrudes downward from the lower end of the side wall 531 at a central portion thereof. The upper wall 532 includes a horizontal portion 532*a* connected to the side wall 531, an inclined portion 532*b* inclining downward from the edge of the horizontal portion 532*a*, and a mounting portion 532*c* extending in a horizontal direction from an end of the inclined portion 532*b*. The mounting portion 532*c* has a screw insertion hole 532*d*, and positioning protuberances 532*e* and 532*f* protruding downwards on both sides of the screw insertion hole 532. The distances between the screw insertion hole 532*d* and each positioning protuberances 532*e*, 532*f* correspond to the distances between the threaded hole 513*a* and each of fitting hole 513*b* and elongated fitting hole 513*c* formed in the base board 51. The end walls 533 and 534 close both ends of space surrounded by the upper part of the side wall 531, horizontal portion 532*a* and inclined portion 532*b* of the upper wall 532. To mount the thus constituted first block 53 on the base board 51, the positioning protuberances 532*e* and 532*f* formed on the mounting portion 532*c* are fitted into the fitting hole 513*b* and the elongated fitting holes 513*c* formed in the upper wall 513 of the base board 51 while inserting the engaging portion 531*b* formed at the lower end of the side wall 531 in the engaging groove 511*a* formed in the bottom wall 511 of the base board 51. In this state, the first block 53 is positioned, and the screw insertion hole 532*d* formed in the mounting portion 532*c* faces the threaded hole 513*a* formed in the upper wall 513 of the base board 51. Therefore, by screwing a screw 535 to the threaded hole 513*a* through the screw insertion hole 532*d*, the first block 53 is mounted on the base board 51.

Figure 19:
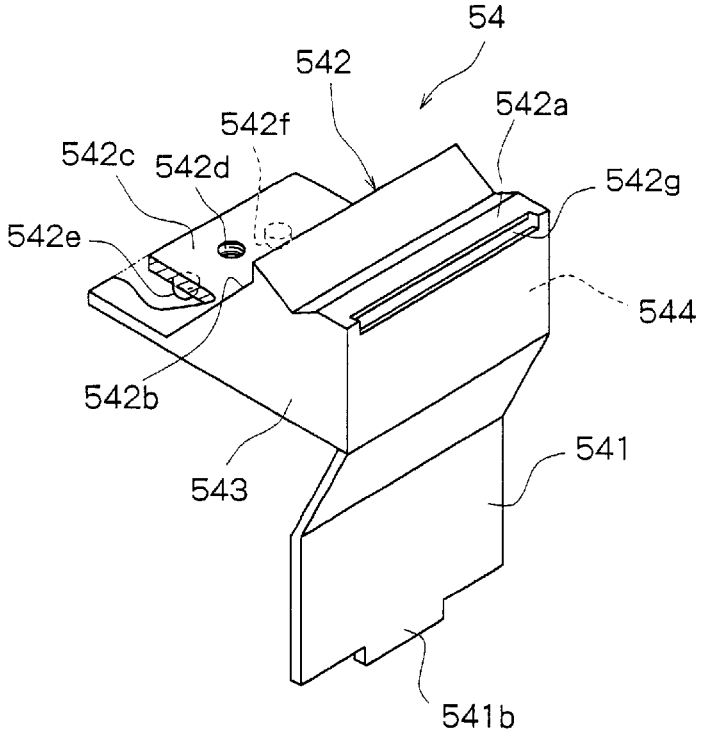
FIG. 19 is a perspective view illustrating a second block that constitutes the air duct of the air-blowing means shown in FIG. 15.
Figure 20:
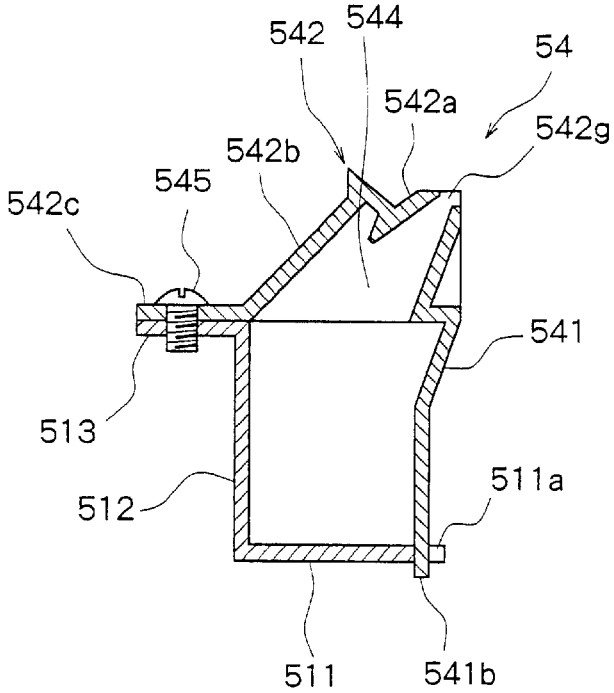
FIG. 20 is a sectional view illustrating a state where the second block shown in FIG. 19 is mounted on the base board.

Referring to FIGS. 19 and 20, the second block 54 includes a side wall 541, an upper wall 542 and end walls 543, 544 which are molded as a unitary structure using a suitable synthetic resin. The side wall 541 has an engaging portion 541*b* protruding downward from the lower end at the central portion thereof. The upper wall 542 includes a first inclined portion 542*a* connected to the side wall 541 and is inclined downward, a second inclined portion 542*b* connected to the first inclined portion 542*a* and is inclined downward, and a mounting portion 542*c* extending horizontally from the end of the second inclined portion 542*b*. A separation nozzle 542*g* is formed at a portion where the first inclined portion 542*a* connects to the side wall 541 to jet out the air onto the lower surface of the suction/feed means 3. The separation nozzle 542*g* is formed elongatingly in the horizontal direction (direction of width of the first inclined portion 542*a*). The mounting portion 542*c* has a screw insertion hole 542*d*, and positioning protuberances 542*e*, 542*f* that protrude downward on both sides of the screw insertion hole 542.

The distances between the screw insertion hole 542*d* and each positioning protuberances 542*e*, 542*f* correspond to the distances between the threaded hole 513*a* and each of the fitting hole 513*b* and the elongated fitting hole 513*c* formed in the base board 51. The end walls 543 and 544 close both ends of space surrounded by the upper part of the side wall 541, first inclined portion 542*a* and second inclined portion 542*b* of the upper wall 542. To mount the thus constituted second block 54 on the base board 51, the positioning protuberances 542*e* and 542*f* formed on the mounting portion 542*c* are fitted into the fitting hole 513*b* and the elongated fitting holes 513*c* formed in the upper wall 513 of the base board 51 while inserting the engaging portion 541*b* formed at the lower end of the side wall 541 in the engaging groove 511*a* formed in the bottom wall 511 of the base board 51. In this state, the second block 54 is positioned, and the screw insertion hole 542*d* formed in the mounting portion 542*c* faces the threaded hole 513*a* formed in the upper wall 513 of the base board 51. Therefore, by screwing a screw 545 into the threaded hole 513*a* through the screw insertion hole 542*d*, the second block 54 is mounted on the base board 51.

Figure 21:
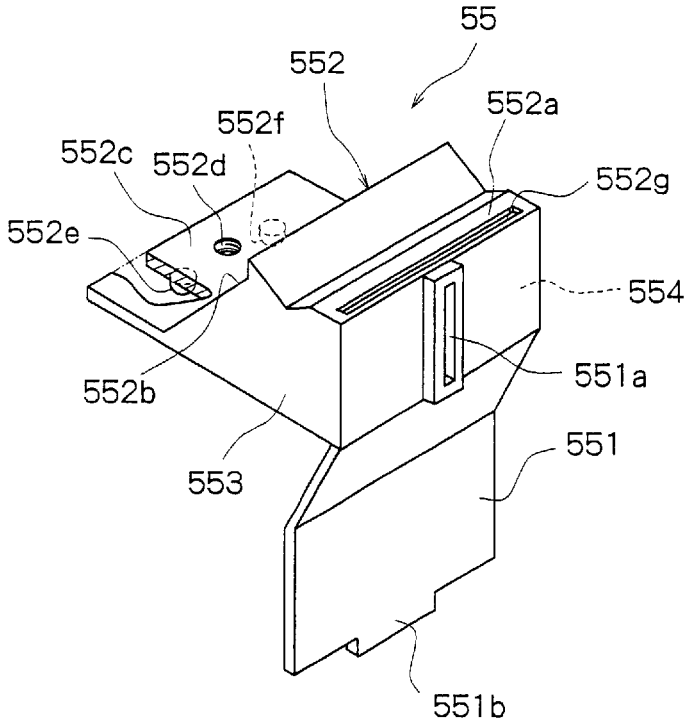
FIG. 21 is a perspective view illustrating a third block that constitutes the air duct of the air-blowing means shown in FIG. 15.
Figure 22:
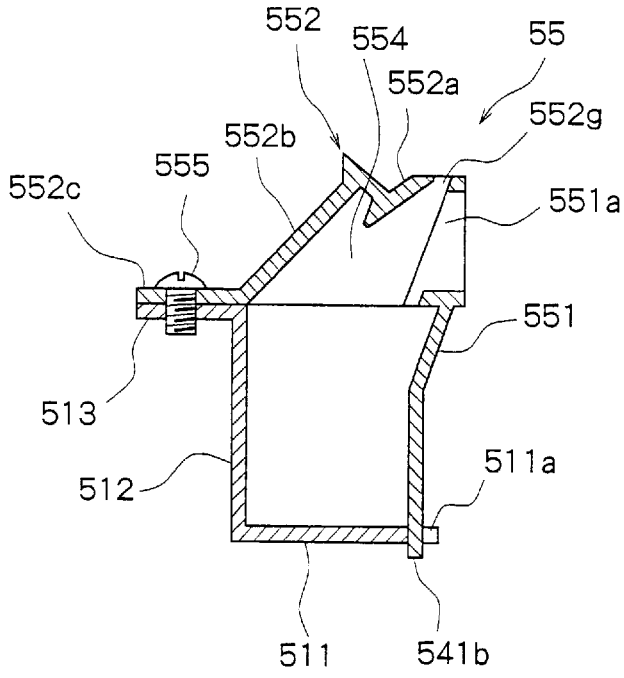
FIG. 22 is a sectional view illustrating a state where the third block shown in FIG. 21 is mounted on the base board.

The third block 55 shown in FIGS. 21 and 22 includes a side wall 551, an upper wall 552 and end walls 553, 554 which are molded as a unitary structure using a suitable synthetic resin. A floatation nozzle 551*a* is formed in an upper part of the side wall 551 to jet out the air against the upper portion of the papers P stacked on the paper-stacking plate 22 of the paper-stacking means 2. The floatation nozzle 551*a* is formed being elongated in the up-and-down direction at a central portion in the direction of width of the side wall 551. The side wall 551 has an engaging portion 551*b* protruding downward from the lower end at the central portion thereof. The upper wall 552 includes the first inclined portion 552*a* connected to the side wall 551 and is inclined downward, the second inclined portion 552*b* connected to the first inclined portion 552*a* and is inclined downward, and a mounting portion 552*c* extending horizontally from the end of the second inclined portion 552*b*. At a portion where the first inclined portion 552*b* is connected to the side wall 551, a separation nozzle 552*g* is formed to jet out the air toward the lower surface of the suction/feed means 3. The separation nozzle 552*g* is formed elongating in the horizontal direction (direction of width of the first inclined portion 552*b*). The mounting portion 552*c* has a screw insertion hole 552*d*, and positioning protuberances 552*e*, 552*f* that protrude downward on both sides of the screw insertion hole 552. The distances between the screw insertion hole 552*d* and each positioning protuberances 552*e*, 552*f* correspond to the distances between the threaded hole 513*a* and each of the fitting hole 513*b* and the elongated fitting hole 513*c* formed in the base board 51. The end walls 553 and 554 close both ends of space surrounded by the upper part of the side wall 551, first inclined portion 552*a* and second inclined portion 552*b* of the upper wall 552. To mount the thus constituted third block 55 on the base board 51, the positioning protuberances 552*e* and 552*f* formed on the mounting portion 552*c* are respectively fitted into the fitting hole 513*b* and the elongated fitting holes 513*c* formed in the upper wall 513 of the base board 51 while inserting the engaging portion 551*b* formed at the lower end of the side wall 551 into the engaging groove 511*a* formed in the bottom wall 511 of the base board 51. In this state, the third block 55 is positioned, and the screw insertion hole 552*d* formed in the mounting portion 552*c* faces the threaded hole 513*a* formed in the upper wall 513 of the base board 51. Therefore, by putting a screw 555 into the threaded hole 513*a* through the screw insertion hole 552*d*, the third block 55 is mounted on the base board 51.

Figure 23:
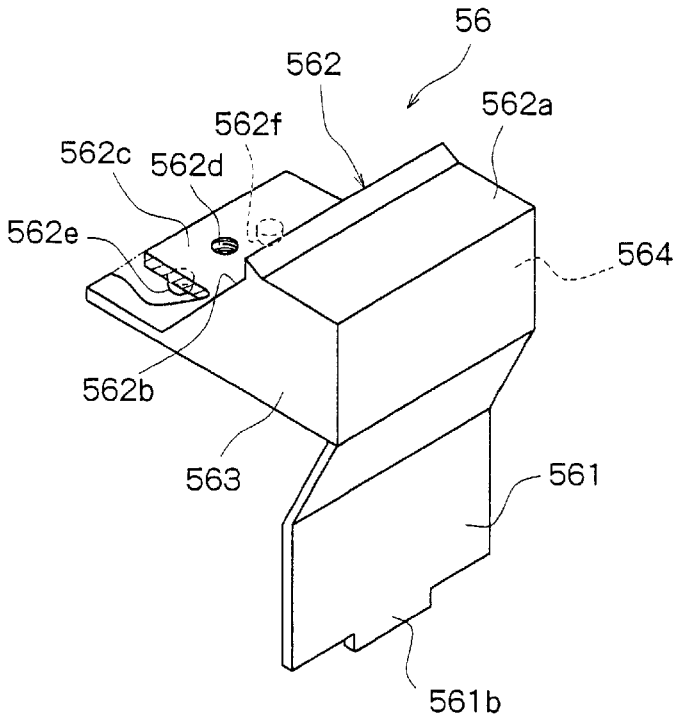
FIG. 23 is a perspective view illustrating a space block constituting the air duct of the air-blowing means shown in FIG. 15.
Figure 24:
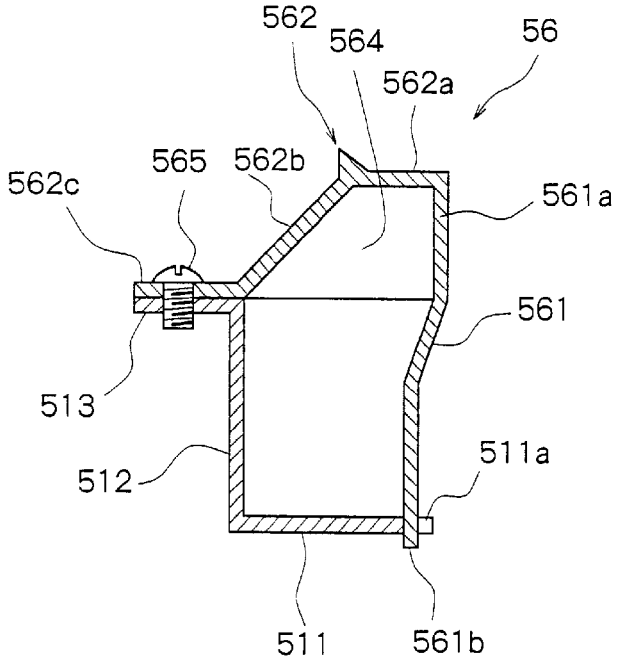
FIG. 24 is a sectional view illustrating a state where the space block shown in FIG. 23 is mounted on the base board.
Figure 25:
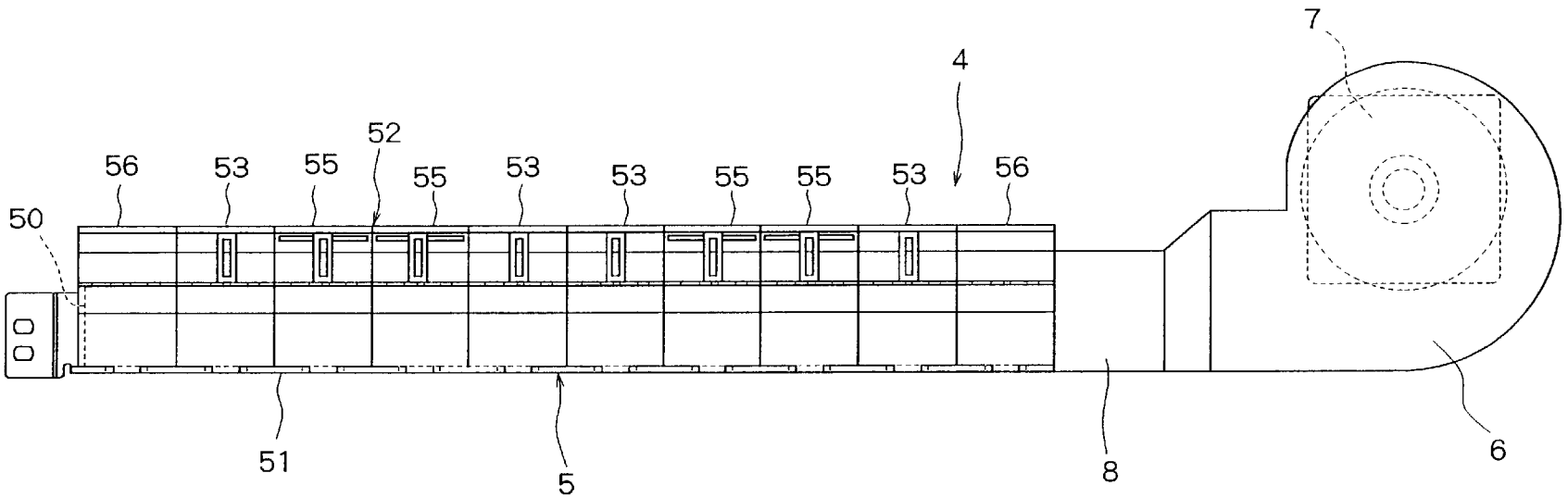
FIG. 25 is a front view illustrating an example of the air duct constituted by a combination of the first blocks, the third blacks and the space blocks.
Figure 26:
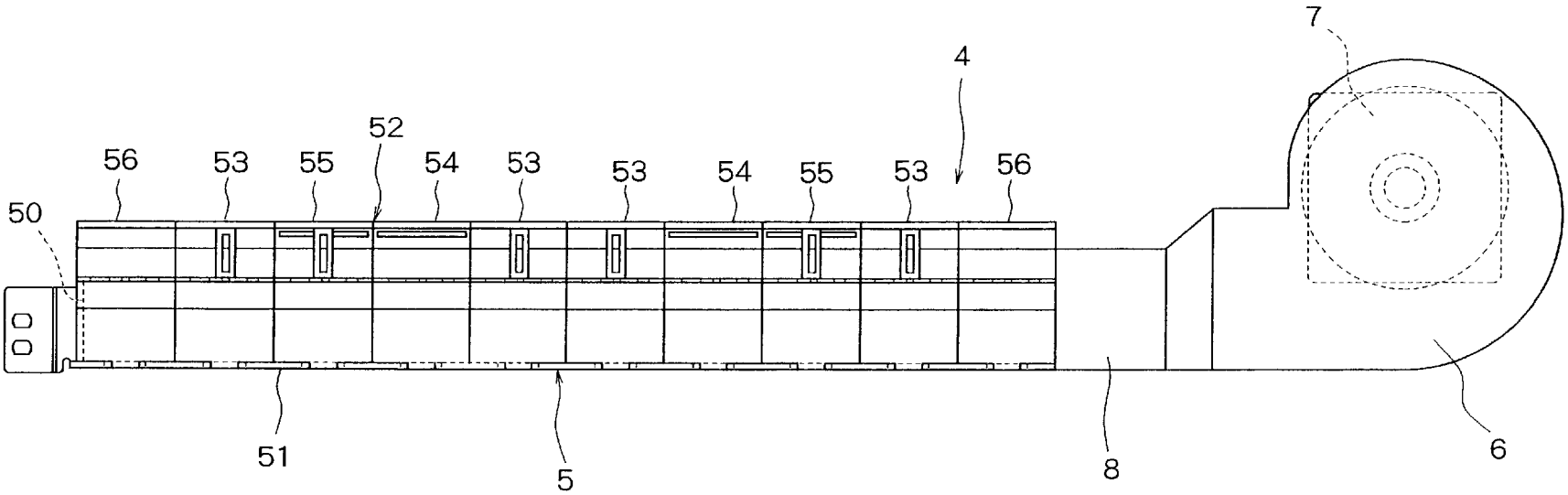
FIG. 26 is a front view illustrating an example of the air duct constituted by a combination of the first blocks, the second blocks, the third blocks and the space blocks.
Figure 27:
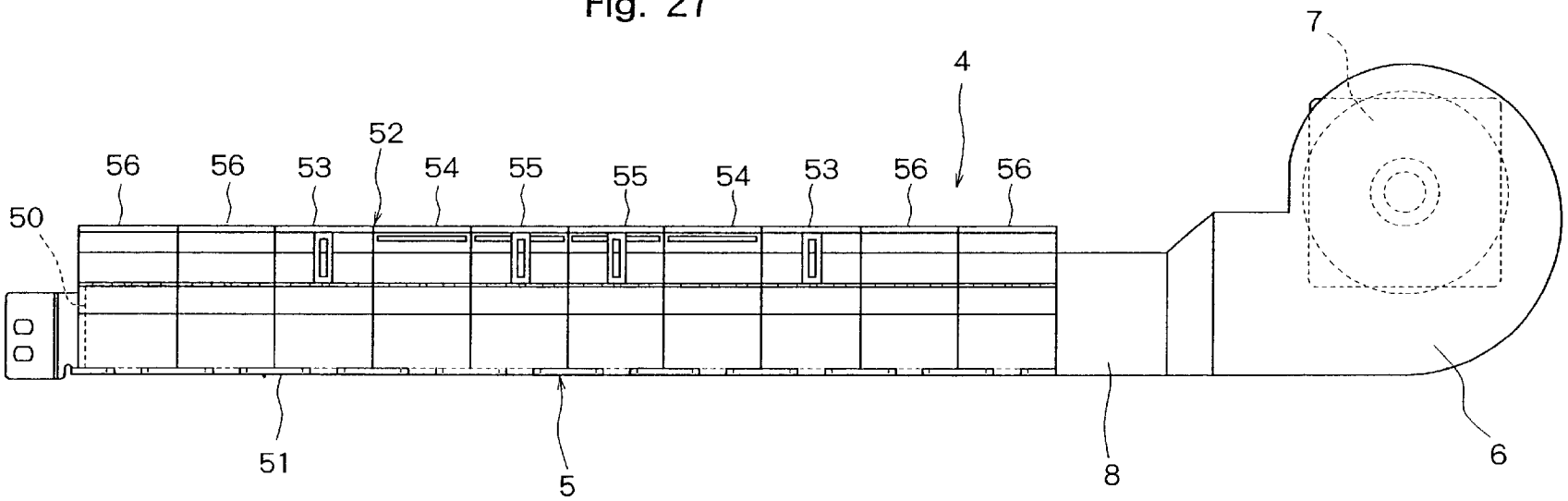
FIG. 27 is a front view illustrating another example of the air duct constituted by a combination of the first blocks, the second blocks, the third blocks and the space blocks.

Referring to FIGS. 23 and 24, the space block 56 includes a side wall 561, an upper wall 562 and end walls 563, 564 which are molded as a unitary structure using a suitable synthetic resin. The side wall 561 has an engaging portion 561*b* protruding downward from the lower end at the central portion thereof. The upper wall 562 includes a horizontal portion 562*a* connected to the side wall 561, an inclined portion 562*b* inclined downward from the end of the horizontal portion 562*a*, and a mounting portion 562*c* extending horizontally from the end of the inclined portion 562*b*. The mounting portion 562*c* has a screw insertion hole 562*d*, and positioning protuberances 562*e*, 562*f* that protrude downward on both sides of the screw insertion hole 562. The distances between the screw insertion hole 562*d* and each of positioning protuberances 562*e*, 562*f* correspond to the distances between the threaded hole 513*a* and each of the fitting hole 513*b* and the elongated fitting hole 513*c* formed in the base board 51. The end walls 563 and 564 close both ends of space surrounded by the upper part of the side wall 561, horizontal portion 562*a* and inclined portion 562*b* of the upper wall 562. The thus constituted space block 56 has neither the floatation nozzle 531*a* formed in the first block 53 nor the separation nozzle 542*g* formed in the second block 54. To mount the space block 56 on the base board 51, the positioning protuberances 562*e* and 562*f* formed on the mounting portion 562*c* are respectively fitted into the fitting hole 513*b* and into the elongated fitting holes 513*c* formed in the upper wall 513 of the base board 51 while inserting the engaging portion 561*b* formed at the lower end of the side wall 561 into the engaging groove 511*a* formed in the bottom wall 511 of the base board 51. In this state, the space block 56 is positioned, and the screw insertion hole 562*d* formed in the mounting portion 562*c* faces the threaded hole 513*a* formed in the upper wall 513 of the base board 51. Therefore, by putting a screw 565 into the threaded hole 513*a* through the screw insertion hole 562*d,* the space block 56 is mounted on the base board 51.

The above-mentioned first blocks 53, second blocks 54, third blocks 55 and space blocks 56 are mounted on the base board 51 in a suitable combination to constitute the air duct 5 that corresponds to the papers of a size and a quality to be used. The embodiment shown in FIG. 15 uses four first blocks 53, four second blocks 54 and two space blocks 56 in combination so as to be adapted to, for example, a common paper of the A4-size. An embodiment shown in FIG. 25 uses four first blocks 53, four third blocks 55 and two space blocks 56 so as to be adapted to, for example, a heavy paper of the A4-size. An embodiment shown in FIG. 26 uses four first blocks 53, two second blocks 54, two third blocks 55 and two space blocks 56 so as to be adapted to, for example, a relatively heavy paper of the A4-size. An embodiment shown in FIG. 27 uses two first blocks 53, two second blocks 54, two third blocks 55 and four space blocks 56 so as to be adapted to, for example, a relatively heavy paper of the B5-size.

Thus, the air duct 5 of the air-blowing means 4 can be easily and optimally constituted so as to be adapted to size and quality of the papers that are to be used by combining the base board 51 and two to four kinds of blocks. Accordingly, a proper air duct corresponding to the size and quality of the papers to be used can be provided without necessity of providing plural kinds of air ducts, for which the number or arrangement of the floatation nozzles and separation nozzles is changed. This contributes toward greatly decreasing the cost.

As shown in FIG. 15, an end of the thus constituted air duct 5 is connected to a connection duct 8, and a fan 6 is connected to the connection duct 8. The other end of the air duct 5 is provided with a closing plate 50.

The paper feeder of the embodiments shown in FIGS. 14 to 27 are constituted as described above. Described below is the operation.

Plural pieces of papers P are set on the paper-stacking plate 22 of the paper-stacking means 2 and are brought to a predetermined position of the frame 21. Upon detecting this state, the plate elevation mechanism is actuated to elevate the paper-stacking plate 21. When the height of the papers P stacked on the paper-stacking plate 22 reaches the position P1, the photo sensor 235 produces a signal ON as described earlier, and the operation of the plate elevation mechanism is halted in a state shown in FIG. 14.

Figure 14:
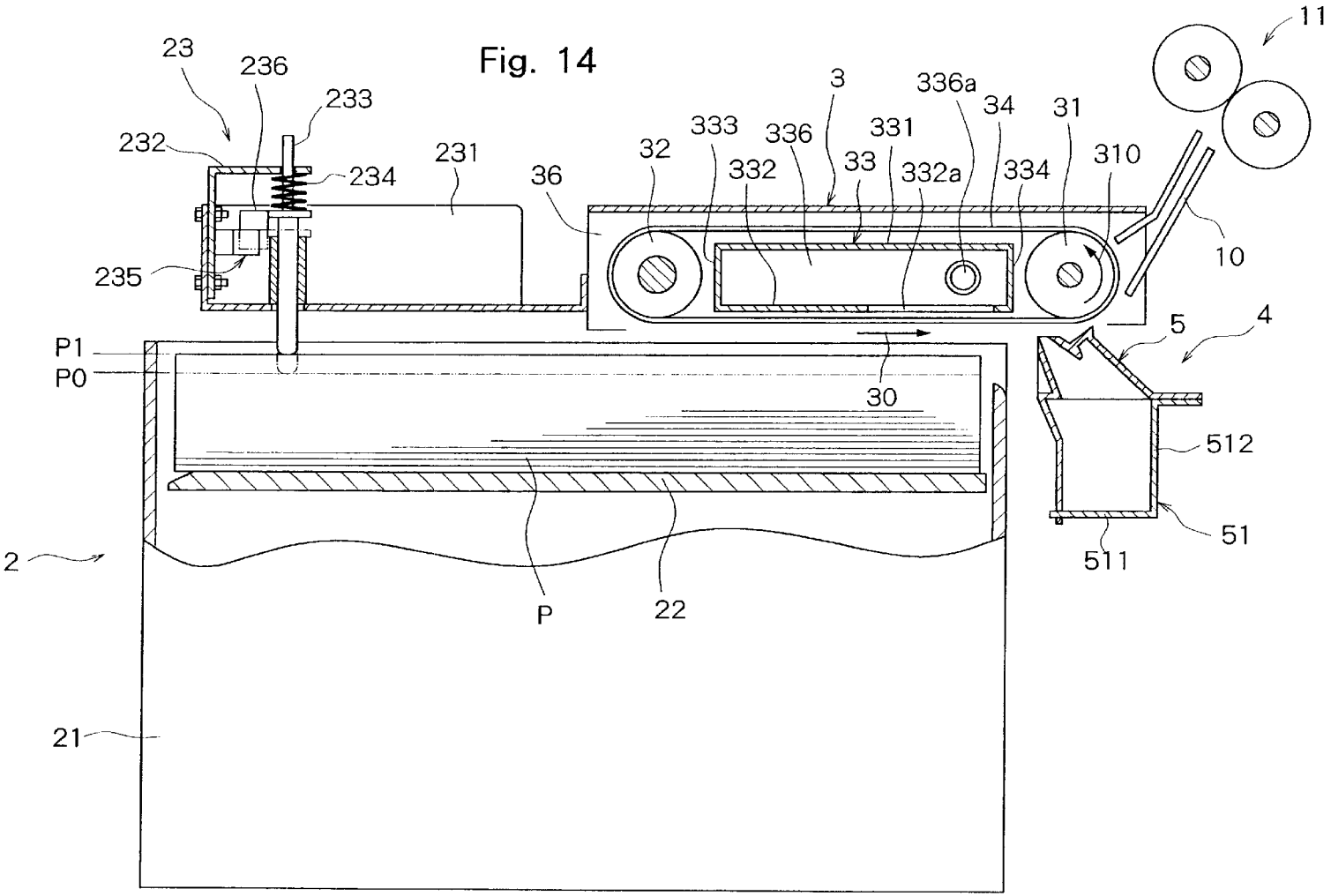
FIG. 14 is a sectional view schematically illustrating the constitution of a paper feeder according to a fifth embodiment of the present invention.

When a paper-feed signal is produced in a state shown in FIG. 14, the control means actuates the electric motor 7 of the air-blowing means 4 and the electric motor 37 of the suction/feed means 3. When the electric motor 7 of the air-blowing means 4 is actuated, the fan 6 is actuated to send the air to the air duct 5, whereby the air is jetted from the floatation nozzles 531*a* (551*a*) and the separation nozzles 542*g* (552*g*). The air jetted from the floatation nozzles 531*a* (551*a*) is blown against an upper portion of the papers P stacked on the paper-stacking plate 22, and the upper several pieces of papers are caused to float. When the electric motor 37 is driven, on the other hand, the suction fan 38 of the suction/feed means 3 is actuated to suck the air through the suction duct 33, suction ports 332*a* and holes 34*a* formed in the conveyer belts 34. As a result, the lower side of the conveyer belt 34 is decompressed, and the uppermost paper that floats is adsorbed by the lower surfaces of the conveyer belts 34. When the second paper is adhered to the uppermost paper, the air jetted from the separation nozzles 542*g* (552*g*) enters between the uppermost paper and the second paper to separate them apart. Here, the drive roller 31 of the suction/feed means 3 is rotatingly driven in a direction indicated by an arrow 310 and the conveyer belts 34 are actuated to move in a direction indicated by an arrow 30. Accordingly, the uppermost paper adsorbed by the conveyer belts 34 is fed in a direction in which the paper is to be conveyed indicated by the arrow 30. Thus, the paper fed by the suction/feed means 3 is conveyed to the image-forming unit through the pair of conveyer rollers 11.

According to the embodiments shown in FIGS. 14 to 27, as described above, the air duct of the air-blowing means can be easily and optimally constituted to be suited for size and quality of the papers to be used by combining the base board, the first blocks having floatation nozzles, second blocks having separation nozzles or third blocks having floatation nozzles and separation nozzles. Accordingly, a proper air duct corresponding to the size and quality of the papers to be used can be provided without necessity of providing plural kinds of air ducts, for which the number and arrangement of the floatation nozzles and the separation nozzles are changed. This contributes toward greatly decreasing the cost.

Next, a sixth embodiment of the paper feeder constituted according to the present invention will be described with reference to FIGS. 28 to 33. In the embodiment shown in FIGS. 28 to 33, the same members as those of the embodiment of FIGS. 1 to 6 are denoted by the same reference numerals but their description is not repeated.

In the embodiment shown in FIGS. 28 to 33, the air duct 5 constituting the air-blowing means 4 is different from that of the embodiment shown in FIGS. 1 to 6. In other respects, however, the constitution of this embodiment is substantially the same as the embodiment shown in FIGS. 1 to 6. First, described below is the air duct 5 of the air-blowing means 4 according to the embodiment shown in FIGS. 29 to 30. In the embodiment shown in FIGS. 29 and 30, the air duct 5 is molded in a rectangular parallelopiped shape using a suitable synthetic resin, and includes side walls 501, 502, an upper wall 503, a bottom wall 504, and an inclined wall 508 connecting the side wall 501 to the upper wall 503. The one side wall 501 forming the air duct 5 is provided with plural floatation nozzles 505 for jetting out the air against the upper portion of the papers P stacked on the paper-stacking plate 22 of the paper-stacking means 22. The plural floatation nozzles 505 are formed, being elongated up and down, at a predetermined distance in the lengthwise direction of the side wall 501. The upper inclined wall 508 forming the air duct 5 has plural separation nozzles 506 formed therein to jet the air toward the lower surface of the suction/feed means 3. The separation nozzles 506 are formed being elongated in the lengthwise direction of the side wall 501.

Figure 30:
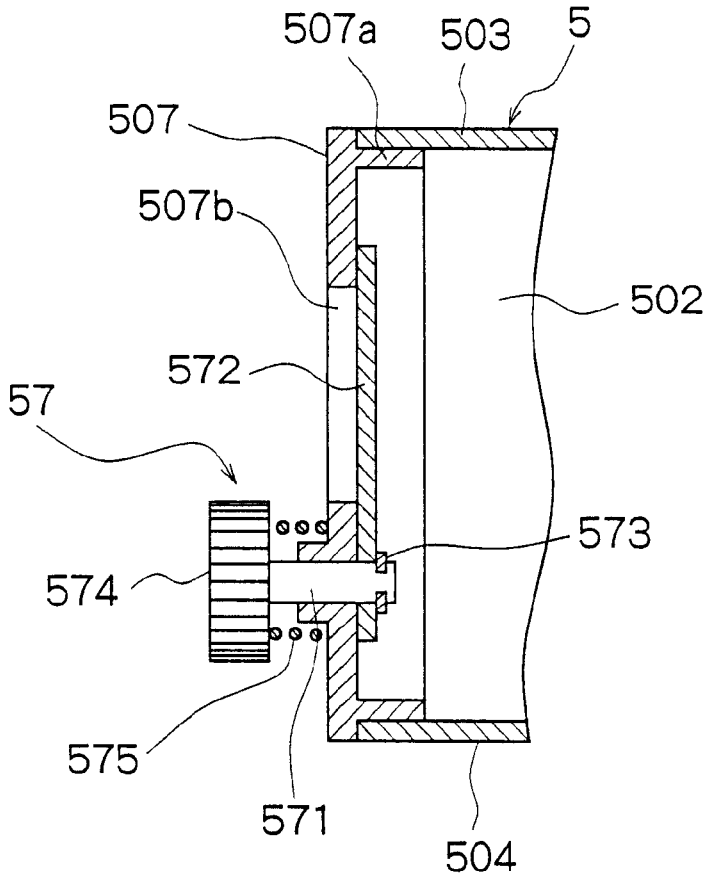
FIG. 30 is a sectional view illustrating major portions of an air duct of the air-blowing means shown in FIG. 29.

The air duct 5 in the illustrated embodiment has an end wall 507 for closing the other end thereof. Referring to FIG. 30, the end wall 507 has a fitting protrusion 507*a* with an outer peripheral surface that corresponds to the inner peripheral surfaces of the side walls 501, 502, upper wall 503, bottom wall 504 and inclined wall 508. The fitting protrusion 507*a* is fitted to the other end of the air duct 5, and is attached thereto by securing means such as adhesive. The end wall 507 is provided with an air-escape hole 507*b* formed in the shape of a fan. In the illustrated embodiment, it is equipped with an escape hole-shutter mechanism 57 for changing the opening area of the air-escape hole 507*b*. The escape hole-shutter mechanism 57 includes a shutter shaft 571 rotatably supported by the end wall 507, of which the one end protrudes inward and the other end protrudes outward, a shutter plate 572 mounted to an end of the shutter shaft 571 and arranged along the inner surface of the end wall 507, a snap ring 573 attached to an end of the shutter shaft 571 to prevent the shutter plate 572 from escaping, an operation knob 574 attached to the other end of the shutter shaft 571 to turn the shutter shaft 571, and a coil spring 575 disposed between the operation knob 574 and the outer surface of the end wall 507 to urge the operation knob 574 toward the left in FIG. 30 at all times. In the illustrated embodiment, the shutter plate 572 is formed in the shape of a fan larger than the air-escape hole 507*b*, and is turned by the operation knob 574 about the shutter shaft 571 to change the opening area of the air-escape hole 507*b*. The shutter plate 572 is brought into contact with the inner surface of the end wall 507 with a predetermined pushing force produced by the coil spring 575, and is maintained at any rotational position by the frictional force. When the opening area of the air-escape hole 507*b* is decreased by the thus constituted escape hole-shutter mechanism 57, the amount of the air discharged from the air-escape hole 507*b* decreases, and the velocity of the air jetted out from the floatation nozzles 505 and separation nozzles 506 increases, i.e., the intensity of the wind acting on the papers increases. When the opening area of the air-escape hole 507*b* is increased, on the other hand, the amount of the air discharged from the air-escape hole 507*b* increases, and the velocity of the air jetted out from the floatation nozzles 505 and separation nozzles 506 decreases, i.e., the intensity of the wind acting on the papers decreases.

Figure 28:
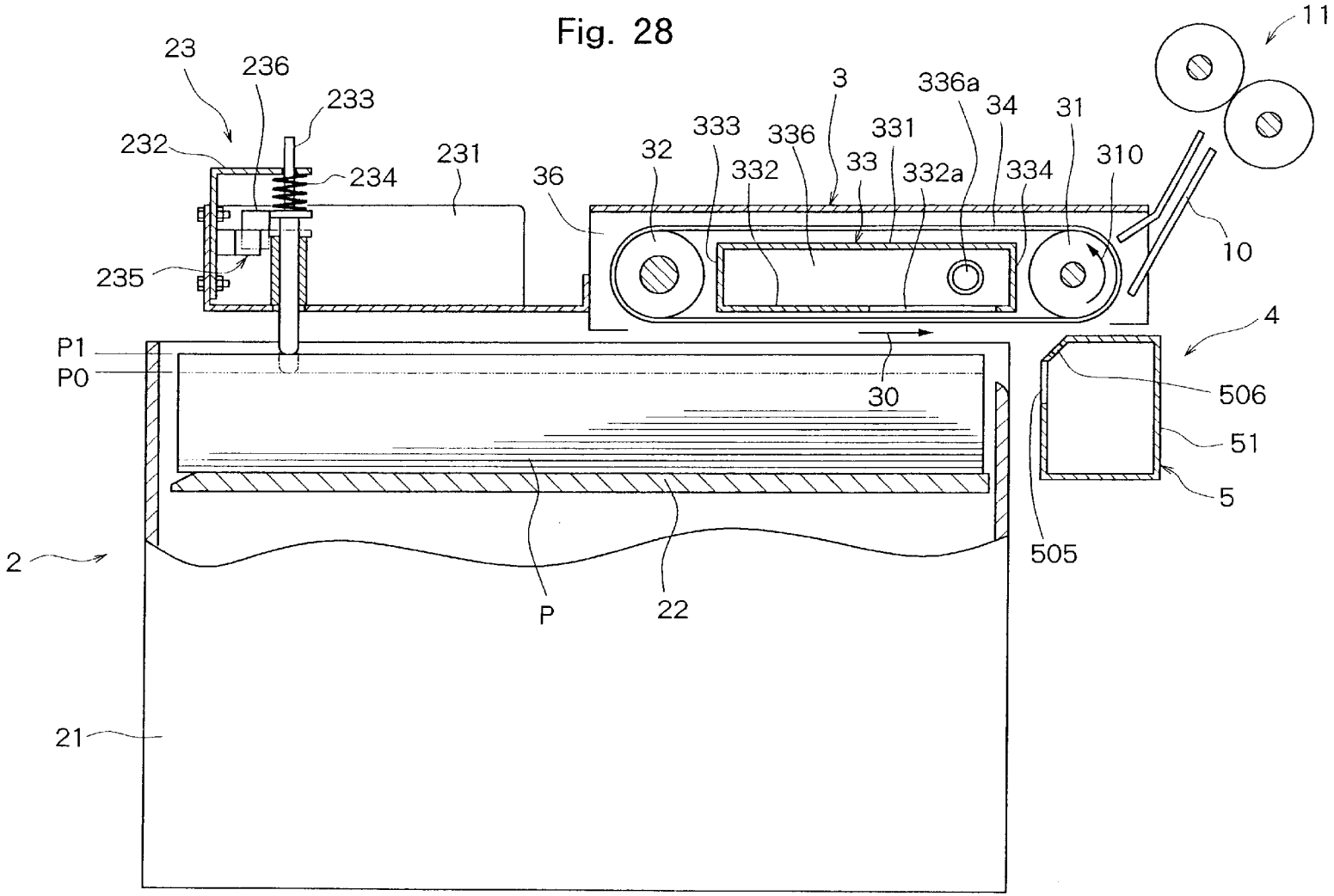
FIG. 28 is a sectional view schematically illustrating the constitution of the paper feeder according to a sixth embodiment of the present invention.
Figure 29:
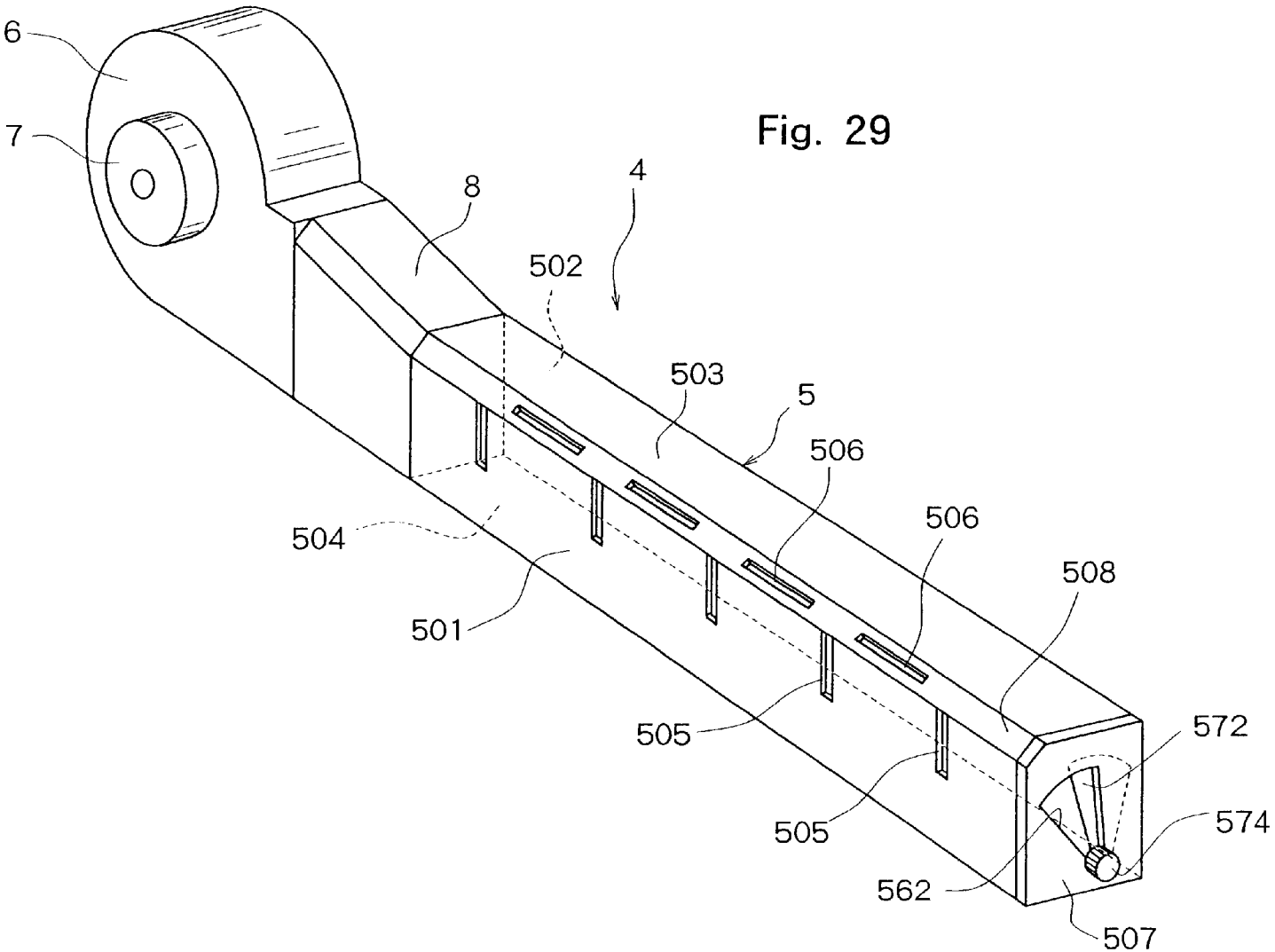
FIG. 29 is a perspective view of an air-blowing means constituting the paper feeder shown in FIG. 28 according to the embodiment.

The paper feeder of the embodiment shown in FIGS. 28 to 30 is constituted as described above. Described below is the operation.

Plural pieces of papers P are set on the paper-stacking plate 22 of the paper-stacking means 2 and are brought to a predetermined position of the frame 21. Upon detecting this state, the plate elevation mechanism is actuated to elevate the paper-stacking plate 21. When the height of the papers P stacked on the paper-stacking plate 22 reaches the position P1, the photo sensor 235 produces a signal ON as described earlier, and the operation of the plate elevation mechanism is halted in a state shown in FIG. 28.

When a paper-feed signal is produced in a state shown in FIG. 28, the control means actuates to drive the electric motor 7 of the air-blowing means 4 and the electric motor 37 of the suction/feed means 3. When the electric motor 7 of the air-blowing means 4 is driven, the fan 6 is actuated to send the air into the air duct 5, whereby the air is jetted out from the floatation nozzles 505 and the separation nozzles 506. The air jetted from the floatation nozzles 505 is blown against an upper portion of the papers P stacked on the paper-stacking plate 22, and the upper several pieces of papers are caused to float. At this moment, the velocity of the air jetted through the floatation nozzles 505 and the separation nozzles 506 can be adjusted by turning the operation knob 574 of the escape hole-shutter mechanism 57 to operate the shutter plate 572 thereby to change the opening area of the air-escape hole 507*b*. That is, when heavy and thick papers are to be used, the opening area of the air-escape hole 507*b* is decreased to increase the velocity of the air jetted from the floatation nozzles 505 and separation nozzles 506. It is thus allowed to float the papers by the air jetted out from the floatation nozzles 505 as required and to reliably separate the second and subsequent papers from the uppermost paper by the air jetted out from the separation nozzles 506. When light and thin papers are to be used, on the other hand, the opening area of the air-escape hole 507*b* is increased to decrease the velocity of the air jetted from the floatation nozzles 505 and the separation nozzles 506, in order to prevent the papers from being excessively floated, i.e., to prevent many pieces of papers from being floated.

When the electric motor 37 is actuated, further, the suction fan 38 of the suction/feed means 3 is driven to suck the air through the suction duct 33, suction ports 332*a* and holes 34*a* formed in the conveyer belts 34. As a result, the lower side of the conveyer belt 34 is decompressed, and the uppermost paper that floats is adsorbed by the lower surfaces of the conveyer belts 34. When the second paper is adhered to the uppermost paper, the air jetted from the separation nozzles 506 enters into between the uppermost paper and the second paper to separate them apart. Here, the drive roller 31 of the suction/feed means 3 is rotatingly driven in a direction indicated by an arrow 310 and the conveyer belts 34 are actuated to move in a direction indicated by an arrow 30. Accordingly, the uppermost paper adsorbed by the conveyer belts 34 is fed in a direction in which the paper is to be conveyed as indicated by the arrow 30. Thus, the paper fed by the suction/feed means 3 is conveyed to the image-forming unit through the pair of conveyer rollers 11.

Next, a further embodiment of the air-blowing means 4 will be described with reference to FIGS. 31 to 33. In the embodiment shown in FIGS. 31 to 33, the same members as those of the embodiment of FIGS. 29 and 30 are denoted by the same reference numerals but their description is not repeated.

Figure 31:
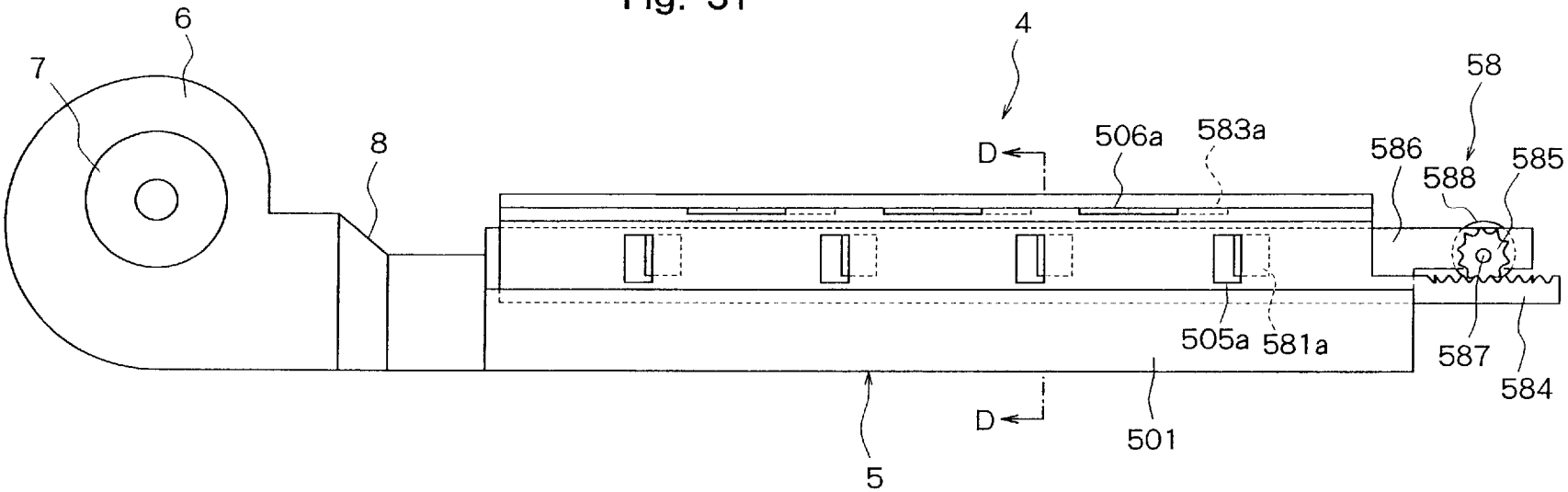
FIG. 31 is a front view illustrating an air-blowing means constituted according to a further embodiment of the invention, and illustrates the first operation condition.
Figure 32:
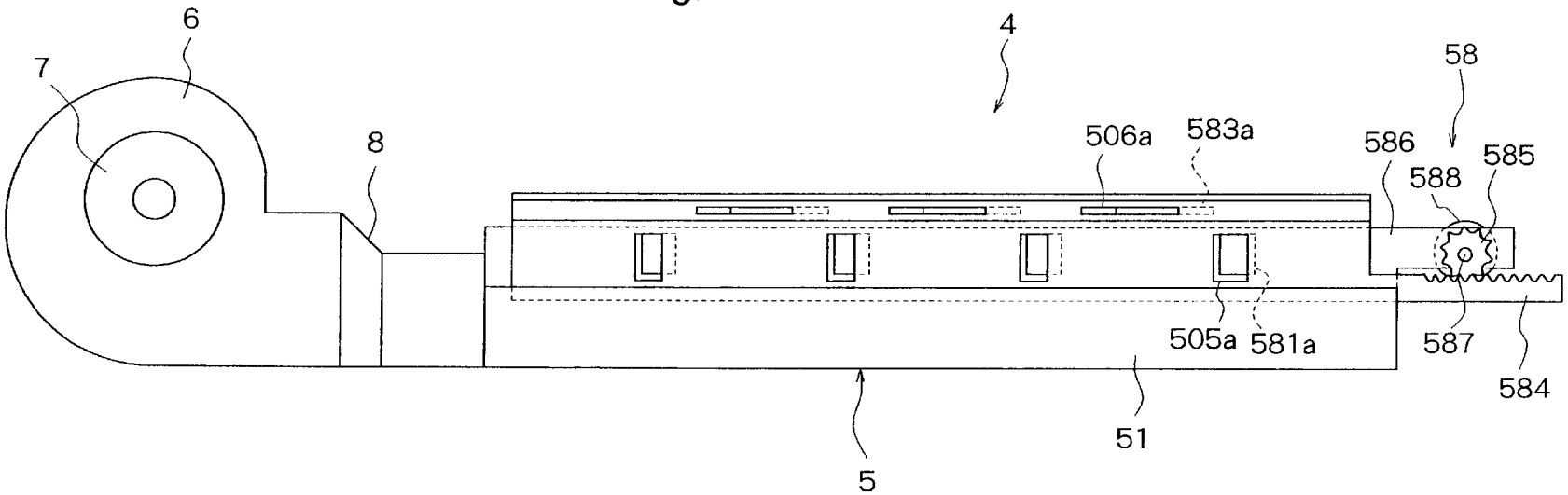
FIG. 32 is a front view illustrating the second operation condition of the air-blowing means shown in FIG. 31.
Figure 33:
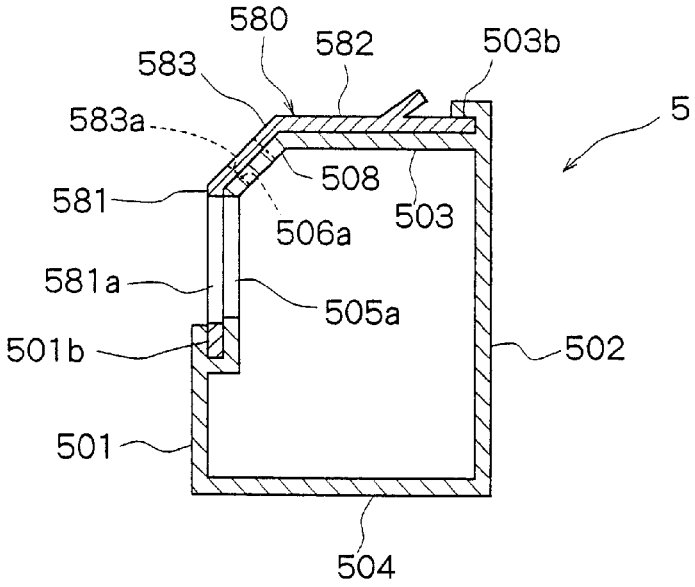
FIG. 33 is a sectional view along the line D—D of the air-blowing means shown in FIG. 31.

In the embodiment shown in FIGS. 31 to 33, the plural floatation nozzles 505*a* formed in a side wall 501 of the air duct 5 have a size larger in the direction of width than the floatation nozzles 505 of the embodiment shown in FIGS. 29 and 30. Further, plural separation nozzles 506*a* formed in the inclined wall 508 forming the air duct 5 have a size larger in the lengthwise direction that the separation nozzles 506 of the embodiment shown in FIGS. 29 and 30. The embodiment shown in FIGS. 31 to 33, however, has no air-escape hole in the end wall 507 that close other end of the air duct 5.

The embodiment shown in FIGS. 31 to 33 is equipped with a nozzle shutter mechanism 58 for changing the opening areas of the floatation nozzles 505*a* and of the separation nozzles 506*a*. The nozzle shutter mechanism 58 includes a side wall 501 forming the air duct 5, a vertical wall 581 formed along the outer peripheral surfaces of an upper wall 503 and of an inclined wall 508, and a nearly L-shaped shutter plate 580 having a side wall 582 and an inclined wall 583. The shutter plate 580 is molded by using a suitable synthetic resin, and has plural first openings 581*a* formed in the vertical wall 581, the plural first openings 581*a* having a size larger than the floatation nozzle 505*a* in the direction of width, and further has plural second openings 583*a* formed in the inclined wall 583, the plural second openings 583*a* having a size larger than the separation nozzles 506*a* in the lengthwise direction. Further, a rack 584 is attached to an end of the shutter plate 580, the rack 584 being formed together with the shutter plate 580 as a unitary structure. Referring to FIG. 33, the thus constituted shutter plate 580 is fitted at the lower end of the vertical wall 581 to a guide groove 501*b* formed in one side wall 501 constituting the air duct 5 and fitted at the right end of the side wall 582 to a guide groove 503*b* formed in the upper wall 503 constituting the air duct 5. The shutter plate 580 is thus mounted to freely slide in the lengthwise direction of the air duct 5.

A pinion gear 585 is in mesh with the rack 584 attached to the shutter plate 580 that is mounted on the air duct 5 to freely slide. The pinion gear 585 is attached to an end of a rotary shaft 587 rotatably supported by a bracket 586 mounted on the air duct 5. An operation knob 588 is attached to the other end of the rotary shaft 587. When the pinion gear 585 is turned by moving the operation knob 588, the shutter plate 580 mounting the rack 584 in mesh with the pinion gear 585 moves in the lengthwise direction of the air duct 5. When the shutter plate 580 is brought to the position of FIG. 31, the floatation nozzles 505*a*, separation nozzles 506*a*, first openings 581*a* and second openings 583*a* are overlapped in small amounts; i.e., the floatation nozzles 505*a* and separation nozzles 506*a* have small opening areas. When the shutter plate 850 is brought to the position of FIG. 32, on the other hand, the floatation nozzles 505*a*, separation nozzles 506*a*, first openings 581*a* and second openings 583*a* are overlapped in large amounts; i.e., the floatation nozzles 505*a* and separation nozzles 506*a* have large opening areas. When the floatation nozzles 505*a* and separation nozzles 506*a* have small opening areas, the air is jetted at an increased speed through the floatation nozzles 505*a* and the separation nozzles 506*a*. When the floatation nozzles 505*a* and separation nozzles 506*a* have large opening areas, the air is jetted at a decreased speed through the floatation nozzles 505*a* and the separation nozzles 506*a*. Therefore, when heavy and thick papers are to be used, the opening areas of the floatation nozzles 505*a* and of the separation nozzles 506*a* are decreased, while when light and thin papers are to be used, the opening areas of the floatation nozzles 505*a* and of the separation nozzles 506*a* are increased. Thus, the floatation and separation of the papers can be properly optimized.

In the illustrated embodiment, the shutter plate 572 and the shutter plate 580 are operated by hand. They, however, may be constructed to be actuated by step motors which are automatically actuated depending on the quality of the papers to be used.

According to the embodiment shown in FIGS. 28 to 33 as described above, the air duct constituting the air-blowing means of the paper feeder includes plural floatation nozzles for jetting out the air toward the front upper end portion of the papers stacked on the paper-stacking means, air-escape hole, and escape hole-shutter mechanism for changing the opening area of the air-escape hole. By changing the opening area of the air-escape hole, therefore, it is allowed to adjust the velocity of the air jetted from the floatation nozzles. Accordingly, when heavy and thick papers are to be used, the opening area of the air-escape hole is decreased to increase the velocity of the air jetted from the floatation nozzles to float the papers as desired. When light and thin papers are to be used, on the other hand, the opening area of the air-escape hole is increased to decrease the velocity of the air jetted from the floatation nozzles, so that the papers will not be excessively floated, i.e., so that floating of many pieces of papers can be prevented.

According to the embodiment shown in FIGS. 28 to 33, further, the air duct constituting the air-blowing means of the paper feeder includes plural floatation nozzles for jetting out the air toward the front upper end portion of the papers stacked on the paper-stacking means and the nozzle shutter mechanism for changing the opening areas of the plural floatation nozzles. Accordingly, by changing the opening areas of the floatation nozzles, it is allowed to adjust the velocity of the air jetted from the floatation nozzles. When heavy and thick papers are to be used, therefore, the opening areas of the floatation nozzles are decreased to increase the velocity of the air jetted from the floatation nozzles. When light and thin papers are to be used, on the other hand, the opening areas of the floatation nozzles are increased to decrease the velocity of the air jetted from the floatation nozzles, so that the papers are properly floated.

Next, a seventh embodiment of the paper feeder constituted according to the present invention will be described with reference to FIGS. 34 to 42. In the embodiment shown in FIGS. 34 to 42, the same members as those of the embodiment of FIGS. 1 to 6 are denoted by the same reference numerals but their description is not repeated.

In the embodiment shown in FIGS. 34 to 42, the suction/feed means 3 is equipped with a paper adsorption detecting sensor 39 (SW4) as a detection means for detecting whether the paper is adsorbed by the conveyer belts 34. In the illustrated embodiment, the paper adsorption detecting sensor 39 (SW4) is a microswitch and mounted to the lower wall 332 of the suction duct 33. The paper adsorption detecting sensor 39 (SW4) sends, to a control means that will be described later, a signal OFF when no paper is adsorbed by the conveyer belts 34 of the suction/feed means 3 and a signal ON when a paper is adsorbed by the conveyer belts 34. The paper adsorption detecting sensor 39 (SW4) works as a component constituting the air-blowing means that will be described later.

Figure 36:
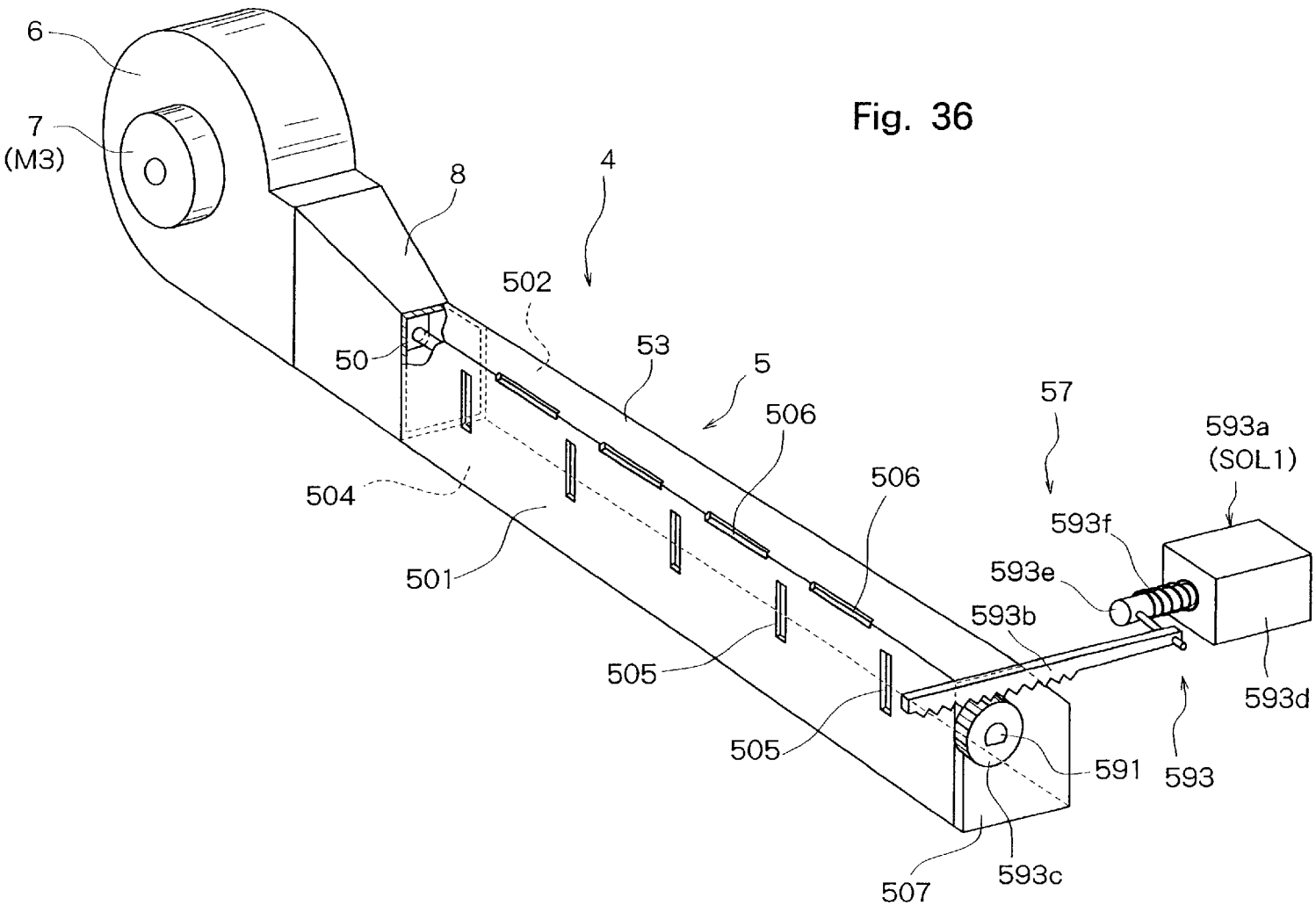
FIG. 36 is a perspective view illustrating an embodiment of an air-blowing means constituting the paper feeder shown in FIG. 34 in a partly cut-away manner.

The air-blowing means 4 is disposed under the front end portion of the thus constituted suction/feed means 3 in the direction in which the paper is conveyed as indicated by the arrow 30. In the embodiment as shown in FIG. 36, the air-blowing means 4 includes an air duct 5 extending in a direction (in a direction perpendicular to the surface of the paper in FIG. 34) at right angles with the direction in which the paper is conveyed, a fan 6 connected to an end of the air duct 5 through a connection duct 8, and an electric motor 7 (M3) for rotating the fan 6.

Figure 37:
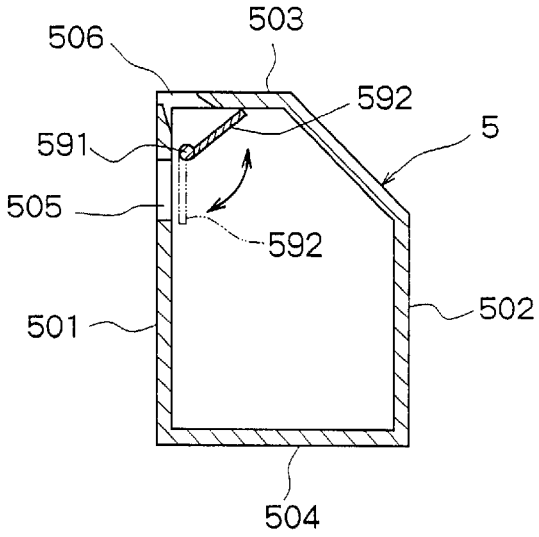
FIG. 37 is a sectional view illustrating a major portion of an air duct of the air-blowing means shown in FIG. 36.

The air duct 5 will now be described with reference to FIGS. 36 and 37. The air duct 5 in the illustrated embodiment is molded in a rectangular parallelopiped shape using a suitable synthetic resin, and includes side walls 501, 502, an upper wall 503 and a bottom wall 504. The one side wall 501 forming the air duct 5 is provided with plural floatation nozzles 505 for jetting the air against an upper portion of the papers P stacked on the paper-stacking plate 22 of paper-stacking means 2. The plural floatation nozzles 505 are formed being elongated up and down and at a predetermined distance in the lengthwise direction of the side wall 501. Further, plural separation nozzles 506 are formed in a portion where the above side wall 501 forming the air duct 5 is connected to the upper wall 503 to jet the air toward the lower surface of the suction/feed means 3. The separation nozzles 506 are formed being elongated in the lengthwise direction of the side wall 501. An end wall 507 separately formed is attached to the other end of the air duct 5.

The air-blowing means 4 in the illustrated embodiment includes an air blow change-over mechanism 59 for suitably changing over the air jetted from the floatation nozzles 505 or the separation nozzles 506. The air blow change-over mechanism 59 includes a rotary shaft 591, a shutter plate 592 attached to the rotary shaft 591, and a drive mechanism 593 for suitably turning the rotary shaft 591. The rotary shaft 591 is disposed on the upper side of the floatation nozzles 505 along the inside of the side wall 501 of the air duct 5, and is supported at its one end by a boss portion 50 formed at an end of the air duct 5 and at the other end by the end wall 507 so as to rotate. The shutter plate 592 attached to the rotary shaft 591 is brought to the first position indicated by a solid line in FIG. 37 and to the second position indicated by a two-dot chain line in FIG. 37 as the rotary shaft 591 turns in one direction or in the other direction. When the shutter plate 592 is brought to the first position, the separation nozzles 506 are closed and the floatation nozzles 505 are opened, so that the air blown by the fan 6 is jetted from the floatation nozzles 505 only. When the shutter plate 592 is brought to the second position, on the other hand, the floatation nozzles 505 are closed and the separation nozzles 506 are opened, so that the air blown by the blower ran 6 is jetted from the separation nozzles 506 only.

The drive mechanism 503 which selectively turns the rotary shaft 591 includes an electromagnetic solenoid 593*a* (SOL1), a rack 593*b* moved by the electromagnetic solenoid 593*a* (SOL1), and a pinion gear 593*c* attached to the other end of the rotary shaft 591 and is in mesh with the rack 593*b*. The electromagnetic solenoid 593*a* (SOL1) includes a solenoid body 593*d*, a plunger 593*e* disposed in the solenoid body 593*d*, and a coil spring 593*f* which always urges the plunger 593*e* in a direction to protrude from the solenoid body 593*d*. The plunger 593*e* is coupled to the rack 593*b*. When the thus constituted electromagnetic solenoid 593*a* (SOL1) has not been energized, the plunger 593*e* is pushed out from the solenoid body 593*d* by the resilient force of the coil spring 593*f* to push the rack 593*b*, in order to turn the rotary shaft 591 in one direction via the pinion gear 593*c* thereby to bring the shutter plate 592 to the first position indicated by a solid line in FIG. 37. When the electromagnetic solenoid 593*a* (SOL1) is energized, the plunger 593*e* is attracted by the solenoid body 593*d* against the resilient force of the coil spring 593*f* and pulls the rack 593*b* to rotate the rotary shaft 591 in the other direction via the pinion gear 593*c* thereby to bring the shutter plate 592 to the second position indicated by a two-dot chain line in FIG. 37.

Figure 38:
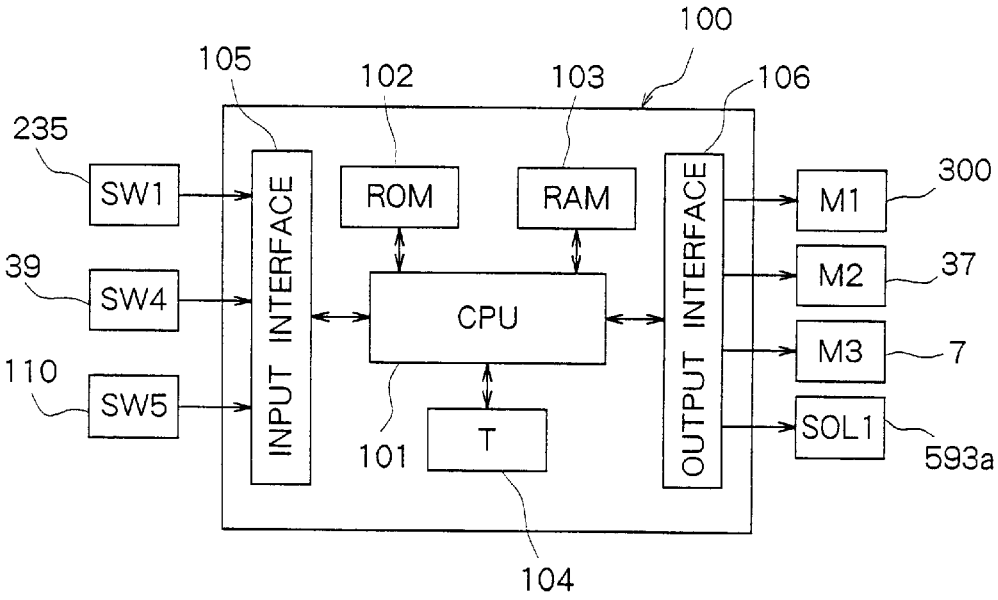
FIG. 38 is a block diagram of a control means constituting the air-blowing means shown in FIG. 36.
Figure 39:
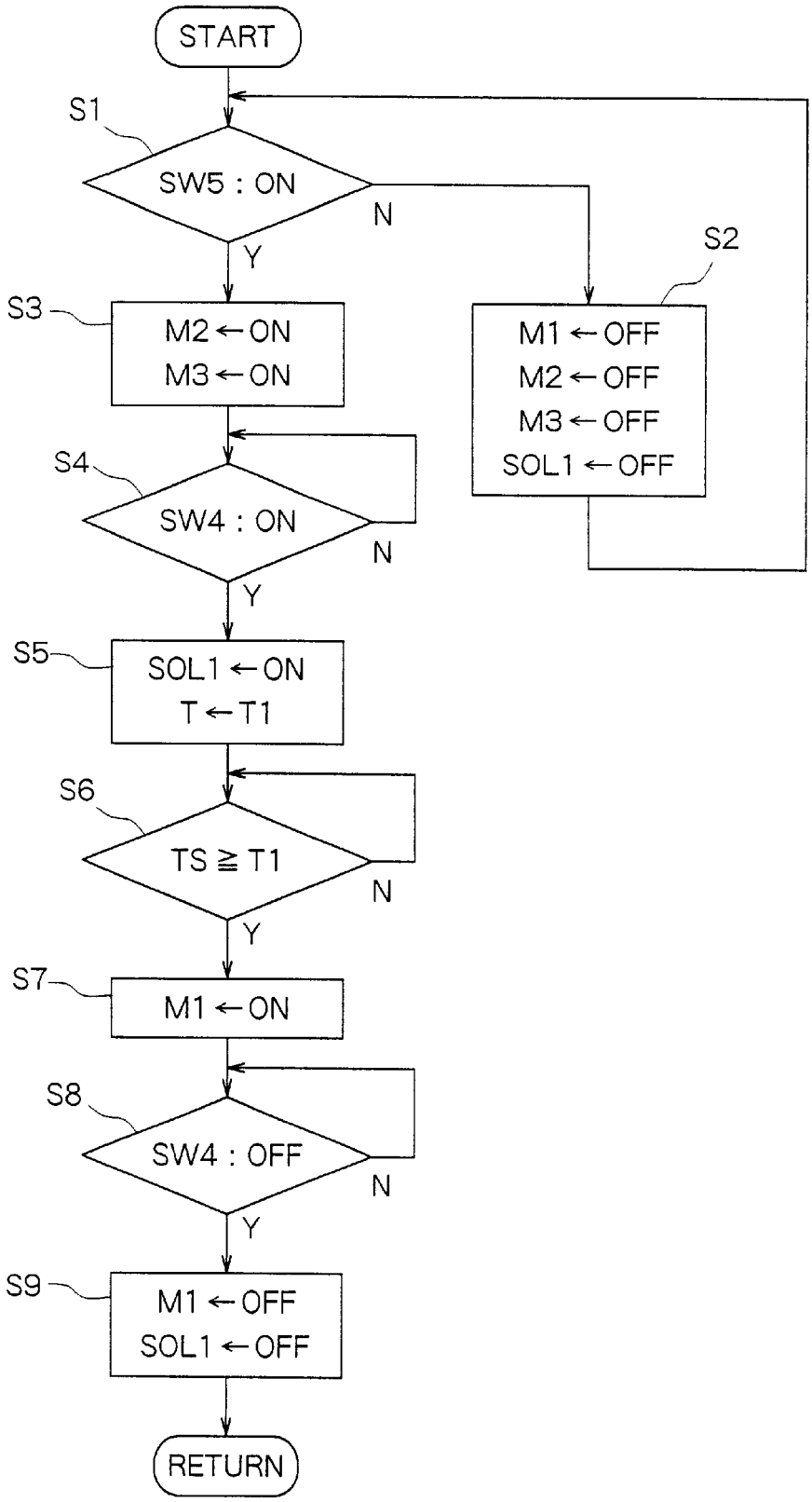
FIG. 39 is a flowchart illustrating the operation of the control means shown in FIG. 38.

The paper feeder in the illustrated embodiment is equipped with a control means 100 shown in FIG. 38. The control means 100 is constituted by a microcomputer and includes a central processing unit (CPU) 101 for executing the arithmetic operation according to a control program, a read-only memory (ROM) 102 for storing the control program, a random access memory (RAM) 103 capable of reading and writing data and storing the operated results, a timer 104 (T), an input interface 105 and an output interface 106. The input interface 106 of the thus constituted control means 100 receives detection signals from the photo sensor 235 (SW1), the paper adsorption detecting sensor 39 (SW4) and a copy start switch 110 (SW5). Further, the control means 100 sends control signals through its output interface 106 to the electric motor 300 (M1), electric motor 37 (M2), electric motor 7 (M3) and electromagnetic solenoid 593*a* (SOL1).

The paper feeder of the illustrated embodiment is constituted as described above. Described below is its operation.

Plural pieces of papers P are set on the paper-stacking plate 22 of the paper-stacking means 2 and are brought to a predetermined position of the frame 21. Then, in response to a detection signal, the control means 100 actuates the plate elevation mechanism that is not shown to elevate the paper-stacking plate 21. When the height of the papers P stacked on the paper-stacking plate 22 reaches the position P1, the photo sensor 235 (SW1) produces a signal ON as described earlier. In response to this signal, the control means 100 ceases to actuate the plate elevation mechanism in a state shown in FIG. 34.

Figure 34:
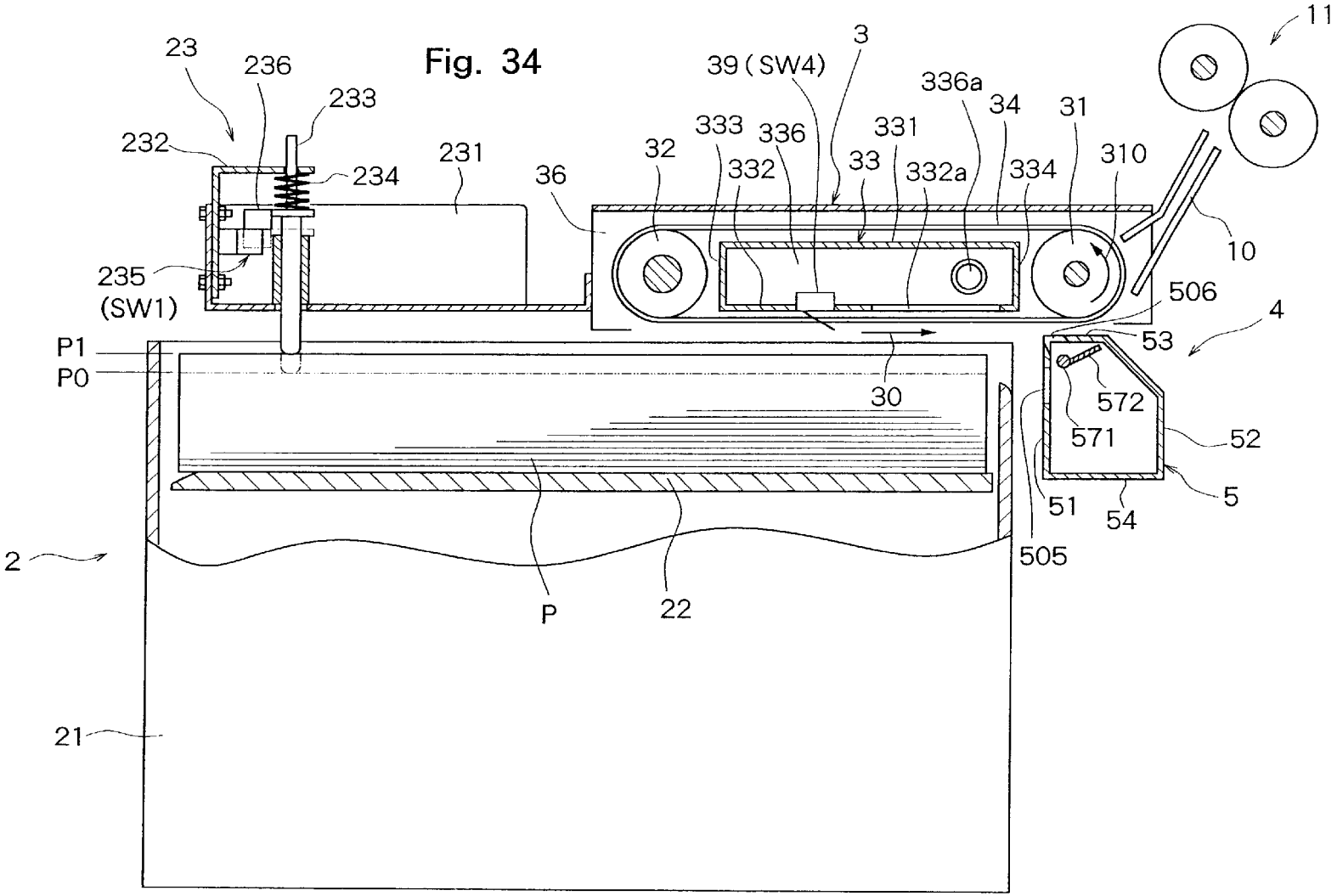
FIG. 34 is a sectional view schematically illustrating the constitution of the paper feeder according to a seventh embodiment of the present invention.
Figure 35:
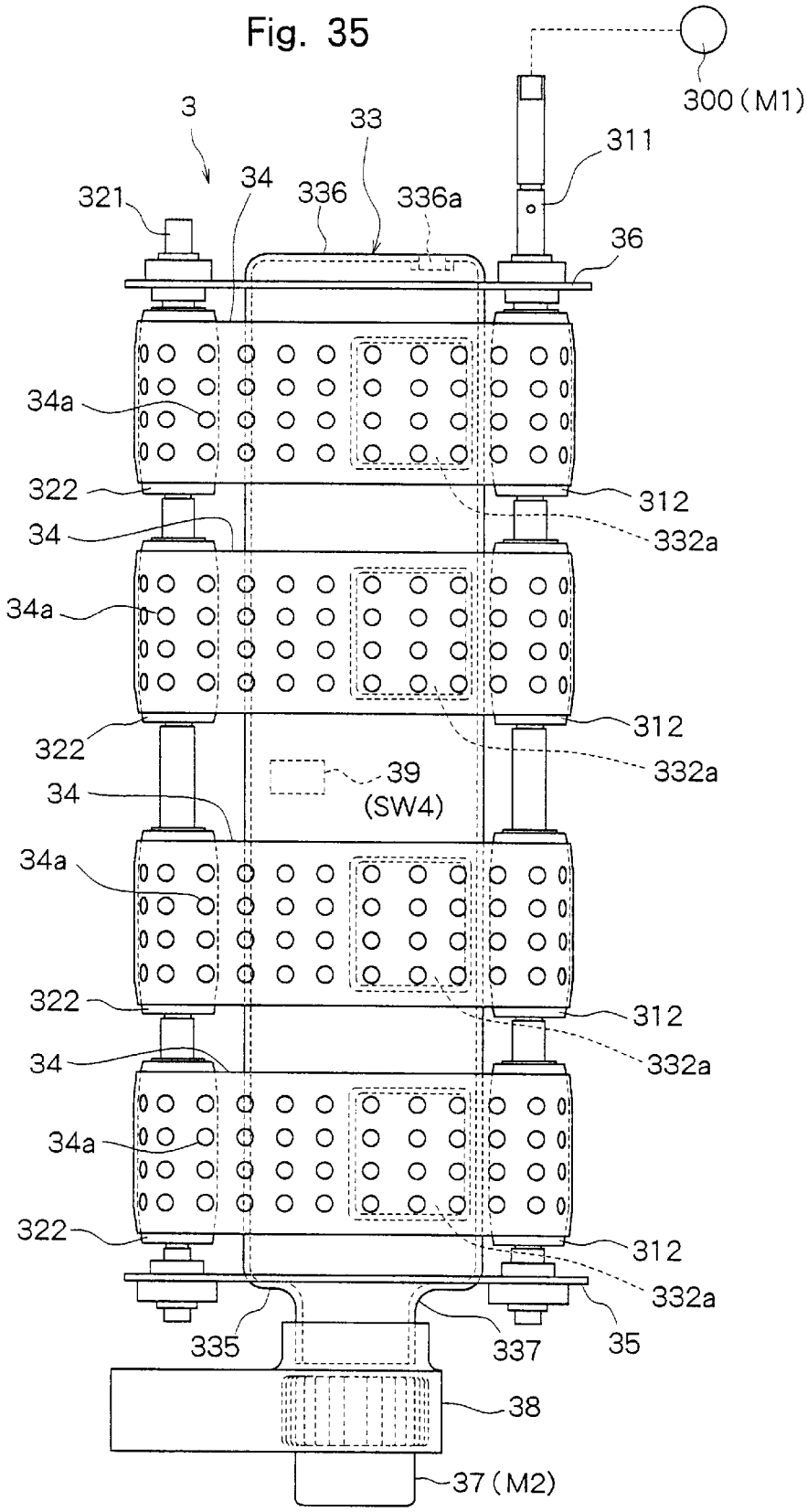
FIG. 35 is a plan view of a suction/feed means constituting the paper feeder shown in FIG. 34.

When the copy start switch 110 (SW5) is closed and a paper-feed signal is generated in a state shown in FIG. 34, the paper-feed operation is executed. The operation of the paper feeder will now be described with also reference to a flow chart shown in FIG. 39.

The control means 100 checks at step S1 whether the copy start switch 110 (SW5) is turned on. When the copy start switch 110 (SW5) has not been turned on, the program in the control means 100 proceeds to step S2 to discontinue the drive of the electric motor 300 (M1), electric motor 37 (M2) and electric motor 7 (M3) and to de-energize the electromagnetic solenoid 580 (SOL1), and then, returns back to step S1.

When the copy start switch 110 (SW5) is turned on at step S1, the program in the control means 100 proceeds to step S3 to drive the electric motor 37 (M2) of the suction/feed means 3 and the electric motor 7 (M3) of the air-blowing means 4. When the electric motor 7 (M3) of the air-blowing means 4 is driven, the fan 6 is actuated to send the air to the air duct 5. At this time, since the electromagnetic solenoid 593*a* (SOL1) has not been energized, the shutter plate 592 of the air blow change-over mechanism 59 has been brought to the first position indicated by the solid line in FIG. 37, and the separation nozzles 506 are closed and the floatation nozzles 505 are opened. Accordingly, the air sent by the fan 6 to the air duct 5 is jetted from the floatation nozzles 505 only and is blown to the upper portion of the papers P stacked on the paper-stacking plate 22. As a result, upper several pieces of papers P stacked on the paper-stacking plate 22 are caused to float. On the other hand, when the electric motor 37 (M2) of the suction/feed means 3 is driven, the suction fan 38 of the suction/feed means 3 is operated to suck the air through the suction duct 33, suction ports 332*a* and holes 34*a* formed in the conveyer belts 34. As a result, the lower side of the conveyer belts 34 is decompressed, and the uppermost paper that floats is adsorbed by the lower surfaces of the conveyer belts 34.

When the electric motor 37 (M2) of the suction/feed means 3 and the electric motor 7 (M3) of the air-blowing means 4 are driven at step S3, the program in the control means 100 proceeds to step S3 where it is checked whether the paper adsorption detecting sensor 39 (SW4) is turned on, i.e., whether the paper is adsorbed by the lower surfaces of the conveyer belts 34. When the paper adsorption detecting sensor 39 (SW4) is not turned on, no paper has been adsorbed by the lower surfaces of the conveyer belts 34, and it is in a standby state. When the paper adsorption detecting sensor 39 (SW4) is turned on, the control means 100 so judges that the paper is adsorbed by the lower surfaces of the conveyer belts 34. The program then proceeds to step S5 where the electromagnetic solenoid 593*a* (SOL1) of the air blow change-over mechanism 57 is energized and the timer 104 (T) is set to a predetermined set time (T1). When the electromagnetic solenoid 593*a* (SOL1) is energized, the shutter plate 592 is brought to the second position indicated by the two-dot chain line in FIG. 37 where the floatation nozzles 505 are closed and the separation nozzles 506 are opened. Accordingly, the air sent by the fan 6 to the air duct 5 is jetted out from the separation nozzles 506 only. The thus jetted air enters into between the uppermost paper adsorbed by the lower surfaces of the conveyer belts 34 and the second paper to separate the second and subsequent papers from the uppermost paper.

When the electromagnetic solenoid 593*a* (SOL1) is energized and the timer 104 (T) is set to a predetermined set time (T1) at step S5, the program in the control means 100 proceeds to step S6 where it is checked whether the passage of time (TS) has reached the set time (T1) or not. The set time (T1) has been set to be, for example, 5 to 10 seconds. When the passage of time (TS) has not reached the set time (T1) at step S6, it is in a standby state. When the passage of time (TS) has reached the set time (T1), the program in the control means 100 proceeds to step S7 to drive the electric motor 300 (M1) that rotates the rotary shaft 311 of the suction/feed means 3. As a result, the drive roller 31 of the suction/feed means 3 is rotated in the direction indicated by the arrow 310 and the conveyer belts 34 move in the direction indicated by the arrow 30; i.e., the uppermost paper adsorbed by the conveyer belts 34 is fed in the direction indicated by the arrow 30. Thus, the paper fed by the suction/feed means 3 is conveyed to the image-forming unit through the pair of conveyer rollers 11.

When the electric motor 300 (M1) is driven at step S7, the program of the control means 100 proceeds to step S8 where it is checked whether the paper adsorption detecting sensor 39 (SW4) is turned off. When the paper adsorption detecting sensor 39 (SW4) is not turned off, the uppermost paper adsorbed by the conveyer belts 34 has not been delivered, and it is in a standby state. When the paper adsorption detecting sensor 39 (SW4) is turned off, it is so judged that the uppermost paper is delivered, and the program in the control means 100 proceeds to step S9 to discontinue the drive of the electric motor 300 (M1) and to de-energize the electromagnetic solenoid 593*a* (SOL1) thereby to bring the shutter plate 592 of the air blow change-over mechanism 59 to the first position indicated by the solid line in FIG. 37. The program in the control means 100 then returns back to step S1.

As described above, the illustrated embodiment is equipped with the air blow change-over mechanism 59 for selectively changing over the air jetted from the floatation nozzles 505 or the separation nozzles 506. The separation nozzles 506 are closed and the air is jetted from the floatation nozzles 505 only until the paper is adsorbed by the conveyer belts 34. After the paper is adsorbed by the conveyer belts 34, the floatation nozzle 505 is closed and the air is jetted from the separation nozzles 506 only. Despite the air is sent in decreased amounts by the fan 6, therefore, the air is jetted in sufficient amounts from the flowing nozzles 505 and the separation nozzles 506, i.e., the air is jetted in air amounts sufficient for floating and separating the papers. Thus, the fan 6 of a small capacity can be employed making it possible to manufacture the whole apparatus at a decreased cost and to constitute the whole apparatus in a compact size.

Next, another embodiment of the air-blowing means will be described with reference to FIGS. 40 to 42. In the embodiment shown in FIGS. 40 to 42, the same members as those of the embodiment of FIGS. 36 and 37 are denoted by the same reference numerals but their description is not repeated.

Figure 40:
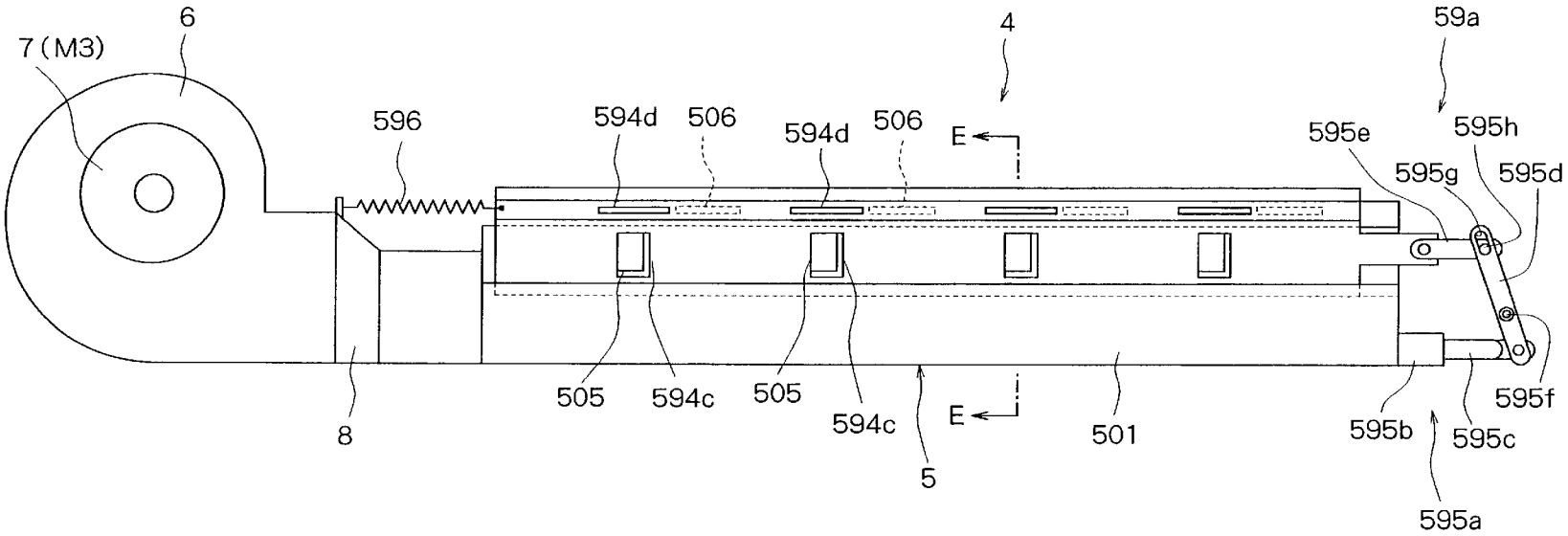
FIG. 40 is a front view illustrating an air-flowing means constituted according to a further embodiment of the invention, and illustrates the first operation condition.
Figure 41:
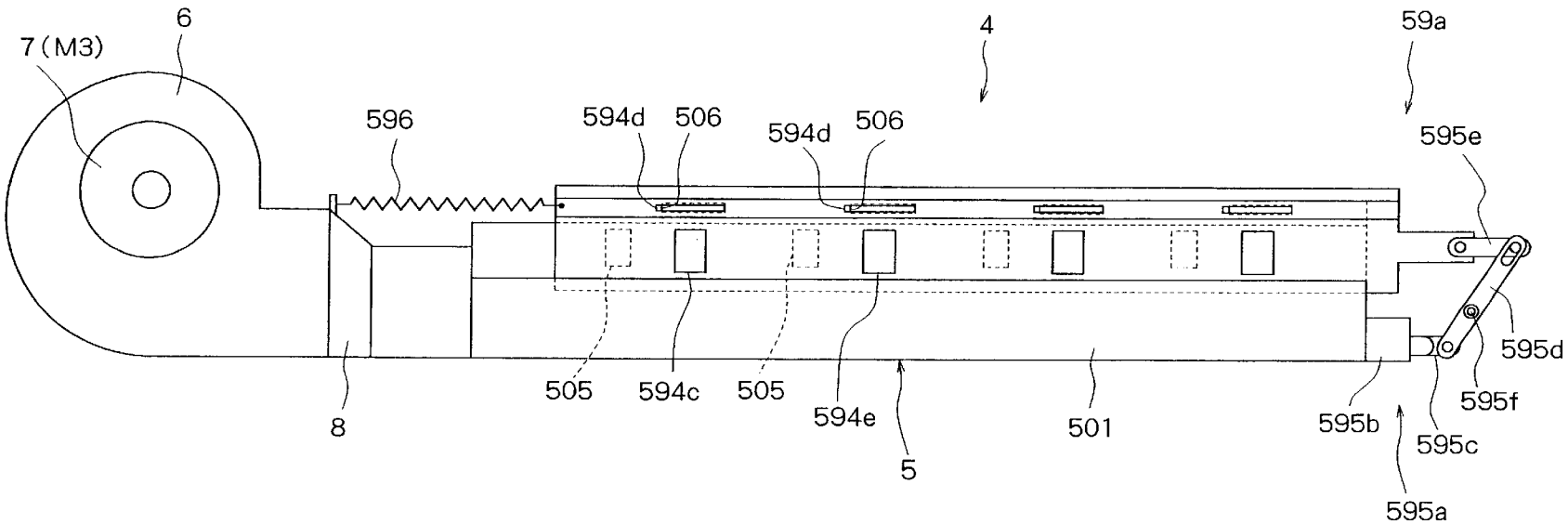
FIG. 41 is a front view illustrating the second operation condition of the air-blowing means shown in FIG. 40.
Figure 42:
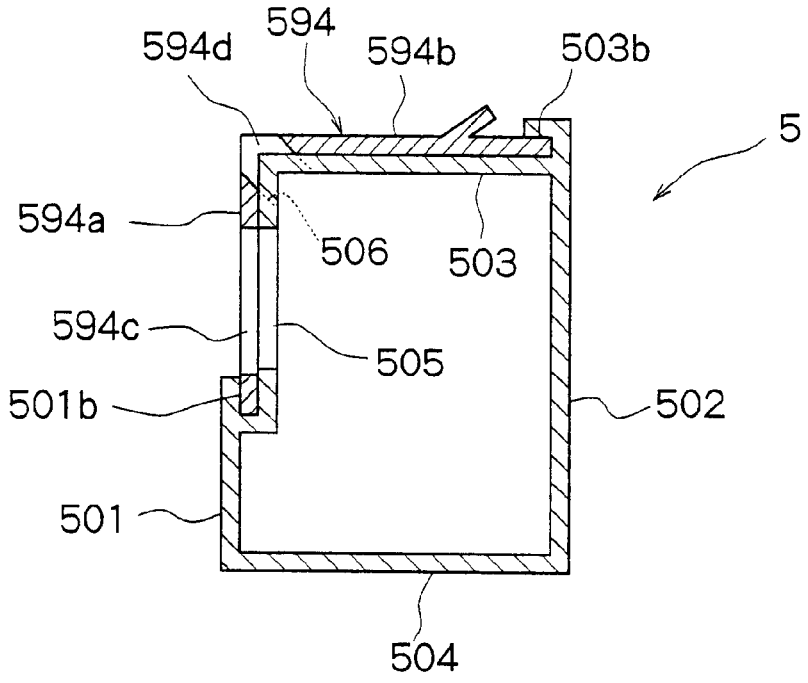
FIG. 42 is a sectional view along the line E—E of the air-blowing means shown in FIG. 40.

In the embodiment shown in FIGS. 40 to 42, the shutter plates 594 is constituted to slide in the air blow change-over mechanism 59 to selectively change over the air that is jetted from the floatation nozzles 505 or the separation nozzles 506 formed in the air duct 5. The shutter plate 594 is formed nearly in an L-shape having a side wall 501 forming the air duct 5, a vertical wall 594*a* and a horizontal wall 594*b* formed along the outer peripheral surface of the upper wall 503. The shutter plate 594 is formed of a suitable synthetic resin, and has plural first openings 549*c* formed in the vertical wall 594*a* to correspond to the floatation nozzles 505, and plural second openings 594*d* formed in the connection portion between the vertical wall 594*a* and the horizontal wall 594*b* to correspond to the separation nozzles 506. Referring to FIG. 42, the thus constituted shutter plate 594 is fitted at the lower end of the vertical wall 594*a* to the guide groove 501*b* formed in the side wall 501 forming the air duct 5, and is fitted at the right end portion of the horizontal wall 594*b* to the guide groove 503*b* formed in the upper wall 503 forming the air duct 5, and is allowed to slide in the lengthwise direction of the air duct 5.

The shutter plate 594 thus mounted on the air duct 5 to freely slide is operated by the drive mechanism 59*a*. The drive mechanism 59*a* includes an electromagnetic solenoid 595*a*, an operation lever 595*d* coupled at its one end to a plunger 595*c* disposed in a solenoid body 595*b* that constitutes the electromagnetic solenoid 595*a*, and a link 595*e* coupled at its one end to the other end of the operation lever 595*d* and is coupled at its other end to the other end of the shutter plate 594. The operation lever 595*d* is rotatably supported at its intermediate portion by a support shaft 595*f*. An elongated hole 595*g* is formed in the other end portion of the operation lever 595*d*. A pin 585*h* attached to the link 585*e* is fitted into the elongated hole 595*g*. In the illustrated embodiment, a coil spring 596 is stretched between an end of the shutter plate 594 and an engaging piece attached to the connection duct 8 so as to urge the shutter 594 toward the left in FIGS. 40 and 41 at all times.

When the electromagnetic solenoid 595*a* has not been energized, the thus constituted drive mechanism 59*a* brings the shutter plate 594 to the first position shown in FIG. 40 by resilient force of the coil spring 596. When the shutter plate 594 is brought to the first position, the separation nozzles 506 formed in the air duct 5 are closed by the shutter plate 594, and the floatation nozzles 505 overlap the first openings 594*c* formed in the shutter plate 594 and are opened. When the shutter plate 594 is brought to the first position shown in FIG. 40, therefore, the air sent to the air duct 5 is jetted from the floatation nozzles 505 only. When the electromagnetic solenoid 595*a* of the drive mechanism 59*a* is energized, the plunger 595*c* is pulled leftward as shown in FIG. 41, whereby the operation lever 595*d* turns clockwise on the support shaft 595*f* to move the shutter plate 594 toward the right via the link 595*e* until it is brought to the second position shown in FIG. 41. When the shutter plate 594 is brought to the second position, the floatation nozzles 505 formed in the air duct 5 are closed by the shutter plate 594, whereby the separation nozzles 506 overlap the second openings 594*d* formed in the shutter plate 594 and are opened. When the shutter plate 594 is brought to the second position shown in FIG. 41, therefore, the air sent to the air duct 5 is jetted from the separation nozzles 506 only. The electromagnetic solenoid 595*a* of the drive mechanism 59*a* is controlled by the control means 100 like the embodiment shown in FIGS. 36 and 37.

In the illustrated embodiment, the electromagnetic solenoid is used as a drive source of the drive mechanism for actuating the shutter plate 592 and the shutter plate 594. However, it is also allowable to use an electric motor.

As described above, the embodiment shown in FIGS. 34 to 42 is equipped with the air-blowing means having an air duct that is provided with plural floatation nozzles for jetting out the air against the front upper portion of the papers stacked on the paper-stacking means and plural separation nozzles for jetting out the air toward the lower surface of the suction/feed means, and the air blow change-over mechanism for selectively changing over the air jetted from the floatation nozzles or from the separation nozzles. To float the papers, the separation nozzles are closed and the air is jetted out from the floatation nozzles only. To separate the papers, the floatation nozzles are closed and the air is jetted from the separation nozzles only. Despite the air is sent in decreased amounts by the fan, therefore, the air is jetted out from the floatation nozzles and the separation nozzles in air amounts sufficient for floating and separating the papers. Thus, the fan of a small capacity can be employed making it possible to manufacture the whole apparatus at a decreased cost and to constitute the whole apparatus in a compact size.

Next, an eighth embodiment of the paper feeder constituted according to the invention will be described with reference to FIGS. 43 to 46. In the embodiment shown in FIGS. 43 to 46, the same members as those of the embodiment of FIGS. 14 to 27 are denoted by the same reference numerals but their description is not repeated.

Figure 43:
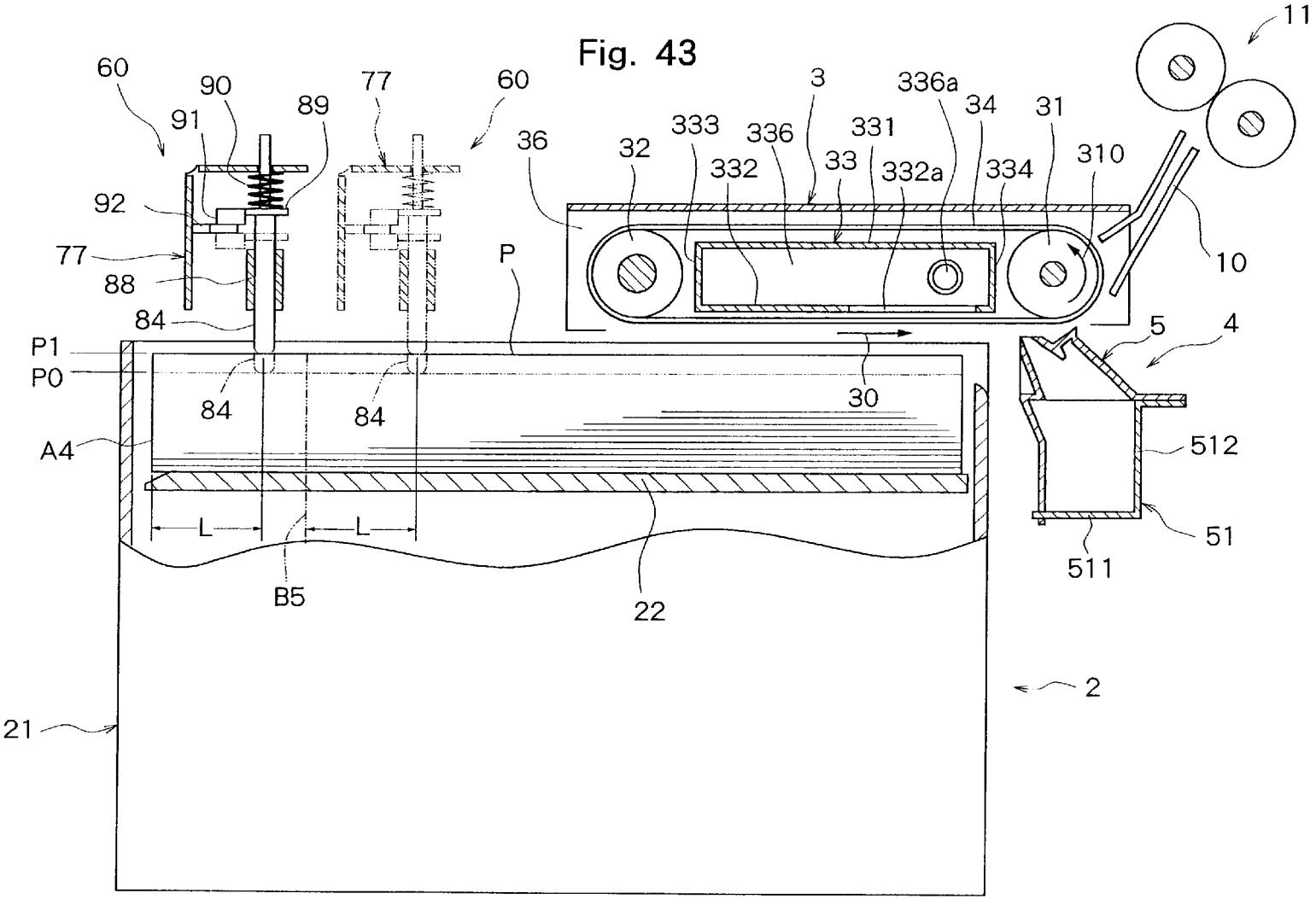
FIG. 43 is a sectional view schematically illustrating the constitution of the paper feeder according to an eighth embodiment of the present invention.
Figure 44:
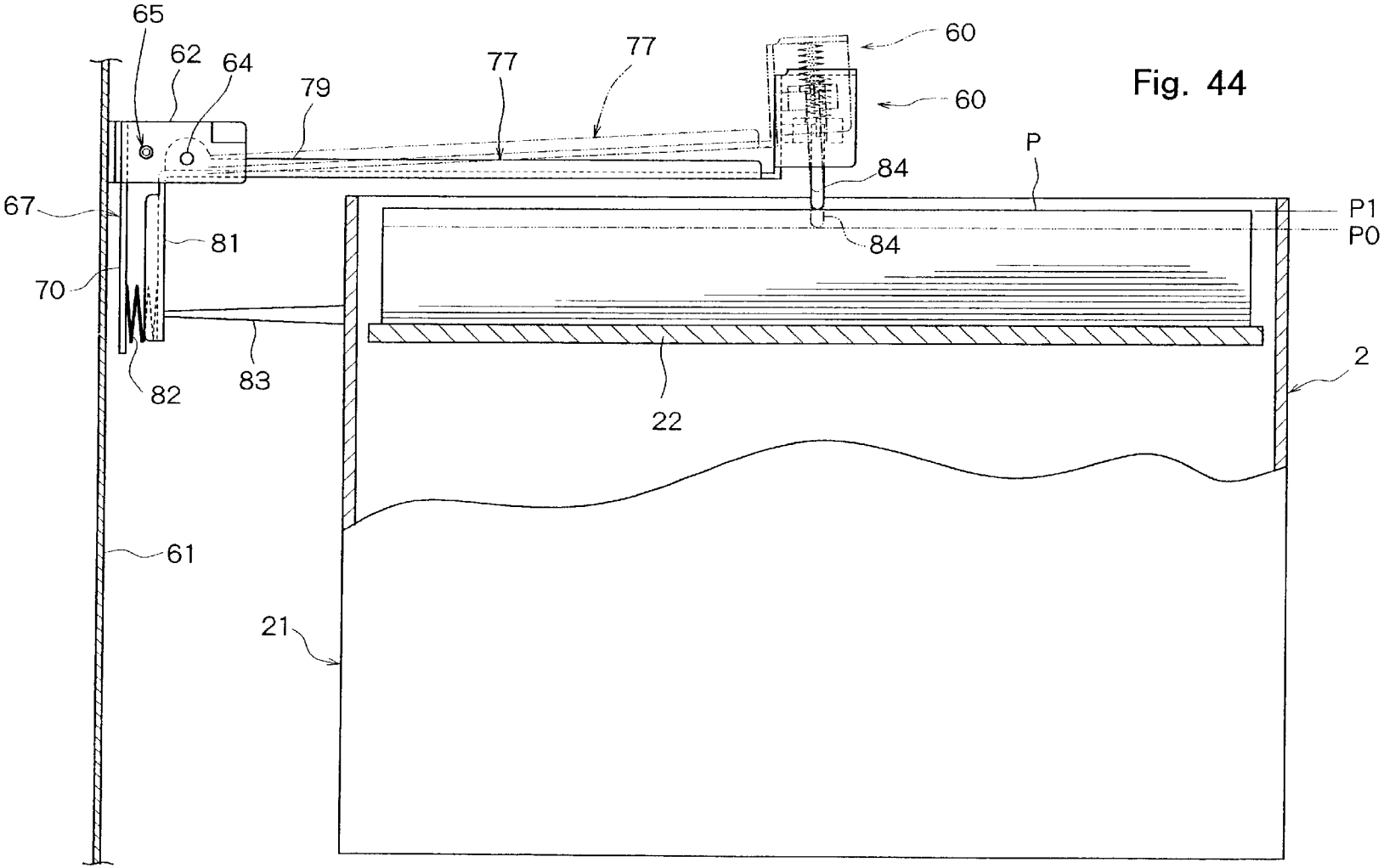
FIG. 44 is a sectional view schematically illustrating the paper feeder shown in FIG. 43.

In the embodiment shown in FIGS. 43 to 46, the frame 21 constituting the paper-placing means 2 is mounted to move back and forth (in the direction perpendicular to the surface of the paper in FIG. 43, or in the right-and-left direction in FIG. 44) substantially horizontally via a suitable mounting means, and is selectively brought to the acting position shown in FIGS. 43 and 44 and to the non-acting position drawn forward (rightward in FIG. 44) from the acting position. The paper-stacking plate 22 which may be a rectangular flat plate extending substantially horizontally, is mounted in the frame 21 so as to be moved up and down via a suitable mounting means (not shown). To the paper-stacking plate 22 is connected a lift means (not shown) which may be an electric motor via a suitable transmission means (not shown), and the paper-stacking plate 22 is moved up and down by the action of the lift means. The frame 21 is drawn out to the non-acting position where plural pieces of papers P are stacked on the paper-stacking plate 22. Thereafter, the frame 21 is moved to the acting position shown in FIGS. 43 and 44.

In the embodiment shown in FIGS. 43 to 46, a means 60 for holding down the rear end of the papers and for detecting the height of the papers is different from the means 23 for holding down the rear end of the papers and for detecting the height of the papers of the embodiment shown in FIGS. 14 to 27.

Figure 45:
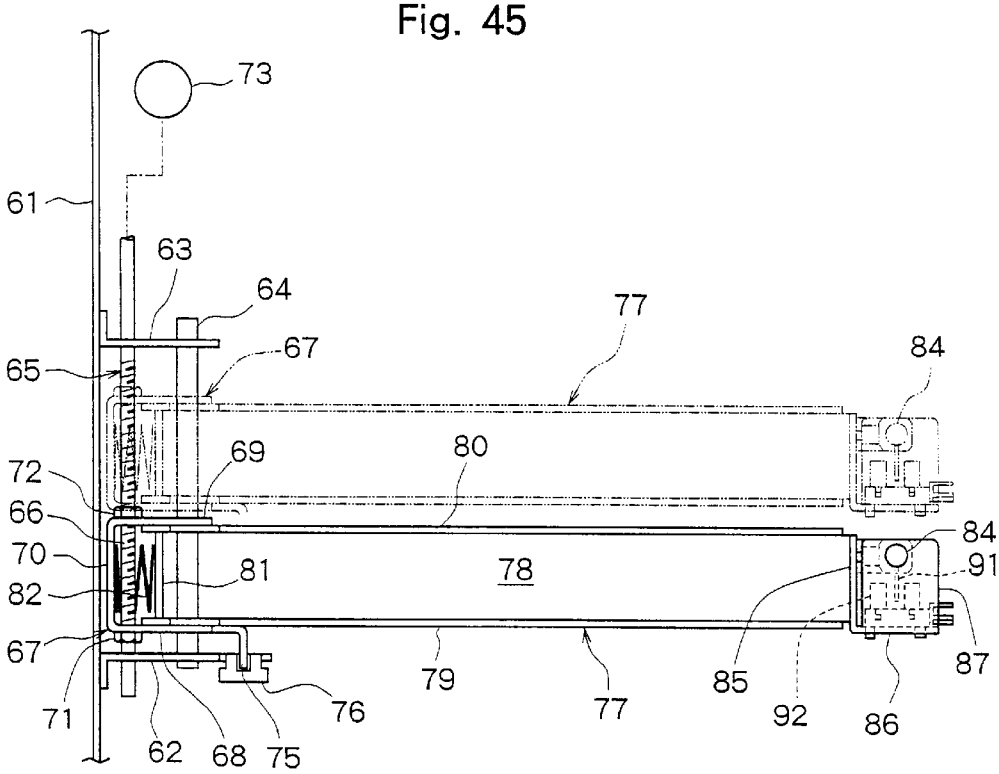
FIG. 45 is a partial plan view illustrating a paper holding/detecting means disposed in the paper feeder shown in FIG. 43.

Described below is the means 60 for holding down the rear end of the papers and for detecting the height of the papers. In the illustrated embodiment, an upright base wall 61 is disposed at a rear portion of the housing (not shown) of the image-forming machine. Referring to FIG. 45, a pair of brackets 62 and 63 are secured to the base wall 61 at a distance apart from each other in the up-and-down direction. A guide shaft 64 is secured to the brackets 62 and 63 extending from the base wall 61, and an externally threaded shaft 65 is mounted thereon so as to rotate. The guide shaft 64 and the externally threaded shaft 65 extend substantially horizontally and in parallel with each other. The externally threaded shaft 65 is externally threaded as designated at 66. The means 60 for holding down the rear end of the papers and for detecting the height of the papers includes a moving member 67 which has both side walls 68, 69 and a rear wall 70. The guide shaft 64 extends penetrating through both side walls 68 and 69 of the moving member 67 which moves along the guide shaft 64. Thus, the moving member 67 is mounted on the guide shaft 64 to move in the direction for delivering the papers P. Internally threaded blocks 71 and 72 are secured to both side walls 68 and 69 of the moving member 67, and internally threaded holes are formed in the internally threaded blocks 71 and 72 extending in the direction for delivering the papers P. The externally threaded shaft 65 extends through the internally threaded blocks 71 and 72, and is screwed into the internally threaded holes of the internally threaded blocks 71 and 72. The externally threaded shaft 65 is drivably coupled to the electric motor 73 which is favorably a pulse motor via a suitable transmission means. When the electric motor 73 is energized to rotate the externally threaded shaft 65, the moving member 67 moves along the guide shaft 64 and the externally threaded shaft 65. On the side wall 68 of the moving member 67 is integrally formed a to-be-detected piece 75 protruding downward in FIG. 45. An optical detector 76 constituted by a light-emitting element and a light-receiving element is secured to the bracket 62. As clearly illustrated in FIG. 45, when the moving member 67 is brought to a reference position indicated by a solid line in FIG. 45, the to-be-detected piece 75 is located between the two elements of the optical detector 76. It is thus detected that the moving member 67 is at the reference position.

With further reference to FIGS. 44 and 45, a support member 77 is mounted on the moving member 67. The support member 77 that is illustrated is made by cutting, bending and machining a thin metal plate, and has a belt-like wall 78 extending in the direction of width of the papers P or in the right-and-left direction in FIG. 45. The support member 77 further has both side walls 79 and 80 extending upward substantially vertically from both ends of the belt-like wall 78, the rear ends of both side walls 79 and 80 being disposed between both side walls 68 and 69 of the moving member 67 and being mounted on the guide shaft 64 so as to rotate. The support member 77 has a hanging wall 81 that hangs down from the rear end of the belt-like wall 78. The rear wall 70 of the moving member 67 extends downward beyond the lower edges of both side walls 68 and 69. A resilient urging means 82 which may be a compression coil spring is interposed between the hanging wall 81 and the rear wall 70 which face to each other. As clearly shown in FIG. 44, a contact piece 83 is protruding substantially horizontally and backward from the rear surface of the frame 21 in the paper-stacking means 2 in relation to the hanging wall 81 of the support member 77. As the frame 21 moves to the acting position shown in FIG. 44, the contact piece 83 comes in contact with the hanging wall 81 of the support member 77, thereby to move the support member 77 to the pushing/detecting position indicated by a solid line in FIG. 44 against the resilient urging action of the resilient urging means 82. When the support member is at the pushing/detecting position, the belt-like wall 78 extends substantially horizontally. When the frame 21 of the paper-stacking means 2 moves toward the right in FIG. 44 and the contact piece 83 separates away from the hanging wall 81 of the support member 77, the support member 77 moves to a separated position indicated by a two-dot chain line in FIG. 44 by resilient urging action of the resilient urging means 82.

Referring to FIGS. 43 to 45, a mounting means is disposed at the front edge of the belt-like wall 78 of the support member 77, and a pushing member 84 is mounted on the mounting means. The mounting means includes an upright wall 85 extending upward from the front edge of the belt-like wall 78, a side wall 86 extending forward from the side edge of the upright wall 85, and an upper wall 87 extending horizontally from the upper edge of the side wall 86. A guide block 88 is secured to the lower half portion of the upright wall 85. A through guide hole is perforated in the guide block 88. The guide hole may have a circular shape in cross section. A circular hole is also formed in the upper wall 87 to be in match with the guide hole in the guide block 88. The pushing member 84 in the illustrated embodiment is formed of a round rod member that passes through the hole in the upper wall 87 and through the guide hole in the guide block 88. It is desired that the pushing member 84 has a semispherical lower end (the reason will be described later). A flange 89 is formed at an intermediate portion of the pushing member 84, the flange 89 having an outer diameter larger than the inner diameter of the guide hole in the guide block 88. A resilient pushing means 90 which may be a compression coil spring is fitted to the upper part of the pushing member 84. The resilient pushing means 90 is interposed between the upper wall 87 and the flange 89, and resiliently urges the pushing member 84 downward. The downward movement of the pushing member 84 is limited as the flange 89 comes into contact with the upper surface of the guide block 88. The flange 89 of the pushing member 84 is provided with a to-be-detected piece 91 on the left side in FIG. 43 and extending downward in FIG. 45. An optical detector 92 constituted by a light-emitting element and a light-receiving element is secured to the inner surface of the side wall 86 of the mounting means. As will be further described later, the to-be-detected piece 91 passes through between the light-emitting element and the light-receiving element of the detector 92 at the time when the pushing member 84 moves up and down.

With further reference to the FIGS. 43 and 45, in the illustrated embodiment, plural pieces of papers P are stacked on the paper-stacking plate 22 of the paper-stacking means 2 by putting the front edges of the papers into the predetermined position of the paper-stacking plate 22 and at the same time, bringing the center of the papers P in the direction of width into the predetermined position of the paper-stacking plate 22, irrespective of the size of the papers P. FIGS. 43 and 44 illustrate a state in which the papers P of the A4-size of JIS standard are stacked on the paper-stacking plate 22 in so-called lengthwise side position, i.e., in the lengthwise direction of the papers P being perpendicular to the direction in which the papers P are delivered (direction perpendicular to the surface of the paper in FIG. 43 or right-and-left direction in FIG. 44). When the frame 21 in which plural pieces of papers P are stacked on the paper-stacking plate 22 is to be moved from the non-acting position to the acting position, the support member 77 of the means 60 for holding down the rear end of the papers and for detecting the height of the papers is at the separated position indicated by a two-dot chain line in FIG. 44 by resilient urging action of the resilient urging means 82, and the movement of the plural pieces of papers P stacked on the paper-stacking plate 22 is not interfered or interrupted by the pushing member 84. When the frame 21 is moved up to the acting position shown in FIGS. 43 and 44, the contact piece 83 disposed on the frame 21 acts on the hanging wall 81 of the support member 77, whereby the support member 77 is turned from the separated position indicated by the two-dot chain line in FIG. 44 to the pushing/detecting position indicated by a solid line in FIGS. 43 and 44. At this time, when a sufficiently large number of pieces of papers P are stacked on the paper-placing plate 22, the uppermost paper P is located between a height designated at P1 and a height designated at P0 in FIG. 43, and the pushing member 84 pushes the uppermost paper P by urging action of the resilient pushing means 90. When the uppermost paper P is located under the position designated at P0, the to-be-detected piece 91 attached to the pushing member 84 is located under the detection region covered by the detector 92. In this case, the paper-placing plate 22 is elevated until the to-be-detected piece 91 passes through the detection region covered by the detector 92 and arrives at an upper side thereof (i.e., until the detector 92 once detects the to-be-detected piece 91 and, then, no longer detects the to-be-detected piece 91). Then, the uppermost paper P on the paper-stacking plate 22 is brought to the height designated at P1 in FIG. 44. When a considerable number of pieces of papers P are delivered from the paper-stacking plate 22, and the position of the uppermost position P becomes as designated at P0 in FIG. 43, the to-be-detected piece 91 of the pushing member 84 passes through the detection region covered by the detector 92 and arrives at the lower side thereof. Then, the paper-stacking plate 22 is elevated again until the uppermost paper P on the paper-stacking plate 22 arrives at the height designated at P1 in FIG. 43. As will be comprehended from FIG. 44, when the frame 21 of the paper-stacking means 2 is brought to the acting position and the support member 77 of the means 60 for holding down the rear end of the papers and for detecting the height of the papers is brought to the pushing/detecting position, the pushing member 84 is pushed onto the uppermost paper P on the paper-stacking plate 22 at the center of the paper P in the direction of width of the paper P, i.e., in a direction (right-and-left direction in FIG. 44) perpendicular to the direction of delivery. Even when the papers P of different sizes are stacked on the paper-stacking plate 22, the centers of the papers P are brought into the predetermined position at all times as described above, and the pushing member 84 is pushed onto the paper P at the center in the direction of width of the paper P.

According to the present inventors' experience, it has been revealed that the following are important for performing smooth and stable feed of the papers as desired: (1) the pushing force of the pushing member 84 exerted on the uppermost paper P on the paper-stacking plate 22, (2) contact area between the uppermost paper P on the paper-stacking plate 22 and the lower end of the pushing member 84, and (3) the length in the direction in which the paper is delivered, from the rear edge of the uppermost paper P on the paper-stacking plate 22 to a position where the lower end of the pushing member 84 comes in contact.

Referring, first, to the pushing force, the present inventors have learned through their experience that the pushing force of the pushing member 84 exerted on the uppermost paper P on the paper-stacking plate 22 is desirably 10 to 80 g and, particularly, 20 to 60 g. When the pushing force is too small, the second paper P from the top or the subsequent several pieces of papers P, in addition to the above second paper P, tend to move backward when the air-blowing means 4 and the suction/feed means 3 are operated. When the pushing force becomes too large, on the other hand, the contact between the uppermost paper P and the second paper P becomes too large, and the second paper P is delivered together with the uppermost paper P, which is the overlapped paper feeding, or the uppermost paper P is not delivered due to excessive pushing force, which is the defective paper feeding.

It is desired that the contact area between the uppermost paper P on the paper-stacking plate 22 and the lower end of the pushing member 84 is as small as possible, say, not more than 100 $mm^2$. When the contact area becomes too large and in particular, when the contact length in the direction of width of the paper P increases, the air that flows between the uppermost paper P and the second paper P to separate them apart is excessively blocked and hence, the second paper P tends to be delivered together with the uppermost paper P, which is the overlapped feeding of papers. It is desired to form the lower end of the pushing member 84 in nearly a semispherical shape in order to minimize the contact area between the uppermost paper P and the lower end of the pushing member 84 and to reliably avoid damage to the paper P caused by the contact of the lower end of the pushing member 84.

It is further desired that the length L from the rear end of the uppermost paper P on the paper-stacking plate 22 to a position where the lower end of the pushing member 84 comes in contact in the direction of conveying the paper P is not more than 50 mm and particularly, not more than 30 mm. When the length L becomes too large, the length at which the uppermost paper P and the second paper are contacted with each other inevitably increases at the back of the position where the lower end of the pushing member 84 pushes the uppermost paper P. Accordingly, the second paper P tends to be delivered together with the uppermost paper P, which is the overlapped paper feeding. As described already, in the illustrated embodiment, the papers P are stacked on the paper-stacking plate 22 by bringing the front edges of the papers P into match with the predetermined position of the paper-stacking plate 22, irrespective of the size of the papers P. Therefore, the position of the rear edges of the papers P changes depending on the size of the papers P in the direction of delivery. In the paper feeder constituted according to the present invention, therefore, the position of the support member 77 on which the pushing member 84 is mounted is adjusted in the direction of delivering the paper P according to the size of the papers P on the paper-stacking plate 22. In the illustrated embodiment, the electric motor 73 is actuated to turn the externally threaded shaft 65, thereby to move the moving member 67, on which the support member 77 is mounted, along the guide shaft 64 to adjust the position of the pushing member 84. When the papers P of the A4-size of the JIS standard are stacked on the paper-stacking plate 22 in such a manner that the lengthwise direction of the papers P is the direction of width of the paper-stacking plate 22 (direction perpendicular to the delivery direction), the pushing member 84 is at the position indicated by the solid line in FIGS. 43 and 45. When the papers P of the B5-size of the JIS standard are stacked on the paper-stacking plate 22 in such a manner that the lengthwise direction of the papers P is the direction of width of the paper-stacking plate 22 (direction perpendicular to the delivery direction), the pushing member 84 is moved to the position indicated by the two-dot chain line in FIGS. 43 and 45. In the illustrated embodiment, the electric motor 73 is actuated to move the moving member 67 to automatically adjust the position of the pushing member 84. As desired, however, the moving member 67 may be moved by hand to a required position to adjust the position of the pushing member 84.

Figure 46:
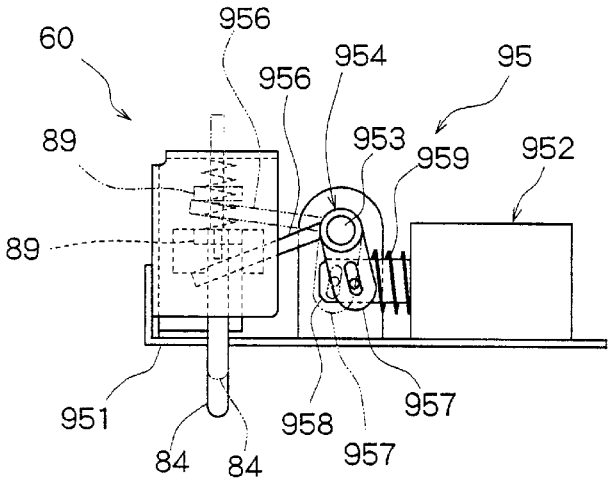
FIG. 46 is a partial front view illustrating a modified embodiment of the paper holding/detecting means.

FIG. 46 illustrates a modified embodiment in which is disposed a push-release means 95 for selectively releasing the pushing force of the pushing member 84 exerted on the uppermost paper P on the paper-stacking plate 22. In this embodiment, the support member 77 in the paper holding/detecting means 60 is secured to the moving member 67 (as desired, the support member 77 may be formed integrally with the moving member 67). A support bracket 951 is secured to the end of the support member 77, and the push-release means 95 includes an electromagnetic solenoid 952 mounted on the support bracket 951. A support pin 953 is secured to the support bracket 951, and a link member 954 is pivotably mounted on the support pin 953. The link member 954 has the first arm 956 and the second arm 957, the first arm 956 extending to the lower side of the flange 89 and the second arm 957 being pivotably coupled to the output pin 958 of the electromagnetic solenoid 952. The electromagnetic solenoid 952 is in a de-energized state at the time of moving the frame 21 (FIGS. 43 and 44) stacking plural pieces of papers P on the paper-stacking plate 22 to the acting position. In this state, the link member 954 is urged to the push-release position indicated by a two-dot chain line by resilient urging action of the coil spring 959 disposed in the electromagnetic solenoid 952, the first arm 56 of the link member 954 elevates the pushing member 84 to the separated position indicated by the two-dot chain line against the resilient urging action of the resilient pushing means 90, and the lower end of the pushing member 84 is separated away above the maximum height of the uppermost paper P on the paper-stacking plate 22. When the frame 21 is to be moved to the acting position, therefore, the papers P stacked on the paper-stacking plate 22 are not interfered by the pushing member 84. When the frame 21 is moved to the acting position, it is detected by a suitable detector (not shown), whereby the electromagnetic solenoid 952 is energized and the link member 954 is turned to a position indicated by a solid line. Thereby, the first arm 956 of the link member 954 moves down to separate away from the flange 89 of the pushing member 84. In this state, the release action of the push-release means 95 extinguishes, the pushing member is resiliently urged downward by the action of the resilient pushing means 90, and the lower end of the pushing member 84 is pushed onto the uppermost paper P on the paper-stacking plate 22. At the time of drawing out the frame 21 from the acting position to the non-acting position, when the front door of the housing (not shown) of the image-forming machine is opened prior to drawing out the frame 21, this state is also detected by a suitable detector (not shown) to de-energize the electromagnetic solenoid 952. Accordingly, the first arm 956 of the link member 954 elevates the pushing member 84 so as to separate away from the uppermost paper P on the paper-stacking plate 22. At the time of drawing out the frame 21 to the non-acting position from the acting position, too, therefore, the papers P on the paper-stacking plate 22 are not interfered by the pushing member 84. In the illustrated modified embodiment, the electromagnetic solenoid 952 is de-energized when the pushing member 84 is to be elevated and separated away from the papers P on the paper-stacking plate 22, and is energized when the pushing member 84 is to be pushed onto the papers P on the paper-stacking plate 22. If desired, however, the electromagnetic solenoid 952 may be energized when the pushing member 84 is to be elevated so as to be separated away from the papers P on the paper-stacking plate 22, and may be de-energized when the pushing member 84 is to be pushed onto the papers P on the paper-stacking plate 22.

What we claim is:

1. A paper feeder comprising:

a paper-stacking means on which the papers are to be stacked;

a suction/feed means having a drive roller and a driven roller arranged above said paper-stacking means in parallel with each other and spaced out in a direction in which the paper is conveyed, a suction duct arranged between said drive roller and said driven roller and having suction ports in the bottom wall thereof, and conveyer belts arranged wrapped round said drive roller, said driven roller and said suction port in said suction duct and having plural holes; and an air-blowing means including an air duct with plural floatation nozzles for jetting the air against an upper portion at the front end of the papers stacked on said paper-stacking means and plural separation nozzles for jetting the air toward the lower surface of said suction/feed means, and a fan connected to an end of said air duct; wherein said suction duct has ribs formed on the lower surface of the bottom wall on the upstream sides of said suction ports in the direction in which the paper is conveyed to come into contact with the conveyer belts.

2. A paper feeder according to claim 1, wherein said suction ports are formed in a plural number in the direction at right angles with the direction in which the paper is conveyed, and said ribs are formed on the upstream sides of the plural suction ports in the direction in which the paper is conveyed.

3. A paper feeder according to claim 1, wherein said ribs protrude by an amount of 1.5 to 3.5 mm from the lower surface of the bottom wall of said suction duct.

4. A paper feeder according to claim 1, further comprising a paper-limiting member made of a flexible elastic material disposed under said conveyer belts and having an upper end close to the lower surfaces of said conveyer belts on the downstream side of the papers stacked on said paper-stacking means in the direction in which the paper is conveyed.

5. A paper feeder according to claim 4, wherein the gap between the upper end of said paper-limiting member and the lower surfaces of said conveyer belts is set to be 0.3 to 3 mm.

6. A paper feeder according to claim 1, further comprising a paper-limiting member made of a flexible elastic material arranged between said conveyer belt and said conveyer belt on the downstream side of the papers stacked on said paper-stacking means in the direction in which the paper is conveyed.

7. A paper feeder according to claim 6, wherein the upper end of said paper-limiting member is not lower than the lowermost point but is not higher than the uppermost point of the paper that is undulated by being adsorbed by said conveyer belts.

8. A paper feeder comprising:

a paper-stacking means on which the papers are to be stacked;

a suction/feed means having a drive roller and a driven roller arranged above said paper-stacking means in parallel with each other and spaced out in a direction in which the paper is conveyed;

a suction duct arranged between said drive roller and said driven roller and having suction ports in the bottom wall thereof;

conveyor belts arranged wrapped around said drive roller, said driven roller and said suction ports in said suction duct, and having plural holes; and an air-blowing means including an air duct having plural flotation nozzles for jetting the air against an upper portion at the front end of the papers stacked on said paper-stacking means and plural separation nozzles for jetting the air toward the lower surface of said suction/feed means, and a fan connected to an end of said air duct, wherein a paper-limiting member made of a flexible elastic material is provided at a position near the lower surfaces of said conveyor belts on the downstream side of the papers stacked on said paper-stacking means in the direction in which the paper is conveyed, and wherein a gap between the upper end of said paper-limiting member and the lower surfaces of said conveyor belts is set to be 0.5 to 3 mm.

* * * * *